US005157413A

United States Patent [19]

Nagato et al.

[11] Patent Number: 5,157,413

[45] Date of Patent: Oct. 20, 1992

[54] THERMAL INKED RIBBON PRINTER MECHANISM

[75] Inventors: Hitoshi Nagato; Tadayoshi Ohno, both of Kawasaki; Tsutomu Kanai, Kawagoe, all of Japan

[73] Assignee: Kabushiki Kaisha Toshiba, Kawasaki, Japan

[21] Appl. No.: 311,824

[22] Filed: Feb. 17, 1989

[30] Foreign Application Priority Data

| | | | |
|---|---|---|---|
| Feb. 18, 1988 | [JP] | Japan | 63-35612 |
| May 16, 1988 | [JP] | Japan | 63-118451 |
| May 20, 1988 | [JP] | Japan | 63-123515 |
| May 27, 1988 | [JP] | Japan | 63-129913 |

[51] Int. Cl.[5] ..... B41J 2/39

[52] U.S. Cl. ..... 346/76 PH; 400/120; 400/323

[58] Field of Search ..... 346/76 PH; 400/323, 400/120

[56] References Cited

U.S. PATENT DOCUMENTS

| | | | |
|---|---|---|---|
| 4,350,449 | 9/1982 | Countryman | 346/76 PH |
| 4,527,171 | 7/1985 | Takanashi | 346/76 PH |
| 4,558,963 | 12/1985 | Applegate et al. | 400/120 |
| 4,642,658 | 2/1987 | Arakawa | 400/323 |
| 4,738,555 | 4/1988 | Nagashima | 346/76 PH |
| 4,760,405 | 7/1988 | Nagira et al. | 346/1.1 |
| 4,776,715 | 10/1988 | Takada et al. | 400/323 |

FOREIGN PATENT DOCUMENTS

| | | | |
|---|---|---|---|
| 0105472 | 4/1984 | European Pat. Off. . | |
| 0289115 | 11/1988 | European Pat. Off. . | |
| 0022059 | 2/1982 | Japan | 400/323 |
| 0136268 | 8/1984 | Japan | 400/323 |
| 61-112682 | 10/1985 | Japan . | |
| 0192656 | 10/1985 | Japan | 400/323 |
| 0192660 | 10/1985 | Japan | 400/323 |
| 0193682 | 10/1985 | Japan . | |
| 0224571 | 11/1985 | Japan . | |
| 61-58768 | 3/1986 | Japan . | |
| 0141582 | 6/1986 | Japan . | |
| 0195877 | 8/1986 | Japan . | |
| 62-170373 | 7/1987 | Japan . | |

*Primary Examiner*—Benjamin A. Fuller
*Assistant Examiner*—Huan Tran
*Attorney, Agent, or Firm*—Oblon, Spivak, McClelland, Maier & Neustadt

[57] ABSTRACT

In a thermal ink transfer printer, a print head and ink ribbon are mounted on a carriage which is moved at a first speed in a first direction along a recording paper in a first recording mode and also moved at the first speed in a second direction along the recording paper in the second recording mode. The ink ribbon is continuously fed in the second direction in the first and second modes and slides on the distal end of the print head so that ink is transferred from the ink ribbon onto the paper. Thus, the ink ribbon can be moved, relative to the paper, at a first speed and at a second speed which is different from the first relative speed.

136 Claims, 31 Drawing Sheets

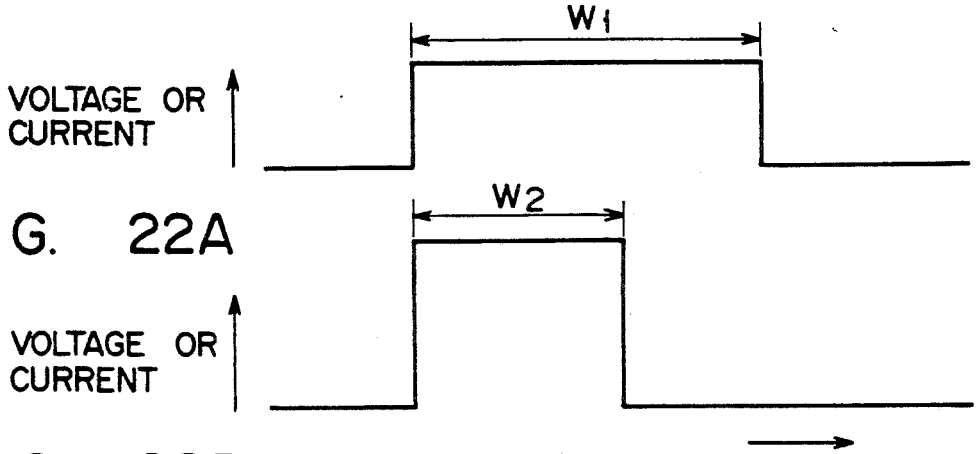
FIG. 22A
FIG. 22B
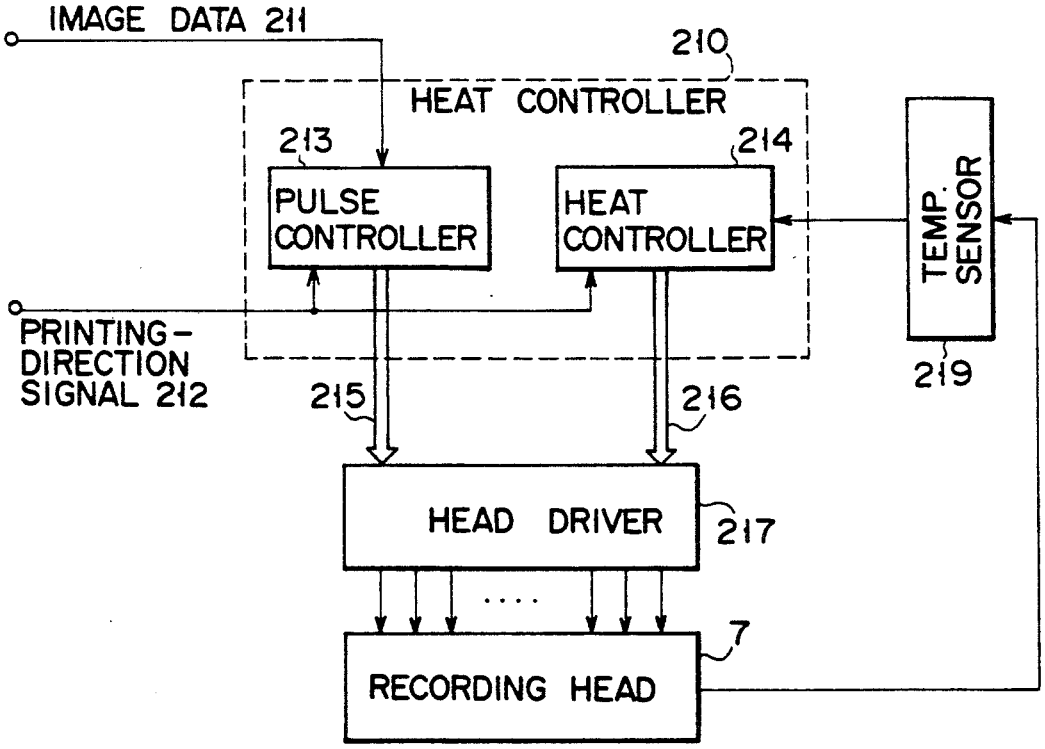
FIG. 25

THERMAL INKED RIBBON PRINTER MECHANISM

BACKGROUND OF THE INVENTION

1. Field of the Invention

The present invention relates to a thermal recording printer, and more particularly to a thermally printer having a print head or recording head which can reciprocate to print data.

2. Description of the Related Art

A thermal printer which ink is thermally transferred onto the paper is a non-impact printer. It is advantageous in some respects. First, it makes little noise while printing data. Second, it can print clear characters even on ordinary paper. Third, it is easy to maintain good printing conditions. For these advantageous features, the thermal printer is used in great numbers in office automation apparatuses of various types.

Ink ribbon shown in FIG. 1 is used for a thermal ink-transfer printer. As is shown in FIG. 1, ink ribbon 103 consists of a strip of base film 101 and an ink layer 102 coated on the base film 101. In use, the ink ribbon 103 is set in contact with the print head 105 on one side, and with recording paper 106 on the other side, as is illustrated in FIG. 1. More precisely, the ribbon 103 contacts the heat-generating elements 104 of the print head 105. The print head 105 prints data, such as characters and images, on recording paper 106, in the following way.

First, an electric current is supplied to those of the heat-generating elements 104 which have been selected in accordance with the data signals supplied to the print head 105. The selected heat-generating elements 104 generate Joule heat. The Joule heat makes those portions of the ink layer 102 which face away from the selected heat-generating elements 104 soften and, thus melted ink finally forms. The melted ink stick onto the recording paper 106 and is transferred onto it. Thus, the print head 105 prints the data, which is represented by the data signals, on the recording paper 106. During this data-printing process, the ink ribbon 103 is moved relative to the print head 105 at speed $V_R$ in the direction of arrow A, and the head 105 is moved relative to the ink ribbon 103 at speed $V_H$ in the direction of arrow B.

To increase the speed at which such the thermal ink-transfer printer can print data, the print head 105 must print data not only while moving in the direction of arrow B, but also while returning to its home position in the direction of arrow A. In other words, the head 105 must print data while reciprocating over the recording paper 106. It is regarded as difficult to make the head 105 achieve such a bidirectional printing. Why it is so regarded will be explained.

The print head 105 transfers each of the ink dots from the ink ribbon 103 to the recording paper 106 in the following manner. When one of the elements 104 of the print head 105 generates heat, that portion of ink layer 107 which faces away from this heat-generating element is first softened and then melted. The melted portion of the ink layer 107 is not immediately transferred onto the recording paper 106. Rather, it is when the melted portion cools and becomes sufficiently adhered to the paper 106 that it is peeled off the ink ribbon 103 and transferred to the recording paper 106. This portion of the ink layer 102, being transferred onto the paper 106, is shown at numeral 108 in FIG. 1.

Obviously, some time elapses from the moment said portion of the ink layer 102 is heated to the moment it is transferred onto the recording paper 106. Hence, the heat-generating element 104 has been moved for some distance in the direction of arrow B when the portion of the ink layer 102 is transferred from the base film 101 to the paper 106. The portion 108 of the ink layer 102 must be kept in contact with the recording paper 106 all the time it is moved in the direction of arrow A for some distance. This distance is somewhere between several millimeters and a few centimeters, in accordance with the printing speed of the thermal ink-transfer printer.

In order to keep the portion 108 of the ink layer 102 in contact with the paper 106 while the portion 108 is moving in the direction of arrow A for said specific distance, a ribbon-holding bar 109 is used. This bar 109 is spaced away from the head 105 for said distance and moves together with the head 105 at the same speed in the same direction. Once the ink ribbon 103 has passed the ribbon-holding bar 109, it is guided in a path extending at a predetermined angle to the recording paper. As that portion of the base film 101, on which the portion 108 of the ink layer 102 is coated, passes the ribbon-holding bar 109, the portion 108 is gradually peeled off the film 101 and transferred onto the recording paper 106, from its front edge to its last edge.

That portion of the ink ribbon 103, which extends between the heat-generating element 104 and the ribbon-holding bar 109, is held in contact with the recording paper 106. This portion of the ribbon 103 does not move relative to the paper 106 at all. Therefore, the print head 105 must move at the same speed as the ink ribbon 103, but in the opposite direction. In other words, the head 105 must move relative to the paper 106 in one direction (arrow A) at the speed $V_H$, and the paper 106 in one direction (arrow A) at the speed $V_H$, and the ribbon 103 must move relative to the head 105 in the opposite direction (arrow A) at the speed $V_R$; $V_H = -V_R$.

As may be understood from the above, the electrothermal printer is characterized in that following respects:

(1) The softened and melted portions of the ink layer are transferred from the ink ribbon onto the recording paper, while the relative speed between the ink ribbon and the recording paper is maintained at zero.

(2) Once any length of the ink ribbon has been used, whereby the portions of the ink layer have been transferred from it cannot be used again.

(3) Each portion of the ink layer, which will be one of the dots forming data to be printed on the recording paper, is not instantaneously transferred to the paper in its entirety. Rather, it is gradually transferred, from its front edge to its last edge.

FIGS. 2A and 2B illustrate a thermal ink-transfer serial printer designed, generally in accordance with the specifications described above. This printer has a carriage (not shown). As is shown in FIGS. 2A and 2B, the printer further comprises a ink ribbon cassette 110, a print head 105, and a ribbon-holding bar 109 — all mounted on the carriage. A roll of ink ribbon 103 is set within the cassette 110. The bar 109 is not located such that portion of the ribbon 103 which extends between the head 105 and the bar 109 is kept in contact with recording paper 106 as is illustrated in FIG. 1. Rather, the bar 109 is arranged such that the ribbon 103 is already guided in a path inclined to recording paper 106 at several degrees to ten and odd degrees, when it reaches the ribbon-holding bar. Only in this respect, this printer is different from the printer shown in FIG. 1. In the case of a serial printer, it suffices to keep the ink ribbon in contact with the recording paper 106 for a short distance between the heat-generating elements, on the one hand, and the downstream edge of the print head 105, on the other hand. This is because any melted portion of the ink layer can become viscous enough to stick onto the paper 106, while moving from the heat-generating element to the down-stream edge of the head 105. Hence, the ribbon-holding bar 109 does not serve to keep said portion of the ink layer in contact with the paper 106 for the time required for this portion to become sufficiently viscous. Rather, the bar 109 functions to remove the ink ribbon 103 from the recording paper 106.

As is shown in FIG. 2A, the print head 105 is pressed toward a platen 113, whereby the recording paper 106 is held between the head 105 and the platen 113. In this condition, an electric current is supplied to the selected ones of the heat-generating elements of the head 105, whereby data is printed on the recording paper 106. During this process, the print head 105 and the cassette 110 containing the ribbon 103, both mounted on the carriage (not shown), are moved at speed V in the direction of arrow B. At the same time, the ink ribbon 103 is fed in the direction of arrow A from the supply reel 111 of the cassette 110, and is taken up around the take-up reel 112 of the cassette 110. The ribbon 103 moves relative to the print head 105 at speed −V, whereby the melted portions of the ink layer 102 are transferred from the ribbon 103 onto the recording paper 106. Since the ink ribbon 103 is pinched between the heat-generating elements, on the one side, and the recording paper 106, on the other side, the ink ribbon 103 cannot be taken up at any speed other than −V.

As soon as the print head 105 prints one line of characters on the recording paper 106, the carriage is moved toward its home position as is shown in FIG. 2B, that is, in the direction of arrow C. While the carriage is returning to the home position, the print head 105 does not press the ink ribbon 103 onto the recording paper 106, nor is the ink ribbon taken up at all.

A thermal ink-transfer printer, wherein the print head and the recording paper which move relative to each other, is regarded as unable to carry out bidirectional printing, that is, to print data not only while the carriage is moving from its home position, but also while the carriage is returning to its home position. The time required for one carriage-return is almost the same as the time required for the carriage to move from the home position to the printing-end position. Hence, unless the print head prints data also while the carriage is returning to the home position, the printing speed of the thermal ink-transfer printer cannot be increased.

It is due to the characterizing features (1) to (3) that the thermal ink-transfer printer cannot accomplish bidirectional printing. Nonetheless it is much demanded that a thermal printer which ink is thermally transferred onto the paper capable of performing bidirectional printing be developed. To make this demand realize, a variety of modified thermal printers as mentioned above have been proposed which can carry out bidirectional.

Japanese Patent Disclosures No. 61-58768 and No. 61-112682 disclose a thermal ink-transfer printer having a carriage and two head-cassette units mounted on the carriage. Each head-cassette unit comprises a print head and a cassette containing a roll of ink ribbon. The first head-cassette unit is used to print data while the carriage is moving away from its home position, and the second head-cassette unit is used to print data while the carriage is returning to its home position. Indeed this printer can achieve bidirectional printing, but it becomes large size since it has two print heads and two ink-ribbon cassettes.

Further, Japanese Patent Disclosure No. 60-224571 discloses a thermal ink-transfer printer having one print head and one ribbon cassette, both mounted on the carriage. In the cassette, an ink ribbon is set in turning back of the ink ribbon such that the two portions are able to be located one above the other near the print head and are allowed to move in the opposite directions, respectively. The print head is moved up and down relative to the two portions of the ink ribbon. The print head is pressed to the lower portion of the ink ribbon while the head is moving away from its home position, thus printing data. On the other hand, the print head is pressed to the upper portion of the ink ribbon, while the head is moving toward the home position, thereby printing data. Obviously, the printer needs an add-mechanism for move the head or the cassette up and down. Further, the cassette has a complex structure since the ink ribbon must be turned back, and the resultant two portions of the ribbon must be located, one above the other. Still further, since the ink ribbon is turned back within the cassette, it is fed from the supply reel and taken up around the take-up reel, more slowly than in the case where the ribbon travels straight within the cassette. Consequently, the printer cannot print data at high speed.

Japanese Patent Disclosure No. 60-193682 discloses a thermal ink-transfer printer which has one print head and two ink ribbon cassettes. The cassettes are located one above the other. The two rolls of ink ribbon, which are set in the cassettes, respectively, are fed in the opposite direction, respectively. This printer also needs a mechanism for moving the ribbon cassettes up and down, and is inevitably larger than otherwise.

Japanese Patent Disclosure No. 61-141582 and U.S. Pat. No. 4,577,198 disclose a thermal ink-transfer printer which uses a strip of ink ribbon having a width twice as great as the print width of the print head. The ink ribbon is moved up so that the head contacts the lower half of the ribbon, or down so that the head contacts the upper half of the ribbon. Further, the ribbon is moved in a direction or the opposite direction, in accordance with the direction in which the print head is moved to print data. Since the printer also needs a mechanism for moving the cassette up and down, it is inevitably large.

Japanese Patent Disclosure No. 61-195877 discloses a thermal ink-transfer printer which uses reusable ink ribbon and can perform bidirectional printing. The ribbon is fed from the first reel and taken up around the second reel while the print head is moving away from its home position, thereby printing data. The same ribbon is fed from the second reel and taken up around the first reel while the head is returning to its home position, thus printing data. The ink ribbon is replaced by new one when it become no longer usable. Ink ribbon reusable in thermal ink-transfer printers is generally less sensitive to heat than one-time use ink ribbon, and is hence less suitable for high-speed printing. Further, the more times the ribbon is used, the lower the print density it provides. Therefore, this thermal ink-transfer printer can hardly be recommended for printing characters or an image in various gray levels.

As has been pointed out, the thermal ink-transfer printer, which uses two ribbon cassettes or one ribbon cassette of special design to accomplish bidirectional printing, is inevitably large and expensive. On the other hand, the thermal ink-transfer printer, which uses a single cassette containing reusable ink ribbon, need not be large, but it can hardly achieve high-speed, high-quality bidirectional printing.

SUMMARY OF THE INVENTION

The object of the present invention is to provide a thermal printer which uses an ordinary ribbon cassette of simple design, containing one-time ink ribbon, and can yet perform bidirectional printing.

According to the invention, there is provided a thermal printer for printing patterns on recording surface by transferring ink onto the recording surface, said printer comprising ink ribbon having an ink layer, energy-applying means having a distal end which contacts the ink ribbon when the printer is set in a recording mode, for applying recording energy to the ink ribbon through the distal end, whereby that portion of the ink layer which contacts the recording surface is transferred onto the recording surface, drive means for driving said energy-applying means in a first direction in a first drive mode, and in a second direction, which is opposite to the first direction, in a second drive mode, such that the distal end of said energy-applying means slides on the ink ribbon, and ribbon-feeding means for continuously feeding the ink ribbon in the second direction, thereby to move the ink ribbon at a first speed relative to the recording surface while said drive means is driving said energy-applying means in the first drive mode, and at a second speed relative to the recording surface while said drive means is driving said energy-applying means in the second drive mode.

According to the invention, there is also provided a thermal ink transfer printer for printing patterns on recording surface by transferring ink onto the recording surface, said printer comprising ink ribbon having an ink layer, means for generating heat including heating elements which contacts the ink ribbon when the printer is set in a recording mode, and which are arranged in a line, for applying heat to the ink ribbon whereby that portion of the ink layer which contacts the recording surface is softened and transferred onto the recording surface, drive means for driving said heat-generating means in a first direction in a first drive mode, and in a second direction, which is opposite to the first direction, in a second drive mode, such that the heating elements of said heat-generating means slides on the ink ribbon, and ribbon-feeding means for continuously feeding the ink ribbon in the second direction, thereby to move the ink ribbon at a first speed relative to the recording surface while said drive means is driving said heat-generating means in the first drive mode, and at a second speed relative to the recording surface while said drive means is driving said heat-generating means in the second drive mode.

Furthermore, according to the invention, there is provided an electrothermal printer for printing patterns on recording surface by transferring ink onto the recording surface, said printer comprising ink ribbon having a heat-generating layer and an ink layer formed on the heat-generating layer, means for applying a recording current to said ink ribbon, including recording electrodes which contact the ink ribbon when the printer is set in a recording mode, and which are arranged in a line, for supplying the recording current to the ink ribbon, whereby said heat-generating layer generates heat, and said ink layer is softened by Joule-heat generated by said heat generating layer and transferred onto the recording surface, drive means for driving said current applying means in a first direction in a first drive mode, and in a second direction, which is opposite to the first direction, in a second drive mode, such that the recording electrode of said current-applying means slides on the ink ribbon, and ribbon-feeding means for continuously feeding the ink ribbon in the second direction, thereby to move the ink ribbon at a first speed relative to the recording surface while said drive means driving said current applying means in the first drive mode, and at a second speed relative to the recording surface while said drive means is driving said current applying means in the second drive mode.

BRIEF DESCRIPTION OF THE DRAWINGS

FIGS. 22A and 22B show the waveforms of current-supply pulses which help to solve the problem explained with reference to FIGS. 21A to 21C;

FIG. 25 is a block diagram showing a printer circuit which is incorporated in the thermal printer according to the invention and which serves to solve the problem discussed with reference to FIGS. 21A to 21C;

DETAILED DESCRIPTION OF THE PREFERRED EMBODIMENTS

Figure 3:
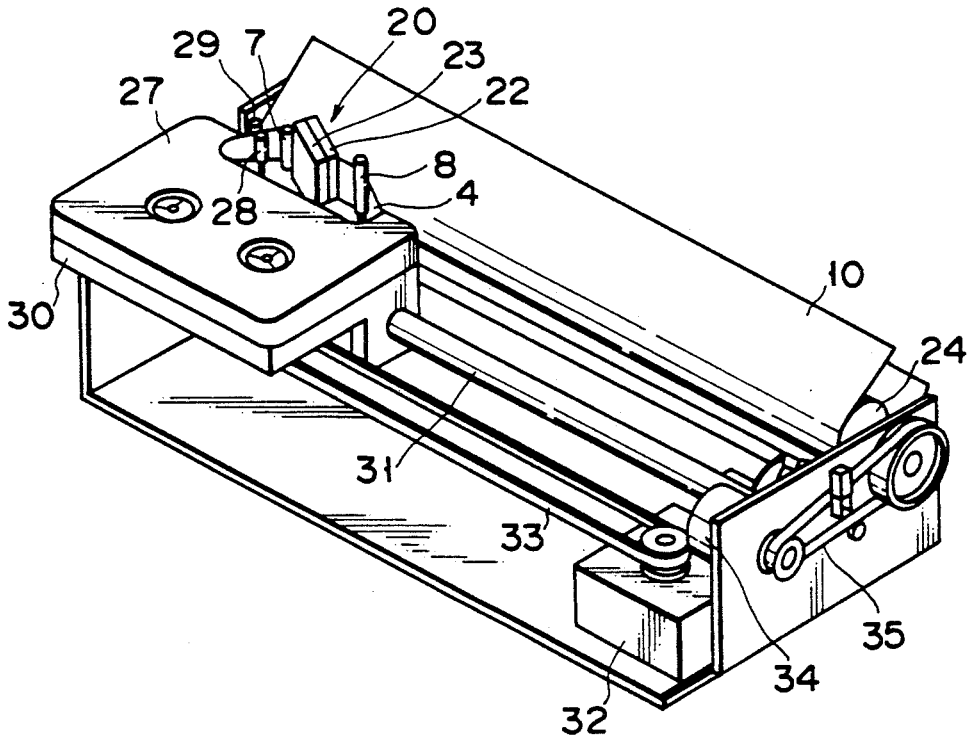
FIG. 3 is a perspective view showing an electrothermal printer according to the present invention, which uses heat-generating, and electrically resistive ink ribbon.
Figure 4:
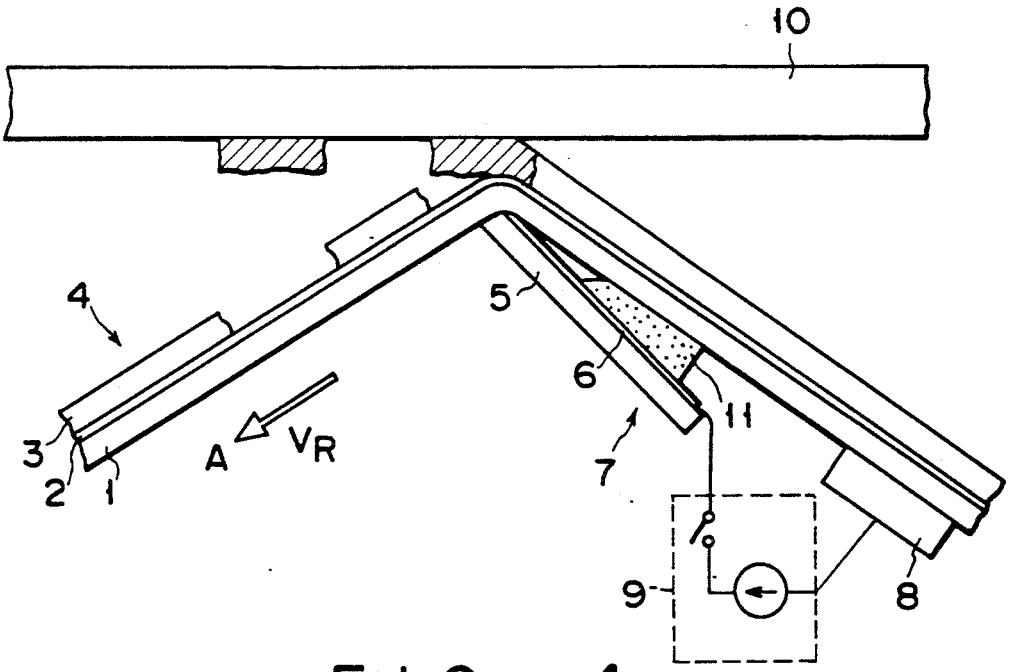
FIG. 4 is diagram representing the positional relationship between the recording head, the return electrode, the ink ribbon, and the recording paper, in the electrothermal printer shown in FIG. 3.

FIGS. 3 and 4 show an electrothermal printer according to the present invention, which can perform bidirectional printing by using heat-generating, electrically resistive ink ribbon. As is illustrated in FIG. 4, the ink ribbon 4 is made of base film 1, a conductive layer 2 formed on the base film 1, and a heat-sensitive ink layer 3 coated on the conductive layer 2. The base film 1 is electrically resistive and generates heat when an electric current flows in it. The layer 2 is electrically conductive, and an electric current, or a recording current, can readily flow through it. The materials of these components of the ink ribbon 4 will be detailed later.

As is shown in FIG. 3, the electrothermal printer has a recording head 7. The head 7 comprises a base 5 and signal electrodes 6 arranged on the base 5, parallel to each other at the density of 12 electrodes per millimeter. (For example, 50 signal electrodes are arranged on the base 5.) As is shown in FIG. 3, the recording head 7 is attached to a pair of head holders 22 and 23. The head 7 and the holders 22 and 23 constitute a recording head assembly 20. The recording head assembly 20 is pressed onto a platen 24 by a bias means (not shown) when the printer is set in recording mode. A return electrode 8 is located near the reel from which the ink ribbon 4 is fed, and spaced away from the recording head 7. The return electrode 8 is kept in contact with the resistive base film 1.

Figure 5A:
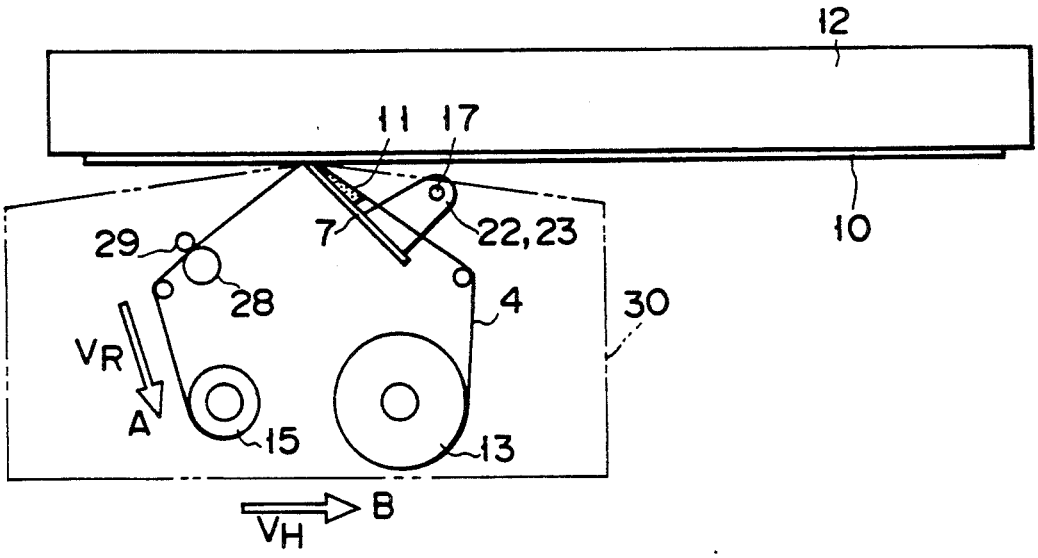
FIGS. 5A and 5B explain the directions and speeds at which the ink ribbon and the carriage are moved in the electrothermal printer illustrated in FIG. 3.
Figure 5B:
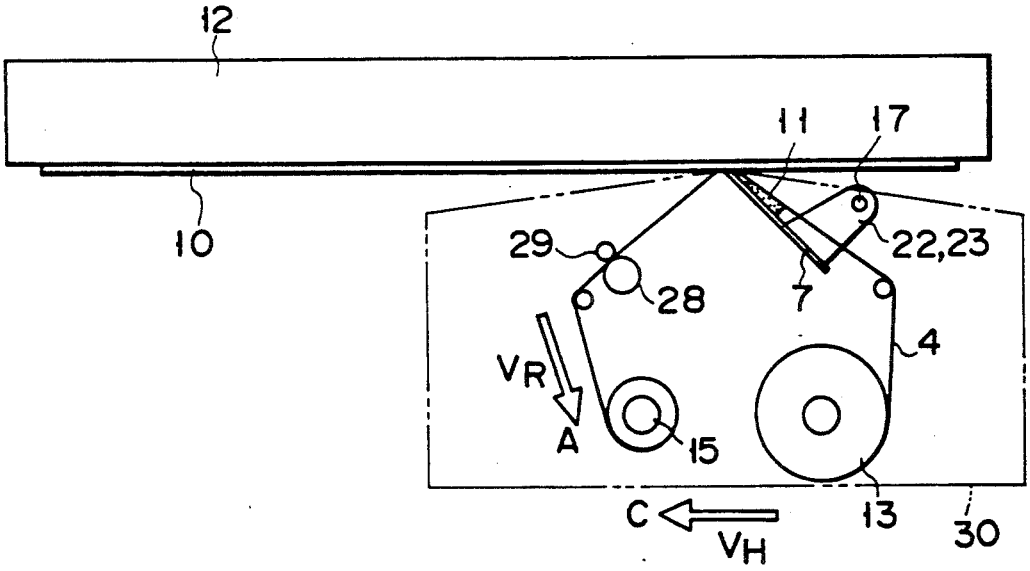

The ink ribbon 4 is contained in an ink ribbon cassette 27. As is shown in FIGS. 5A and 5B, the ribbon 4 is pinched by pinch rollers 28 and 29 and is fed as these rollers 28 and 29 rotate. The cassette 27 and the pinch rollers 28 and 29 are mounted on a carriage 30. This carriage 30 can be movably supported by a guide bar 31 which extends parallel to the platen 24. A motor 32 for driving the carriage 30 is located within the housing of the printer, at the one side of the housing. A pulley is connected to the shaft of motor 32. A pulley (not shown) is located within the housing, at the opposite side thereof. A timing belt 33, which is an endless belt, is wrapped around the pulleys. The carriage 30 is fastened to the timing belt 33. Hence, when the motor 32 is rotated in one direction, the timing belt 33 drives the carriage 30 in one direction along the guide bar 31, and hence along the platen 24.

Another motor 34 is located within the housing of the printer, near the motor 32. A pulley is connected to the shaft of this motor 34. A pulley is also connected to one end of the platen 24. A timing belt 35 is wrapped around these pulleys. Therefore, when the motor 34 is rotated in one direction, the timing belt 35 rotates the platen 24 in one direction, there by to feed recording paper 10 wound around the platen 24.

In response to a record-starting signal which has been input to the electrothermal printer, the motor 32 drives the timing belt 33 such that the carriage 30 is moved from its home position, i.e., the left end of the guide bar 31, to a record-starting position. At the record-starting position, the recording head 7 is pressed onto the ink ribbon 4. The ribbon 4 in turn is pressed onto the recording paper 10 wound around the platen 24. In this condition, the recording head 7 can print data, such as images and characters, on the recording paper 10, by using the ink ribbon 4.

As is illustrated in FIG. 4, when the printer is set in the recording mode to print data on the paper 10, a recording circuit 9 supplies a recording current to the selected ones of the signal electrodes 6 of the recording head 7. The currents supplied to the selected recording electrodes 6 flow to the return electrode 8 through the base film 1 and the conductive layer 2. Those portions of the base film 1 which contact the selected electrodes 6 generates Joule heat, which melts those portions of the ink layer 3 which face away from the selected electrodes 6. The resultant melted ink are transferred onto the recording paper 10, whereby the data is printed on the paper 10.

The recording current flows through the base film 1 not only when it flows from the selected signal electrodes 6 to the conductive layer 2, but also when it flows from the conductive layer 2 to the return electrode 8. Nonetheless, the base film 1 near the return electrode generates no Joule heat which is so intense as to melt the ink layer 3. This is because the contacting area of the ink ribbon 4 and the return electrode 8 is sufficiently large.

The electrothermal printer, which uses the resistive ink ribbon 4, can print data on the recording paper 10 even if the ribbon 4 and the paper 10 move relative to each other, and can thus accomplish bidirectional printing. More specifically, as is shown in FIG. 4, the ink ribbon 4 is bent in the form of letter V while it is fed, and its bent portion is held in multi-point contact or line-contact with the recording paper 10. Owing to this multi-point contact or line-contact, the friction between the ribbon 4 and the paper 10 is small enough to allow the ribbon 4 and the paper 10 to move relative to each other. As is shown in FIG. 4, the printer has a ribbon guide 11 which guides the ink ribbon 4 into the gap between the head 7 and the paper 10 at a specified angle.

Figure 1:
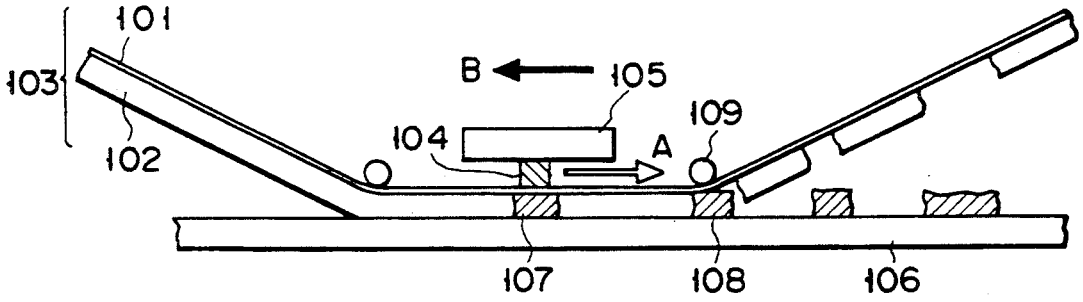
FIG. 1 PRIOR ART
FIG. 1 is a diagram explaining how a conventional thermal ink-transfer printer prints data on recording paper.

Any melted portion of the ink layer 3 is transferred onto the recording paper 10 while the ink ribbon 4 remains in multi-point contact or line-contact with the paper 10. This means that the ribbon 4 is removed from the paper 10 immediately after the ink has been transferred onto the recording paper 10. (In this respect, the printer of this invention differs from the conventional printer (FIG. 1) in which the ink ribbon 103 is removed from the paper 106 some time after the selected heat-generating elements 104 have generated heat.) Therefore, the ink layer 3 of the ribbon 4 is made of such material as firmly adheres to the paper 10 as soon as it touches the paper 10. To be precise, the material of the ink layer 3 contains more resin than the ink layer 102 of the ribbon 103 used in the conventional thermal ink-transfer printer (FIG. 1). Such ink material is known to be suited for printing data on paper having rough surface-texture. It can adhere to rough-surface paper even if the ink ribbon is removed from the paper immediately after heat has been applied to the ink material, for the following reason.

The melted ink solidify rather quickly, and they do not have time to flow into and fill the cavities in the surface of the paper, with the result that air pockets are formed. Hence, the solidified melted ink contact only the peaks defining the cavities. Nonetheless, the adhesion between each solidified melted ink, on the one hand, and the peaks, on the other, is sufficiently strong because of the high resin-content of the ink material.

The ink layer 3 has a melting point higher than the ink layer 102 of the ink ribbon 103 which is of ordinary type. Despite this, any desired portion of the layer 3 can readily be melted since the heat generated by conductive layer 2 is applied concentratedly to the desired portion of the layer 3. Thus, the electrothermal printer of this invention, which uses the resistive ink ribbon 4, can print data at high speed, even on paper having rough surface-texture.

As has been pointed out, the electrothermal printer according to the invention is characterized in three respects. First, the contacting area of the ink ribbon 4 and the recording paper 10 is minimized. Secondly, the ribbon 4 and the paper 10 can moved relative to each other, due to the small contacting area of them. Third, the ink layer 3 is made of a high resin-content material, so that data can be printed on the paper 10 even if the paper has rough surface-texture, and even if the ribbon 4 is removed from the paper 10 immediately after the ink layer 3 has been melted. These characterizing features enable the printer to accomplish bidirectional printing.

The recording head 7 applies a pressure to the ink ribbon 4 during the data-printing process. This pressure must be moderate. If it is too great, the ink ribbon 4 and the recording paper 10 can no longer move relative to each other, disabling the electrothermal printer to perform bidirectional printing.

FIGS. 5A and 5B show how the carriage 30 is driven, and how the ink ribbon 4 is supplied, so that the printer shown in FIG. 3 accomplishes bidirectional printing. More precisely, FIG. 5A explains how the ink ribbon 4 is fed when the carriage 30 moves in the direction of arrow B, and FIG. 5B illustrates how the ribbon 4 is supplied when the carriage moves in the reverse direction, i.e., in the direction of arrow C. The carriage 30 is moved at speed $V_H$, in either direction. In whichever direction the carriage is driven, the ink ribbon 4 is supplied from a supply reel 13, then contacts ribbon guide 11, is pressed onto the paper 10 by the head 7, is fed forward by a pair of take-up rollers 28, 29, and finally and is taken up around a take-up reel 15. The ink ribbon 4 is contained in the cassette 27 which is mounted on the carriage 30.

The take-up rollers 28, 29 are rotated automatically when the carriage 30 is moved in either direction of arrow B or C, and feed the ink ribbon 4 in the direction of arrow A. To be more precise, one of the rollers 28 is connected a clutch-gear unit (not shown), which includes a one-way clutch and a few gears. One of the gears is in mesh with a lack extending parallel to the guide part 31 on which carriage 30 is slidably mounted. The clutch-gear unit is designed such that the roller 28 is rotated in the same direction as the carriage 30 moves in either direction. The roller 28 has such a diameter and is rotated at such a speed that the ribbon 4 is taken up around the reel 15 at speed $V_R$ identical to speed $V_H$ of the carriage 30.

As has been described, the recording head 7 is attached to the head holders 22 and 23. As is shown in FIGS. 5A and 5B, the holders 22 and 23 have holes 17. A pin is loosely fitted in this holes 17. Thus, both holders 22 and 23 can rotate about the pin, and so can rotate the recording head 7. To print data on the recording paper 10, the head 7 is rotated in one direction until it presses the ink ribbon 4 onto the paper 10, which in turn is pressed onto the platen 12. As a result, the head 7, the ribbon 4, and the paper 10 remains in line-contact with one another. During a non-printing period, the head 7, the ribbon 4, and the paper 10 are released from one another.

The ribbon guide 11 is made of metal which is electrically conductive, and is connected to the ground. Therefore, the guide 11 performs the same function as the return electrode 8 shown in FIGS. 3 and 4.

To print data in the forward direction, the recording head 7 is moved at speed $V_H$ in the direction of arrow B, and the ink ribbon 4 is fed from the supply reel 12 at speed $V_R$ in the opposite direction, i.e., the direction of arrow C. Hence, the ink ribbon 4 moves relative to the recording paper 10 at speed $V_H - V_R$, where speed $V_H$ at which the head 7 moves forward is regarded to have a positive value. Since $V_H = V_R$, the ribbon 4 and the paper 10 do not move relative to each other. Hence, it is an unused portion of the ink ribbon 4 that contacts an unused portion of the recording paper 10. The recording head 7 can, therefore, achieve high-quality printing of data.

To print data in the reverse direction, the head 7 is moved at speed $V_H$ in the direction of arrow C, and the ink ribbon 4 is fed from the supply reel 13 at speed $V_R$ in the opposite direction, i.e., the direction of arrow C. Hence, the ink ribbon 4 moves relative to the recording paper 10 at speed $-(V_H + V_R)$. Since $V_H = V_R$, the ribbon 4 moves relative to the head 7 at speed $2V_H$ in the direction of arrow C. Hence, the unused portion of the ink ribbon 4 is continuously supplied to the recording head 7. Although the ink ribbon 4 moves relative to the recording paper 10 while head 7 is moving in the reverse direction, the unused portion of the ribbon 4 is supplied to the recording head 7, unlike in the conventional thermal printer (FIG. 1). The printer according to the present invention can, thus, accomplish bidirectional printing.

Figure 2A:
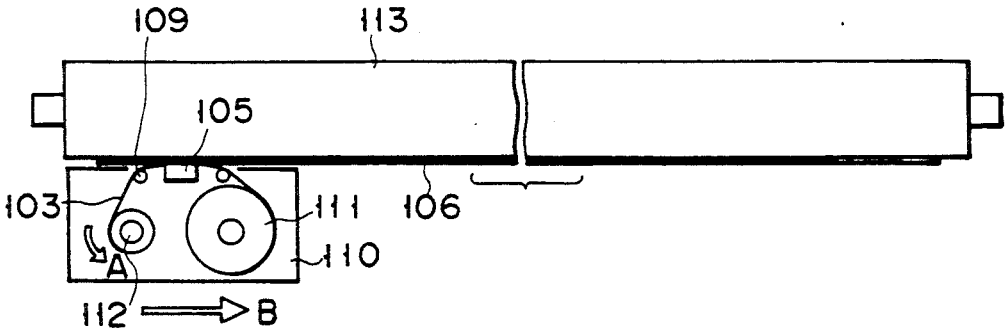
FIG. 2A PRIOR ART
FIGS. 2A and 2B are plan views showing the positional relationship between the carriage and the platen of the conventional thermal ink-transfer printer.
Figure 2B:
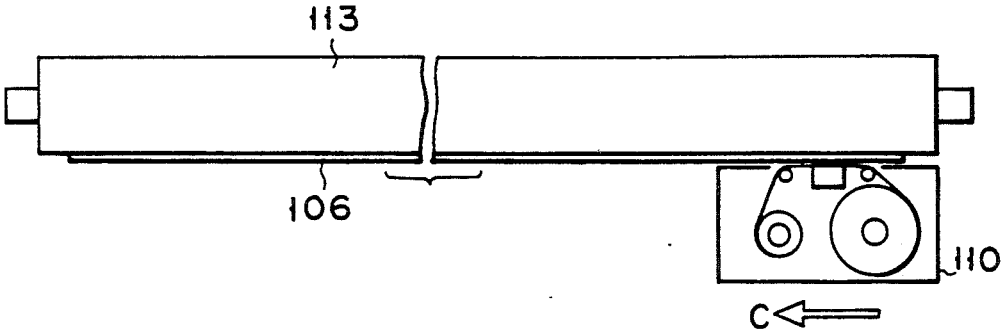
FIG. 2B PRIOR ART

The electrothermal printer shown in FIG. 3 can print data about twice faster than the prior art electrothermal printer which cannot achieve bidirectional printing. If the electrothermal printer has printing speed of 100 cps, it can print data almost at the same speed as an electrothermal printer which has printing speed of 100 cps and which prints data only in one directions. Where the conventional printer to print data at 200 cps, the carriage, on which the head 105 and the ribbon cassette 110 are mounted, should be moved twice as fast. The motor for driving the carriage should be more powerful. The more powerful the motor, the more power it consumes, and the greater noise or vibration it causes. Furthermore, to make the conventional printer (FIGS. 2A and 2B) print data at 200 cps, a greater recording current must be supplied to the print head 105. Hence, the conventional printer needs a greater power source. When it uses resistive ink ribbon to print data at 200 cps, the ribbon may be cut during use, due to the intense heat generated from the large recording current flowing in the ribbon.

Figure 6A:
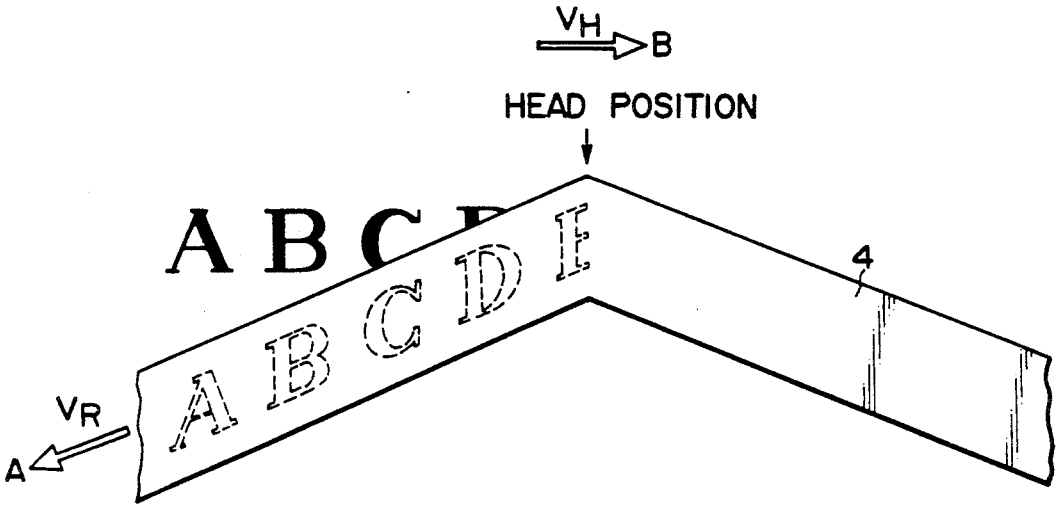
FIGS. 6A and 6B illustrate how the portions of the ink layer are transferred from the ink ribbon onto the recording paper when the printer shown in FIG. 3 prints data in the forward direction and the reverse direction.
Figure 6B:
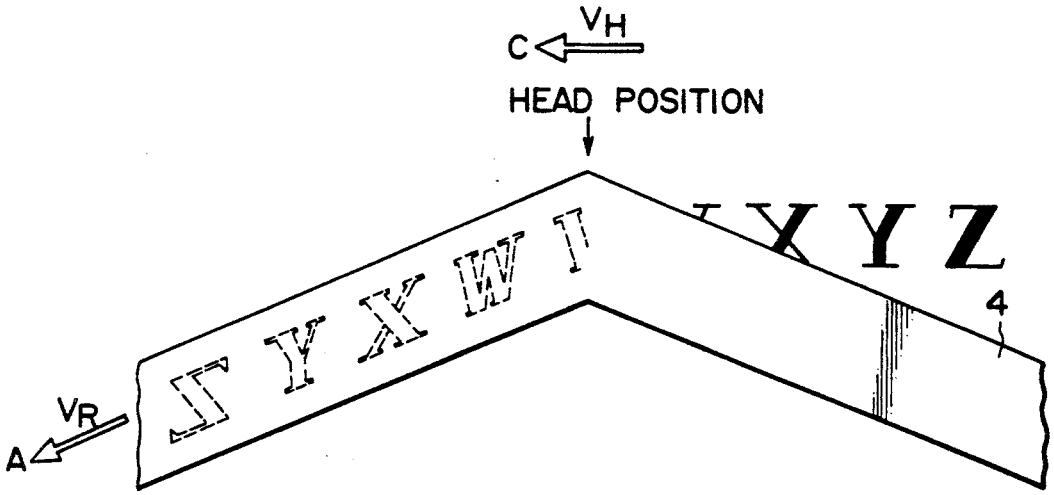

FIG. 6A shows how the printer (FIG. 3) prints characters on the recording paper 10 when the recording head 7 is moved in the forward direction (arrow B). FIG. 6B shows how the printer prints characters on the paper 10 when the head 7 is moved in the reverse direction (arrow C). As the head 7 moves to the right, it prints characters in the normal order as is evident from FIG. 6A. Since the ink ribbon 4 is fed to the left at the same speed as the head 7, it does not move relative to the paper 10. Thus, the printed characters align with those portions of the ink ribbon 4 from which the ink has been transferred to the paper 10. On the other hand, as the head 7 moves to the left, it prints characters in the reverse order, each character from the rear edge to the front edge, as is evident from FIG. 6B. In this case, the data items representing the characters and stored in a one-line buffer (not shown) are read out in the reverse order. Hence, that portion of the ribbon 4 from which the ink has been transferred, thus forming the last character on the paper 10, is first removed from the paper 10, and this portion of the ribbon 4 has an image of the character which is inverted the left side right, as is evident from FIG. 6B.

An electrothermal printer according to a second embodiment of the present invention, which can perform bidirectional printing and save ink ribbon, will now be described.

In the case of the printer according to the first embodiment shown in FIG. 3, the ink ribbon 4 and the recording paper 10 do not move relative to each other when the carriage 30 moves in the forward direction (arrow B). By contrast, in the printer according to the second embodiment, the ribbon 4 and the paper 10 move relative to each other, not only when the carriage 30 moves in the reverse direction (arrow C) but also when the head 7 moves in the forward direction (arrow B). In other words, the carriage 30 is moved in the forward direction faster than the ink ribbon 4 is fed, that is, $V_H > V_R$, while the carriage 30 is moving in the forward direction. Therefore, the recording head 7 moves a longer distance than the ink ribbon 4 is fed from the supply reel 13. In other words, the ratio of the ribbon-feeding length to the print length is less than unity, regardless of the direction in which the head 7 moves to print data, whereas, in the printer shown in FIG. 3, the ratio of the ribbon-feeding length to the print length is 1. Hence, the printer can print a greater amount of data than the printer shown in FIG. 3, by using the same length of the ink ribbon 4.

When the ratio of the ribbon-feeding length to the print length is less than unity, the same portion of the ribbon 4 may be used again to print data, and the density of the printed data may be lower than otherwise. Nonetheless, the experiments, which the inventors hereof had conducted, revealed that the print quality is sufficient as long as the ratio of the ribbon-feeding length to the print length is greater than about 0.5, that is, $V_R$ is greater than $\frac{1}{2} V_H$. This is perhaps because, though the ribbon 4 is removed from the head 7 immediately after a portion of the ink layer 3 has been transferred to the paper 10, the adjacent portion of the ink layer 3, which is to be transferred to the paper 10, is also heated and viscous and is coated onto that portion of the conductive layer 2 from which the ink layer has been transferred.

As can be understood from the above, the electrothermal printer according to the second embodiment of the invention not only can perform bidirectional printing, but also can save ink ribbon.

Figure 7A:
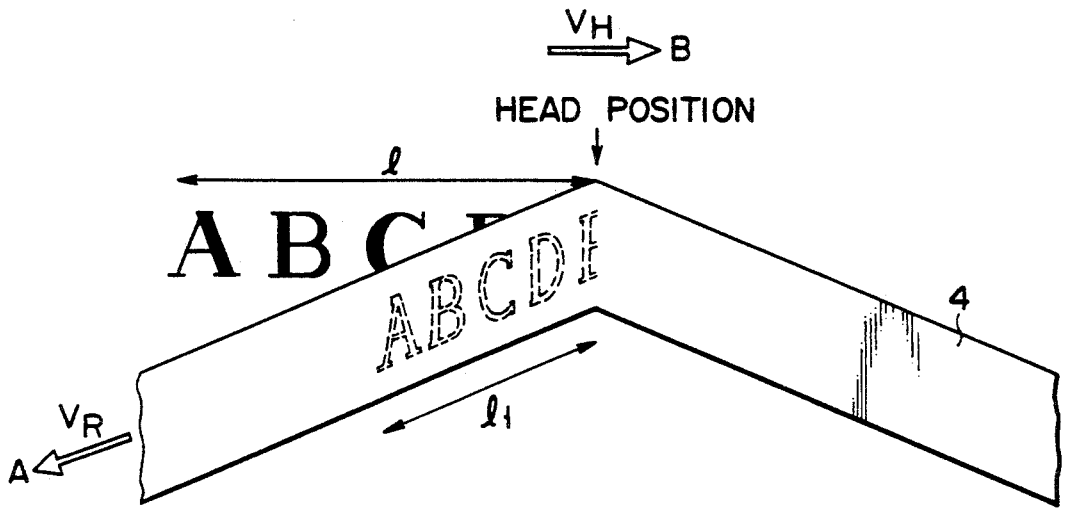
FIGS. 7A and 7B explain how the portions of the ink layer are transferred from the ink ribbon onto the recording paper when the printer shown in FIG. 3 prints data in the forward direction and the reverse direction in the ribbon-saving mode.
Figure 7B:
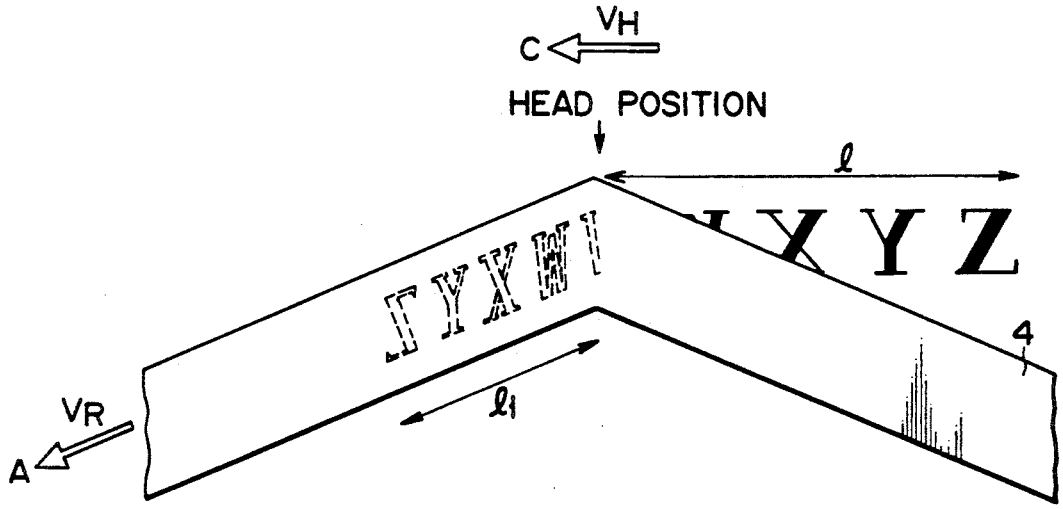

FIG. 7A shows how the printer according to the second embodiment of the invention prints characters on the recording paper 10 when the recording head 7 is moved in the forward direction (arrow B). FIG. 7B shows how this printer prints characters on the paper 10 when the head 7 is moved in the reverse direction (arrow C). In whichever direction the head 7 is moved, the length $l_1$ of the used portion of the ink ribbon 4 is shorter than the length l of the line of characters printed on paper 10. As has been stated, according to the results of the inventors' experiments, the print quality is sufficient as long as $l_1/l$ is at least 0.5. This follows that the printer can save at most about 50% of ink ribbon.

In the second embodiment, the recording head 7 is moved in either direction (arrow B or arrow C) at speed $V_H$, or at the same speed as in the electrothermal printer shown in FIG. 3, whereas the ink ribbon 4 is fed and taken up at lower speed $V_R$, thereby saving the ink ribbon 4. Alternatively, the ribbon 4 can be fed and taken up at the same speed as in the printer shown in FIG. 3, whereas the head 7 is moved at higher speed $V_H$. In either case, $V_H > V_R$. When the data items representing characters are stored into a one-line buffer (not shown) and read therefrom, at the same intervals as in the printer shown in FIG. 3, the printer of the second embodiment will print, on the paper 10, characters which are expanded horizontally. On the other hand, when these data items are stored into a one-line buffer (not shown) and read therefrom, at the shorter intervals than in the printer shown in FIG. 3, the printer will print the characters on the paper 10 in draft mode. The characters can be printed in both direction, i.e., the forward and reverse directions, either in the expanded form or in the draft mode.

When the ink ribbon 4 is supplied faster than the carriage 30 is moved, that is, when $V_R > V_H$, a longer portion of the ribbon 4 is used for printing characters in a line of the same length. In this case, the electrothermal printer of this invention can carry out so-called "high-precision printing" in both directions.

Figure 8:
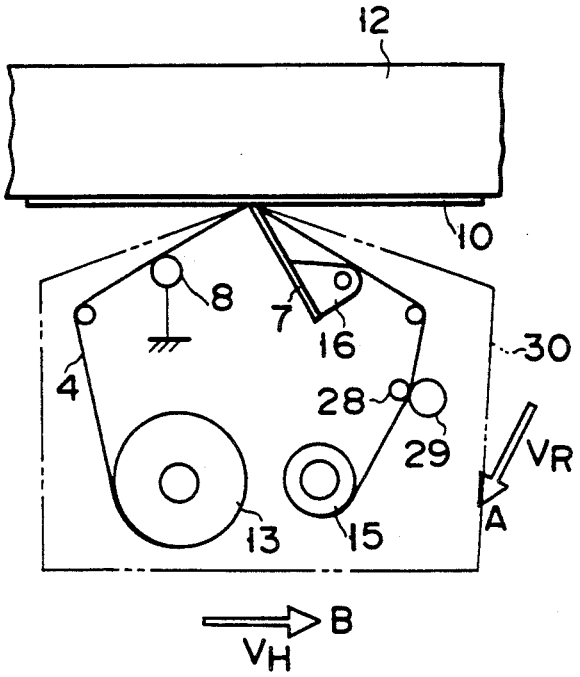
FIG. 8 is a plan view schematically showing the recording head and the carriage of another electrothermal printer according to the present invention.

FIG. 8 illustrates a third embodiment of the present invention, i.e., an electrothermal printer. This printer is different from the printer of the first embodiment (FIGS. 5A and 5B) in that ink ribbon 4 is taken up in the opposite direction. Hence, the ribbon 4 moves relative to recording paper 10 while the carriage 30 is moving in the forward direction, and does not move relative to the paper 10 while the carriage 30 is moving in the reverse direction. As is shown in FIG. 8, a recording head 7 is inclined to the paper 10 such that the ribbon 4 is fed toward the gap between the head 7 and the paper 10 at an angle of 90° or more. Therefore, if the ribbon 4 has a rough surface, and the paper 10 has surface-smoothness of 2 seconds (Beck's roughness), the ribbon 4 may pull down the head 7. Nonetheless, the recording paper in common use has surface-smoothness of 10 seconds or more, and the printer shown in FIG. 8 can perform bidirectional printing on the ordinary recording paper. Since the ink ribbon 4 is taken up in the direction opposite to that direction in which the ribbon 4 is taken up in the first embodiment (FIGS. 5A and 5B), the return electrode 8 and take-up rollers 28 and 29 takes positions different from those in the first embodiment. More specifically, the return electrode 8 is located close to the ribbon-feeding reel 13 to prevent the ribbon 4 from being cut. As to the function and position of the electrode 8, refer to U.S. patent application Ser. No. 163,394 filed May 2, 1988, and U.S. patent application Ser. No. 225,787 filed Jul. 29, 1988, both assigned to the same assignee of the present application.

Figure 9:
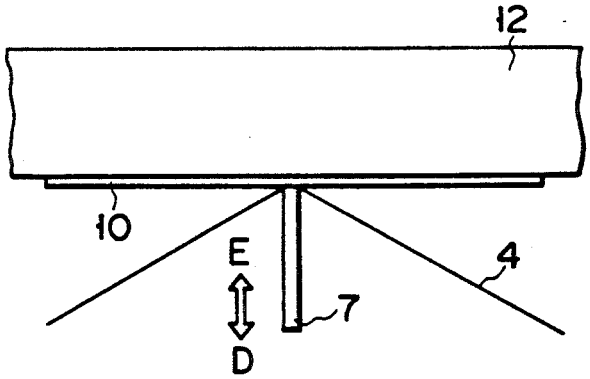
FIG. 9 is a plan view schematically showing the position of the recording head with respect to the platen, in a modification of the electrothermal printer according to the present invention.
Figure 10A:
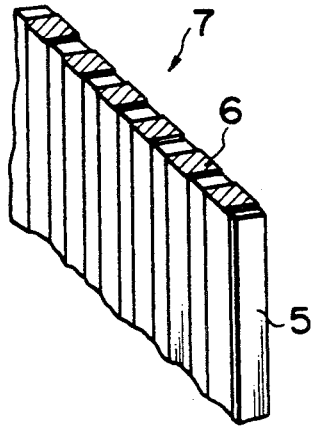
FIGS. 10A and 10B are perspective views showing two recording heads which can be used in the present invention.
Figure 10B:
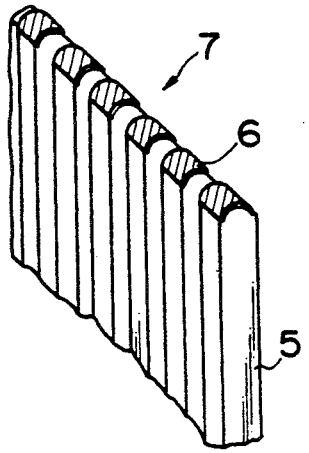
Figure 12:
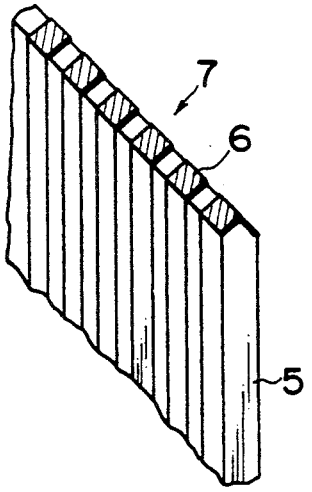
FIG. 12 is a perspective view showing another recording heads which can be used in the present invention.

FIG. 9 shows a recording head 7 which is positioned, extending at right angles to recording paper 10. This head 7 comprises a base 5 and signal electrodes 6 or heat-generating elements arranged on the edge of the base 5, as is illustrated in FIGS. 10A and 10B and FIG. 12. When the printer is set into the recording mode, the head 7 is moved in the direction of arrow E until it contacts the paper 10. When the printer is set into the non-recording mode, the head 7 is moved in the direction of arrow D, moving away from the paper 10. The recording head 7 remains at right angles to the paper 10 remains equal, in whichever direction the ink ribbon 4 and the head 7 are moved, in the forward direction or the reverse direction.

Figure 11:
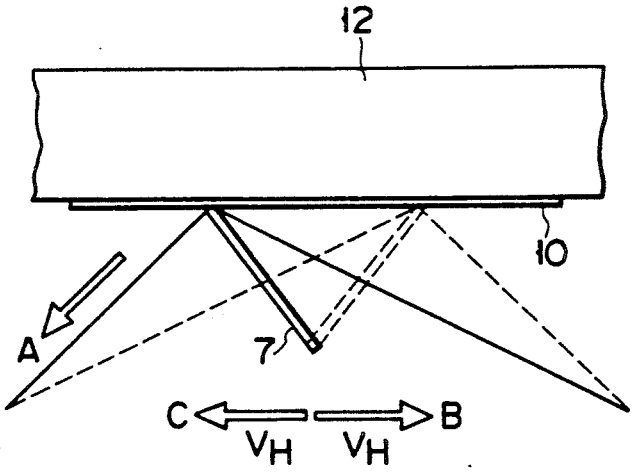
FIG. 11 is a plan view showing the position of the recording head with respect to the platen, in a modification of the electrothermal printer according to this invention.

Alternatively, the head 7 can be have such structures as are shown in FIGS. 12 and 10B. More precisely, the edge of the head 7 can either be shaped like a ridge as is shown in FIG. 12, or rounded as is shown in FIG. 10B. In operation, the head 7 is inclined toward the recording paper, assuming the position indicated by solid lines in FIG. 11 while it is moving in the forward direction, i.e., the direction of arrow B, and the position indicated by broken lines in FIG. 11 while it is moving in the reverse direction, i.e., the direction of arrow C. The head 7 may indeed take the position indicated by the solid lines while it is moving in the reverse direction (arrow C), and the position indicated by the broken lines while it is moving in the forward direction (arrow B). In this case, however, the head 7 is inclined at a smaller angle to the recording paper 10. The greater the angle between the head 7 and the paper 10, the better. In view of this, it would be desirable that the head 7 take the position indicated by solid lines in FIG. 11 while moving in the forward direction, and the position indicated by broken lines in FIG. 11 while moving in the reverse direction.

In the case of the printer which can save ink ribbon, the ink ribbon 4 is fed at the same speed as the head 7 is moved, due to the friction $P_P$ between the ribbon 4 and the paper 10, when the ribbon 4 is fed from the reel 13 at speed $V_R$ which is lower than the speed $V_H$ of the head 7. The ink ribbon 4 slackens after it has passed the head 7, and cannot be smoothly fed to head 7, inevitably increasing the possibility of low-quality printing. Why the ribbon 4 slackens will be explained with reference to FIGS. 13A and 13B.

Figure 13A:
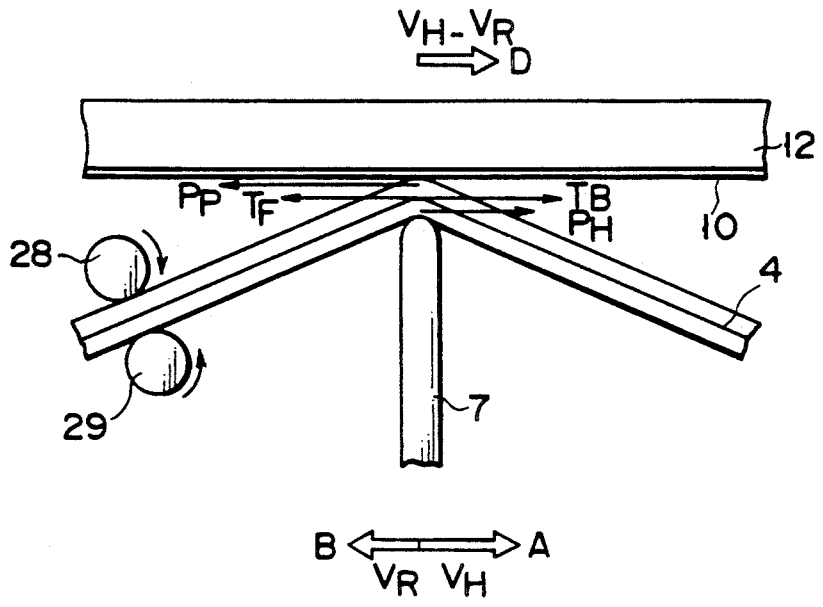
FIGS. 13A and 13B are plan views explaining the problem arising when the printer shown in FIG. 5 prints data in the reverse direction in the ribbon-saving mode.

As is shown in FIG. 13A, the ribbon take-up rollers 28 and 29 apply front tension $T_F$ on that portion of the ribbon 4 which is held between the head 7 and the paper 10, whereas the ribbon-feeding rollers (not shown) apply back tension $T_B$ on this portion of the ink ribbon 4. Further, also as is shown in FIG. 13A, friction force $P_H$ between head and ribbon is exerted on the ribbon 4 since the ribbon 4 contacts the head 7 while being fed. The tensions $T_F$ and $T_B$ act to the left and to the right, respectively, and the friction PH acts in the direction or arrow A. Since the ink ribbon 4 moves in the direction of arrow D with respect to the paper 10 at speed of $V_H - V_R$, friction $P_P$ is applied on the ribbon 4, acting in the direction opposite to arrow D. When these forces are balanced, that is, $P_P + T_{F=PH+TB}$, the ribbon 4 can be taken up smoothly. The back tension $T_B$ is inversely proportional to the diameter of the roll of ribbon 4 mounted on the ribbon-feeding reel. It is, therefore, considerably small when the ribbon 4 has almost not been used. The friction $P_H$ between the ribbon 4 and the head 7 is less than the friction $P_P$ between the ribbon 4 and the paper 10 since the base film of the ribbon 4 is made of a resin. The friction $P_P$ is great if the paper 10 has a rough surface-texture, or while the ink is being transferred from the ribbon 4 onto the recording paper 10. When the friction $P_P$ becomes greater than the sum of the friction $P_H$ and the back tension $T_B$, that is, $P > P_H + T_B$, the ink ribbon 4 will be fed even if take-up rollers 28 and 29 apply no front tension $T_F$ on the ribbon 4. In this condition, the ribbon 4 is fed from the feeding reel at the speed $V_H$, and is taken up around the take-up reel at the speed $V_R$ which is lower than the speed $V_H$. As a result, the ribbon 4 slackens. The length of the slackening portion of the ribbon 4 is proportional to the difference between speeds $V_H$ and $V_R$, i.e., $V_H - V_R$.

Once the ink ribbon 4 has slacked in this way, it is no longer possible for the electrothermal printer to save ink ribbon. To make the matter worse, the slackening portion of the ribbon 4 stays near the recording head 7, inevitably hindering a smooth supply of the ribbon 4, and ultimately resulting in low-quality printing.

Figure 14:
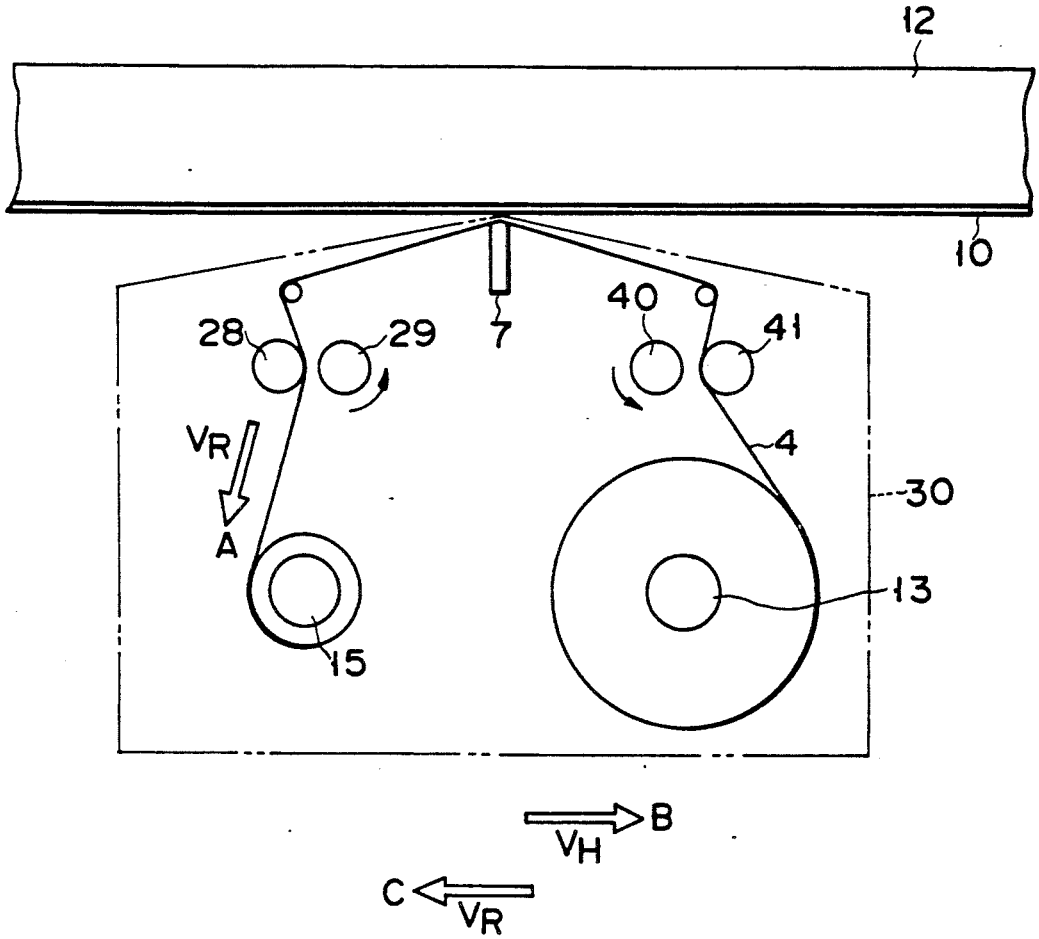
FIG. 14 is a plan view schematically showing the recording head and the carriage of still another electrothermal printer according to the present invention.

According to the present invention, the ink ribbon 4 can be prevented from slacking at any portion while the recording head 7 is printing data in the ribbon-saving mode. FIG. 14 shows a printer according to the invention, which can prevents ink ribbon from slacking. As is shown in FIG. 14, a ribbon-feeding reel 13 and a ribbon take-up reel 15 are mounted on a carriage 30. Also on the carriage 30, a pair of rollers 40 and 41 are mounted for feeding the ribbon 4 toward a recording head 7, and a pair of rollers 28 and 29 are also mounted for supplying the ribbon 4 to the ribbon take-up reel 15. The rollers 29 and 40 are driven in one direction at any desired speed, by means of a control mechanism (not shown). When the ribbon 4 is pinched between the rollers 28 and 29, or between the rollers 40 and 41, it is supplied forward as the roller 29 or 40 rotates in the direction of the arrow shown in FIG. 14. When the ribbon 4 is pinched between neither pair of rollers, it is not supplied forward. In the recording mode, the ribbon 4 is pinched between the rollers of either pair, and the rollers 29 and 40 are rotated by a motor (not shown) in the direction of the arrows, whereby the ink ribbon 4 is fed from the reel 13 and taken up around the reel 15 which is driven by a take-up reel drive mechanism (not shown). While the ribbon 4 is being fed and taken up in this way, a back tension-applying means (not shown) applies on that portion of the ribbon 4 which is being fed from the reel 13.

Figure 15A:
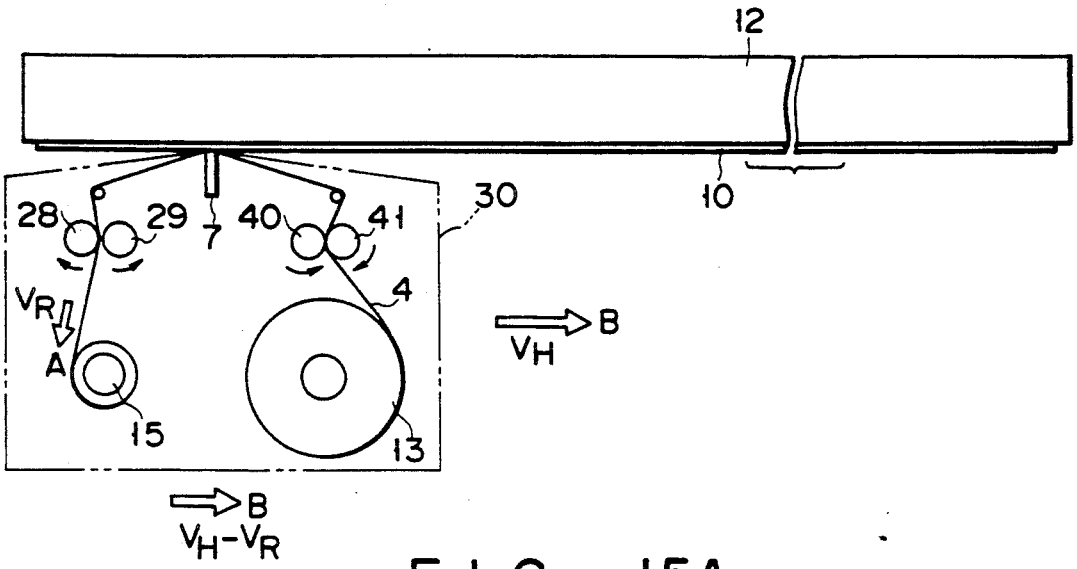
FIGS. 15A and 15B and FIG. 16 are plan views explaining how the printer shown in FIG. 14 operates.

While the recording head 7 of the printer shown in FIG. 14 is moving in the forward direction, thus printing data on recording paper 10, the roller 41 is held in contact with the roller 40 as is illustrated in FIG. 15A, whereby the ink ribbon 4 is fed from the ribbon-feeding reel 13 at the speed $V_R$ which is lower than the speed $V_H$. Meanwhile, the roller 28 is kept out of contact with the roller 29, and the ribbon 4 contacts only this roller 28. Since this roller 28 freely rotates as the ribbon 4 is taken up around the reel 15, it applies virtually no load on the ribbon take-up reel 15.

Figure 15B:
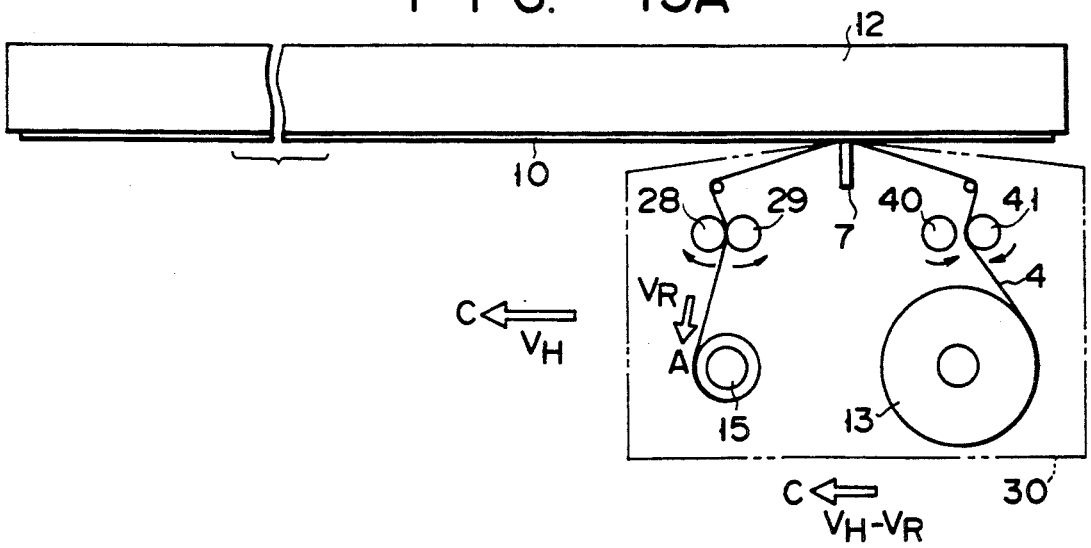

On the other hand, while the recording head 7 of the printer shown in FIG. 14 is moving in the reverse direction, thus printing data on recording paper 10, the roller 28 is held in contact with the roller 29 as is shown in FIG. 15B, whereby the ink ribbon 4 is fed from the ribbon-feeding reel 13 at the speed $V_R$ which is lower than the speed $V_H$. Meanwhile, the roller 41 remains out of contact with the roller 40, and the ribbon 4 contacts only this roller 41.

Figure 13B:
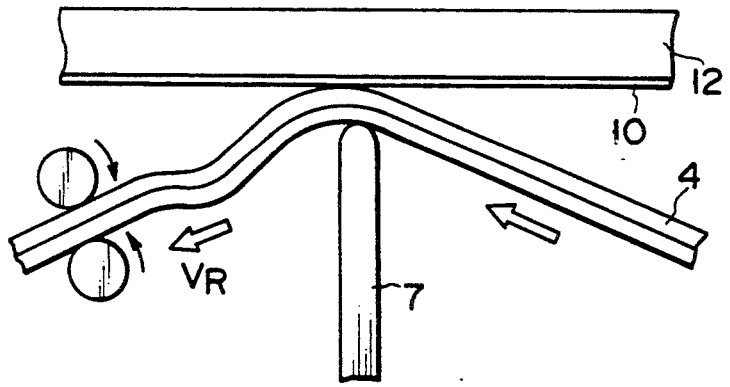

As has been described, the ink ribbon 4 is supplied at the speed $V_R$ by the rollers 40 and 41 all the time the printer effects the forward printing in the ribbon-saving mode, and by the rollers 28 and 29 all the time the printer performs the reverse printing in the ribbon-saving mode. Since the rollers 40 and 41 feed the ribbon 4 at the speed $V_R$, when the head 7 is moved in the forward direction the ribbon 4 passes the head 7 and is taken up around the reel 15 also at the same speed, $V_R$. That is, there is no difference ($V_H - V_R$) between the speed at which the ribbon 4 is supplied from the reel 13 to the head 7 and the speed at which the ribbon 4 is supplied from the head 7 to the reel 15. Thus, that portion of the ribbon 4, which is travelling from the head 7 to the reel 15, does not slacken as is illustrated in FIG. 13B.

In the case of the embodiment shown in FIG. 14, the ink ribbon is fed by the rollers 40 and 41 during the forward printing, by the rollers 28 and 29 during the reverse printing. Alternatively, both pairs of rollers can be used to feed the ink ribbon while the head 7 is moving in either direction. If this is the case, no switching between one pair of rollers to the other pair needs to be effected to change the forward printing to the reverse printing, or vice versa. This helps to reduce the time required for printing one page of data, particularly when it would take some time to switch from one pair of rollers to the other pair of rollers. Further, it is possible to make only the rollers 40 and 41 pinch and feed the ribbon 4 during the forward printing, and to make both pairs of rollers (i.e., the rollers 28, 29, 40 and 41) pinch and supply the ribbon 4 during the reverse printing.

Figure 16:
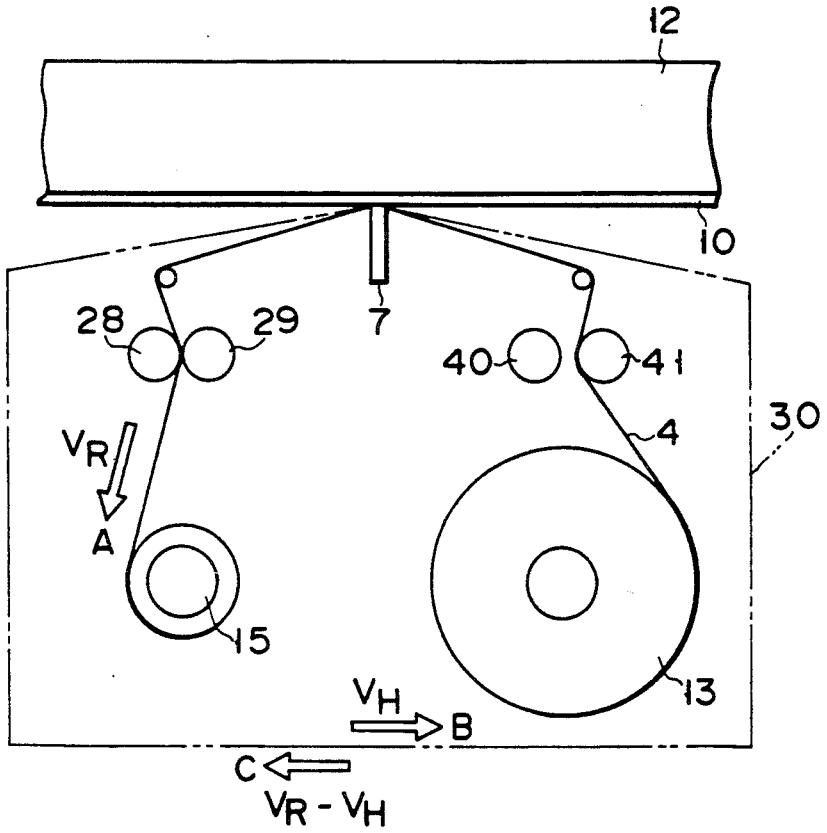

While the forward printing is being performed in the high-precision printing mode, wherein in $V_H < V_R$ as has been pointed out, the ink ribbon 4 is supplied at the speed $V_R$, and the carriage 30 is moved in the forward direction at the speed $V_H$, as is illustrated in FIG. 16. More precisely, the rollers 28 and 29, which are located between the head 7 and the ribbon take-up reel 15, pinch and feed the ribbon 4 in the direction of arrow A, whereby the ribbon 4 moves in the direction of arrow C with respect to the recording paper 10. While the reverse printing is being performed in the high-precision printing mode, the ink ribbon 4 moved in the direction of arrow C with respect to the recording paper 10. Also in this case, the rollers 28 and 29 pinch and feed the ink ribbon 4 toward the ribbon take-up reel 15.

As has been described, the rollers 28, 29, 40, and 41 and the mechanisms for driving these rollers are mounted on the carriage 30. Therefore, the unit consisting of the carriage 30 and the rollers is relatively heavy. A motor of great torque must be used to drive the carriage 30, and a great power source is required to drive the motor. As well known in the art, the greater torque a motor has, the longer the through-up time and the through-out it has. Hence, the motor for driving the carriage 30 hinders a high-speed printing. In view of this, the electrothermal printer shown in FIGS. 17A to 17D, which is another embodiment of the present invention is advantageous.

As is illustrated in FIGS. 17A to 17D, only a recording head 7, two ribbon guides 44 and 45, and a ribbon-holding mechanism are mounted on the carriage 30, and a ribbon-feeding reel 13, a ribbon take-up reel 15, and rollers 28, 29, 40, and 41 are arranged outside the carriage 30. Thus, the load on the carriage 30 far less than in the case of the printer shown in FIG. 14. The printer shown in FIGS. 17A to 17D can print data at a higher speed than the printer shown in FIG. 13.

Figure 17A:
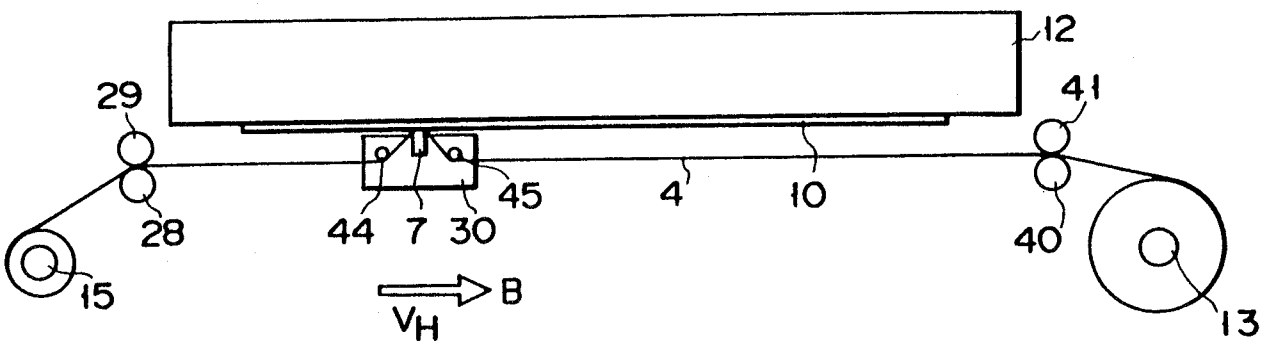
FIGS. 17A to 17D are plan views showing another electrothermal printer according to this invention, and explaining how this printer operates.

As is shown in FIG. 17A, that portion of the ink ribbon 4, which extends along the platen 12, is longer than width of the recording paper 10 wrapped around the platen 12. During the forward printing performed in the ordinary mode, the ribbon 4 is not moved, held between the rollers 28 and 29 and also between the rollers 40 and 41 which are not rotating at all; there is no relative movement between the ribbon 4 and the paper 10. As can be evident from FIG. 17A, the ribbon 4 need not be held or pinched between the rollers 28 and 29, or between the rollers 40 and 41, if a sufficient back tension is applied on both reels 13 and 15.

Figure 17B:
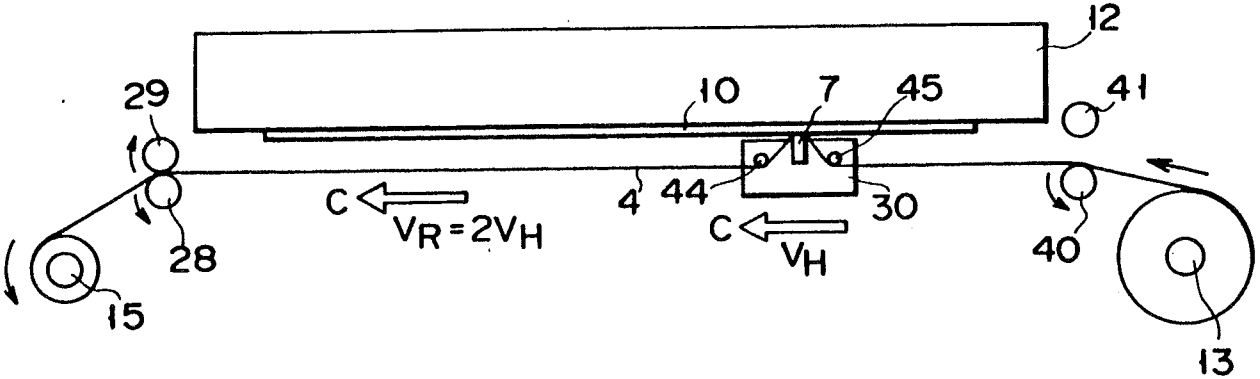

During the reverse printing effected in the ordinary mode, the rollers 28 and 29, which are located downstream of the ribbon-feeding, feed the ink ribbon 4 in the direction of arrow C at the speed $V_R$ twice as high as the speed $V_H$ of the carriage 30 moving also in the same direction, as is illustrated in FIG. 17B. The rollers 40 and 41, which are located upstream of the ribbon-feeding, do not pinch the ribbon 4, thus not hindering the fast feeding of the ink ribbon 4.

Figure 17C:
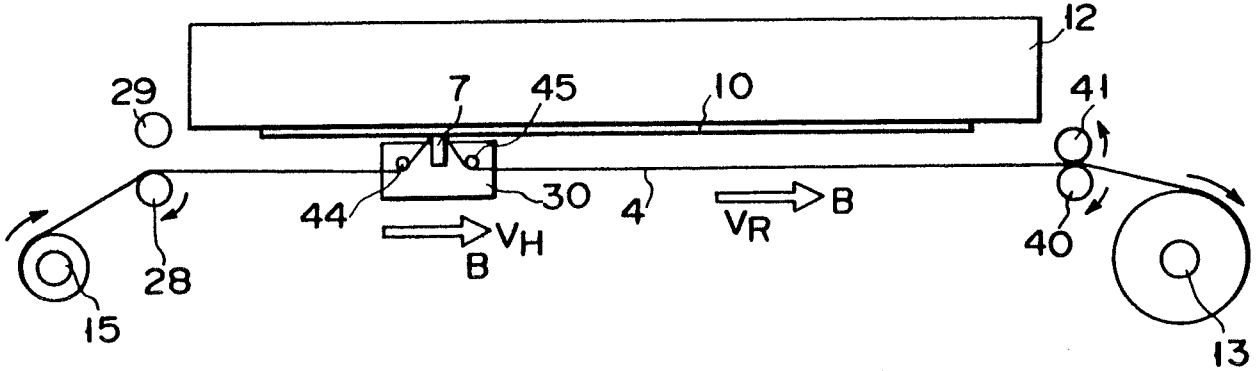

During the forward printing effected in the ribbon-saving mode, the rollers 40 and 41, which are located upstream of the ribbon-feeding, feed the ink ribbon 4 in the direction of arrow B at the speed of $V_R$, whereas the carriage 30 is moved in the direction of arrow B at the speed $V_H$ higher than the speed $V_R$, as is illustrated in FIG. 17C. In this case, the ink ribbon 4 is taken up around the reel 13 at the speed $V_R$, without slacking between the reel 15 and the rollers 28 and 29. Before the forward printing is performed in the ribbon-saving mode, an unused portion of the ribbon 4, which is longer than the width of the paper 10, is taken up around the reel 15. This is because this portion of the ribbon 4 must be taken up around the ribbon-feeding reel 13 to achieve a successful forward printing in the ribbon-saving mode.

Figure 17D:
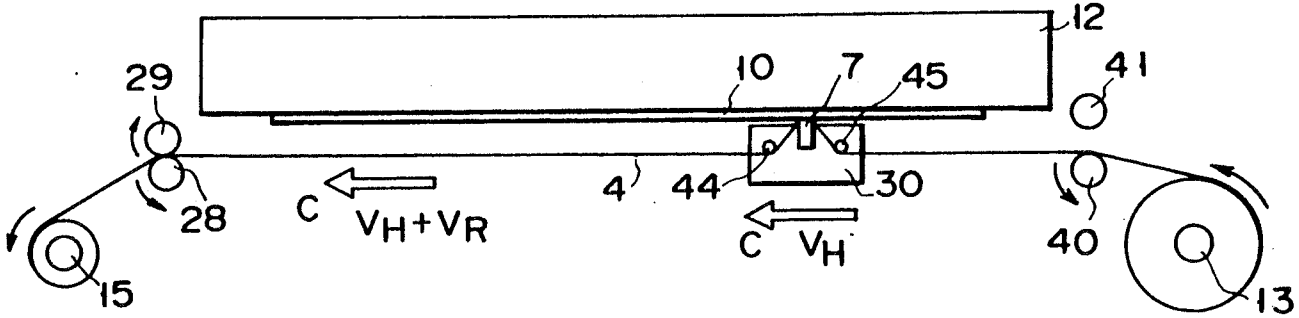

During the reverse printing effected in the ribbon-saving mode, the rollers 28 and 29 pinch the ribbon 4 and feed the ribbon 4 so that the ribbon 4 is taken up around the reel 15 at the speed of $V_C+V_R$, where $V_C>V_R>0$, as is illustrated in FIG. 17D.

With the electrothermal printer shown in FIGS. 17A to 17D, when the carriage 30 is moved for any purpose other than printing data, the ink ribbon 4 must be taken up in the same direction at the same speed. This is because that portion of the ribbon 4 which is located between the head 7 and the ribbon take-up reel 15 has already been used, whereas that portion of the ribbon 4 which is located between the head 7 and the ribbon-feeding reel 13 has not been used. Hence, the ink ribbon 4 must be moved along with the recording head 7.

As has been described, when the ink ribbon 4 is moved relative to the recording paper 10, thereby to save the ink ribbon or reverse printing, the paper 10 is more likely to get dirty with the ink than in the case of the printing in the ordinary mode. More precisely, when the printer is set in the ribbon-saving mode, the ink ribbon 4 contacts the paper 10 while moving, and, as a consequence, the ink may unnecessarily be transferred from the ribbon 4 onto the recording paper 10. To keep the paper clean, the ink ribbon 4 shown in FIG. 18 should better be used for printing data in the ribbon-saving mode or reverse printing mode.

Figure 18:
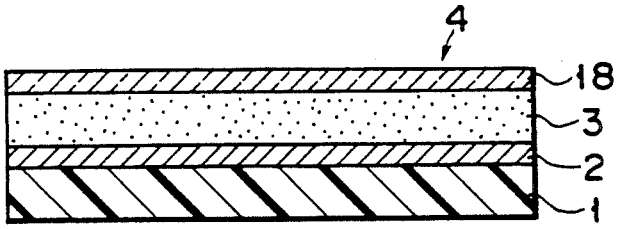
FIG. 18 is a sectional view of the ink ribbon used in the electrothermal printers according to the present invention.

As is shown in FIG. 18, this ink ribbon 4 comprises a resistive base film 1, a conductive layer 2 formed on the base film 1, a heat-sensitive ink layer 3 coated on the conductive layer 2, and a cover layer 18 formed on the ink layer 3. The cover layer 18 prevents any portion of the ink layer 3 from unnecessarily sticking to the recording paper 10. The components of the ink ribbon 4 will be described in detail.

The resistive base film 1 is made of polycarbonate used as a carrier, and conductive material dispersed in the polycarbonate. The carrier is, for example, polyester resin, polyvinyl chloride, aromatic polyamide, nitrocellulose, or the like. The conductive material is, for example, powder of a metal such as copper, nickel, molybdenum, or chrominum. It is desirable that the base film 1 has a thickness ranging from 2 μm to 20 μm. When the thickness is less than 2 μm, the film 1 is less mechanically strong than desired. When the thickness if more than 20 μm, the image data transferred from the ribbon 4 will have an insufficient resolution. It is preferable that the resistive base film 1 have a surface resistance ranging from 200 $\Omega/cm^2$ to 60 $K\Omega/cm^2$. When the surface resistance is less than 200 $\Omega/cm^2$, a great current is required to generate sufficient Joule heat, and ultimately a large power source is necessary. Further, a relatively large amount of heat will be generated in the circuit for supplying a constant current to the resistive base film 1. On the other hand, when the surface resistance is more than 60 $K\Omega/cm^2$, the drive voltage will be so high that an electrical discharge occurs between the base film 1 and the recording head 7, inevitably reducing the lifetime of the head 7. Most preferably, the surface resistance of the base film 1 is 400 $\Omega/cm^2$ to 50 $K\Omega/cm^2$.

The conductive layer 2 is made by vapor-depositing aluminum on the resistive base film 1, to a thickness ranging from 100 Å to 5000 Å. When the layer 2 is thicker than 5000 Å, is allows more heat to leak through the conductive layer 2 resulting in a loss of heat. On the other hand, when the layer 2 is thinner than 100 Å, it generates heat, consuming the current due to its increased electrical resistance, resulting in a loss of recording energy.

The heat-sensitive ink layer 3 is made of carbon black and polyamide resin. The carbon black is used as coloring agent, and the polyamide resin is used as binder. The ink layer 3 has a melting point of 70° C. Alternatively, the ink layer 3 can be either a thermoplastic ink layer or a sublime ink layer, which melts or softens when heated to a specific temperature. When it is a thermoplastic ink layer, the coloring agent is phthalocyannine blue, brilliant carmine 6B, disazo yellow, and the binder is a synthetic resin such as aliphatic ester resin, vinyltoluene-acryl copolymer resin, ethylene-vinyl acetate copolymer resin, bisamide, vinyl acetate, polyketone-ethylene vinyl acetate, polystyrene, polyethylene, or petroleum resin; or a wax such as carnaba wax, paraffin wax, oxide wax, or montan wax derivative. Further, the binder of the thermoplastic ink layer can be toluol oil or aromatic carboxylic acid. When the layer 3 is a sublime ink layer, the coloring agent is a sublime dye such as color index solvent blue-80, color index disposed red-60, or color index yellow, and the binder is a cellulose derivative, a water-soluble acrylic resin, starch, or a hydrophilic high-molecular resin. It is desirable that the ink layer 3 soften or melt when it is heated to 45° C. to 150° C. More preferably, it should soften or melt when it is heated to 45° C. to 100° C. Were the ink layer 3 not covered with the layer 18, the lowest temperature at which the layer 3 may soften or melt should be about 60° C. in order to avoid an "ink-blocking". It is desirable that the ink layer 3 have a thickness ranging from 2 μm to 10 μm.

The cover layer 18 is about 2 μm thick. It is made of polyolefin or polyamide. Alternatively, it can be made of any other material which is solid at room temperature and softens or melts when it is heated to a temperature higher than 45° C. More specifically, it can be made of a synthetic resin such as vinyl acetate, polyketone, ethylene vinyl acetate, polystyrene, polyethylene or petroleum resin, or a wax such as carnaba wax, paraffin wax, oxide wax, or montan wax. The material of the cover layer 18 should be transparent, white or a little colored, so that even if a portion of the cover layer 18 is transferred onto the non-recording portion of the recording paper 10, it will not be considered to be a stain on the paper 10. Preferably, the cover layer 18 softens, melts or remains viscous when heated to 45° C. to 120° C. More preferably, it should soften, melt or remain viscous when heated to a temperature ranging from 60° C. to 100° C. When the layer 18 is made to soften or melt at a lower temperature than the ink layer 3, it does not matter as long as the ink layer 3 and the cover layer 18 can be made to soften or melt at any temperatures falling within the ranges specified above. Nonetheless, when the cover layer 18 is made to soften or melt at a higher temperature than the ink layer 3, the difference between the temperatures at which the layers 3 and 18 soften or melt should be 55° C. or less. When this difference is more than 55° C., the ink cannot be correctly transferred onto the recording paper 10 or sufficiently adhere thereto.

Figure 19A:
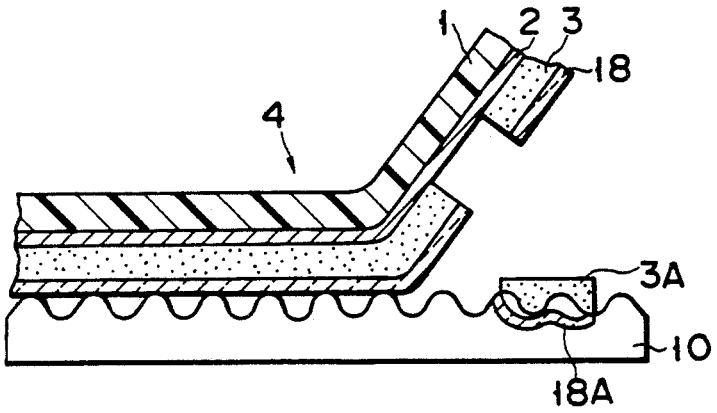
FIG. 19A is a sectional views of the ink ribbon, explaining how the portions of the ink layer are transferred from the ribbon shown in FIG. 18, onto the recording paper.
Figure 19B:
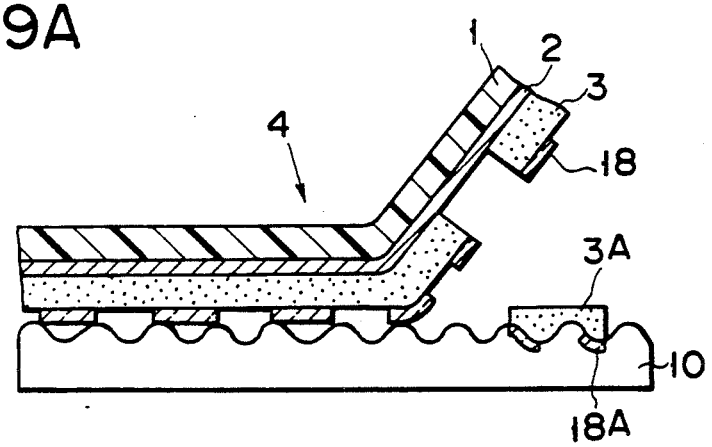
FIG. 19B is a sectional views of ink ribbon which is a modification of the ribbon shown in FIG. 18, and explains how the portions of the ink layer are transferred from this ink ribbon onto the recording paper.

The cover layer 18 need not function as an adhesive for adhering the ink to the recording paper 10. Once any portion of the ink layer 3 has softened or melted, that portion of the cover layer 18 which covers this portion of the ink layer 3 also softens or melts. As soon as the soft or molten portion of the cover layer 18 contacts the paper 10, it soaks into the paper as is illustrated in FIG. 19A, making it possible for the soft or molten portion of the ink layer 3 to adhere to the recording paper 10. Further, the cover layer 18 need not be coated on the entire surface of the ink layer 3. The cover layer 18 can be discontinuous as is shown in FIG. 19B, provided that it keeps the ink layer 3 spaced apart from the paper 19 for a predetermined distance. Moreover, the cover layer 18 need not have great affinity with the ink layer 3. The thinner the layer 18, the better. Preferably, the cover layer 18 has a thickness of 6 μm or less, and more preferably, 3 μm or less.

Figure 20:
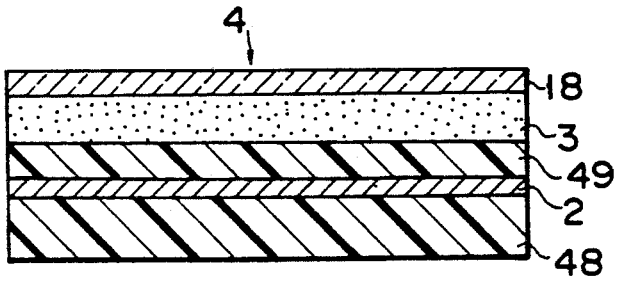
FIG. 20 is a sectional view of other ink ribbon which is a modification of the ribbon illustrated in FIG. 18.

FIG. 20 shows another ink ribbon which can be used in the electrothermal printer of the invention to print data in the ribbon-saving mode. As is shown in this figure, this ink ribbon 4 is different from the ink ribbon shown in FIG. 18 in that a resistive layer 48 and a base layer 49 are used in place of the base film 1. More precisely, a conductive layer 2 is sandwiched between the base layer 49 and the resistive layer 48, an ink layer 3 is formed on the base layer 49, and a cover layer 18 is formed on the ink layer 3. The resistive layer 48 is made of polyphosphin resin and conductive carbon dispersed in this resin. The layer 48 softens or melts when it is heated to a temperature higher than the temperature at which the ink layer 3 and the cover layer 18 soften or melt. Preferably, its thickness ranges from 2 μm to 20 μm. It is desired that the layer 48 has a surface resistance of 200 $\Omega/cm^2$ to 60 $K\Omega/cm^2$. More preferably, the layer 48 has a surface resistance of 400 $\Omega/cm^2$ to 50 $K\Omega/cm^2$. The conductive layer 2 is formed by vapor-depositing aluminum to the thickness of 2000 Å. The base layer 49 is made of polyethylene terephthalate and has a thickness of 3.5 μm. Alternatively, the layer 49 can be made of a heat-resistant material such as polyimide resin, aromatic polyamide, polyester resin, or the like. It should be as thin as possible so far as its mechanical strength is sufficient, so as to minimize the loss of heat which may occur while the heat is transmitted to the ink layer 3. Preferably, the base layer 49 can be 2 μm to 10 μm thick, more preferably 2 μm to 6 μm. The ink layer 3 is made of a binder and carbon black dispersed in the binder. This binder is, for instance, aliphatic ester resin or vinyl toluen-acryl copolymer. The binder has a softening point of 65° C. The cover layer 18 is made of paraffin wax and has a thickness of 2 μm. The cover layer 18 is discontinuous, and the ink layer 3 is partly covered by this layer 18 and partly exposed. The ink layer 3 and the cover layer 18 can be made of the same materials as those of the ink ribbon 4 illustrated in FIG. 18. The ink ribbon 4 shown in FIG. 20 was used in the printer illustrated in FIG. 3, thereby printing data on a sheet of recording paper. The results was that no ink was transferred to the non-recording portions of the paper, as in the case where use was made of the ink ribbon shown in FIG. 18. Further, the ink ribbon having no cover layer was used in the printer shown in FIG. 3, thus printing data on a sheet of recording paper. The results was that the ink was transferred to some non-recording portions of the paper.

The material of the cover layer 18 should be transparent, white or a little colored, as in the case of the cover layer of the ribbon 4 shown in FIG. 18. Therefore, even if a portion of the cover layer 18 is transferred onto the non-recording portion of the paper 10, it will not look as stain on the paper 10.

The ink ribbon which can be used in the electrothermal printer according to the invention is not limited to those types shown in FIGS. 18 and 20. For instance, ink ribbon can be used which is identical to the ribbon shown in FIG. 18 or 20, except that it has no conductive layers. If such is the case, the recording head must have a pair of electrodes both contacting either the resistive base film or the resistive layer, so that a signal is supplied from one electrode to the other through the resistive layer, thus generating heat in that portion of the resistive layer which extends between the electrodes.

The inventors hereof have found, by experiments, that the ink ribbon 4 contacts the ink layer transferred to the recording paper 10, while the printer prints data in the reverse direction. In this condition, the ink ribbon 4 is likely to rub the transferred ink layer, inevitably streaking the paper 10 with the ink. This undesirable phenomenon will be explained in greater detail.

Figure 21A:
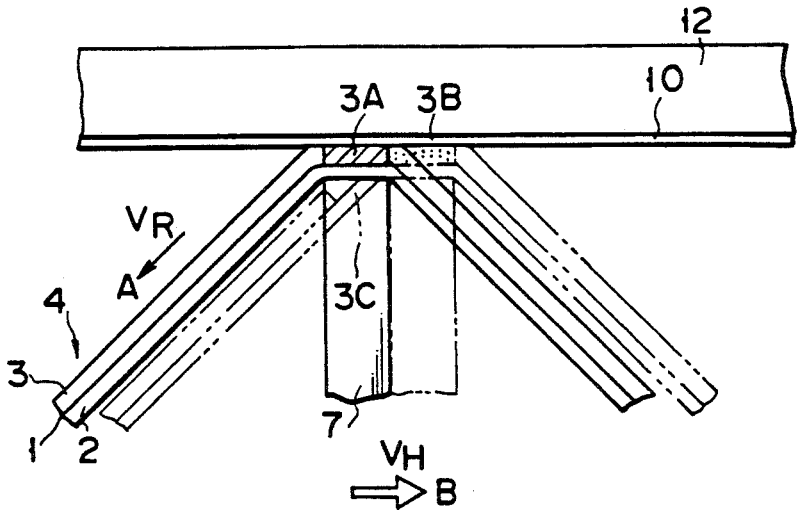
FIGS. 21A to 21C are plan views, explaining the problem arising when the thermal printer according to this invention prints data in the reverse direction.

As is shown in FIG. 21A, the ink ribbon 4 and the recording head 7 are moved in the opposite directions during the forward printing. The unused portion 3B of the ink layer 3 does not contact the ink 3A transferred onto the paper 10. Some time after the portion 3A of the ink layer 3 has been melted due to the heat applied from the head 7 and has thus be transferred onto the recording paper 10, the recording head 7 is moved in the forward direction (arrow B) for some distance, whereby the unused portion 3B of the ink layer 3 reaches the recording head 7. In this case, that portion 3C of the ink layer 3, which is leaving the paper 10 contacts only the rear edge of the portion 3A of the ink layer 3, as is illustrated in FIG. 21A. The unused portion 3B of the ink layer 3 is kept out of contact with the transferred portion 3A of the ink layer 3.

Figure 21B:
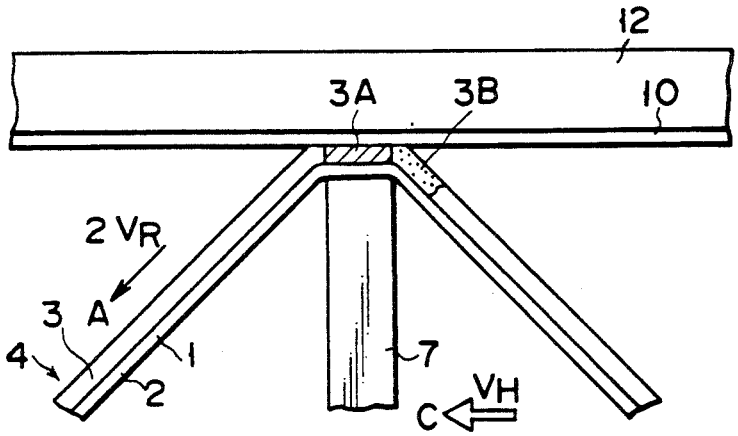
Figure 21C:
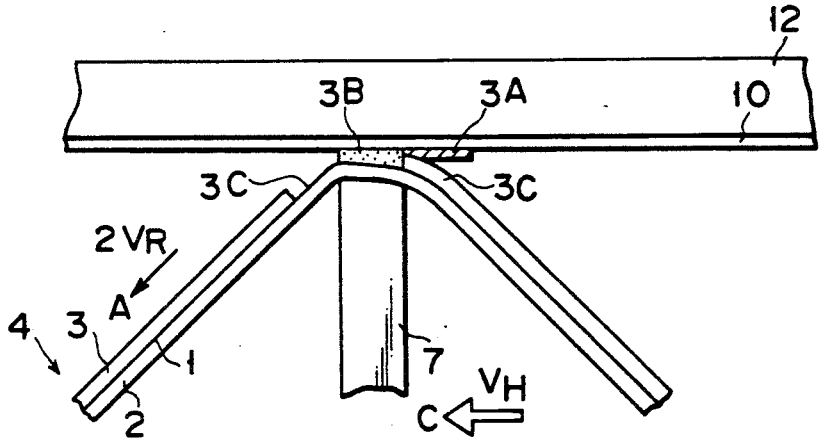

By contrast, the ink ribbon 4 and the head 7 are moved in the same direction during the reverse printing, as can be understood from FIGS. 21B and 21C. Therefore, the unused portion 3B of the ink layer 3 contacts that portion 3A of ink layer 3 which has been transferred to the recording paper 10. That is, some time after the portion 3A of the ink layer 3 has been melted due to the heat applied from the head 7 and has thus be transferred onto the paper 10 as is illustrated in FIG. 21B, the head 7 is moved in the reverse direction (arrow C) for some distance, whereas the unused portion 3B of the ink layer 3 is moved to the head 7 as is illustrated in FIG. 21C. In this case, the portion 3B or that portion 3C of the ink layer 3, which is leaving the paper 10 contacts the still soft portion 3A of the ink layer 3. Consequently, the unused ink portion 3B rubs the transferred ink portion 3A, inevitably streaking the paper 10 with the ink and, ultimately, resulting in low-quality of printing.

The inventors hereof have found that such low-quality printing can be avoided by applying the recording head 7 with current-supply pulses having a width W1 to print data in the forward direction, and with current-supply pulses having a width W2, where W1>W2, to print data in the reverse direction as illustrated FIGS. 22A and 22B. It will be discussed why this method is effective, with reference to FIGS. 23A to 23D and also FIGS. 24A to 24D.

FIGS. 23A to 23D show the positional relationship the ribbon 4 and the paper 10 have during the reverse printing when the head 7 is supplied with current-supply pulses having the same width (W1) as those supplied to the head 7 to print data in the forward direction. On the other hand, FIGS. 24A to 24D illustrate the positional relationship the head 7 and the paper 10 have during the reverse printing when the head 7 is supplied with current-supply pulses having the shorter width (W2) than those supplied to the head 7 to print data in the forward direction. Although not shown in FIGS. 23A to 23D or FIGS. 24A to 24D, the recording head 7 is always located at the position where the ink ribbon 4 contacts the recording paper 10. The head 7 has a width which is far less than the width l of each pixel.

First, with reference to FIGS. 23A to 23D, it will be explained how data is printed on the recording paper 10 when current-supply pulses having a width W1 are supplied to the recording head 7 to perform both the forward printing and the reverse printing.

Figures 23A, 23B, 23C, 23D:
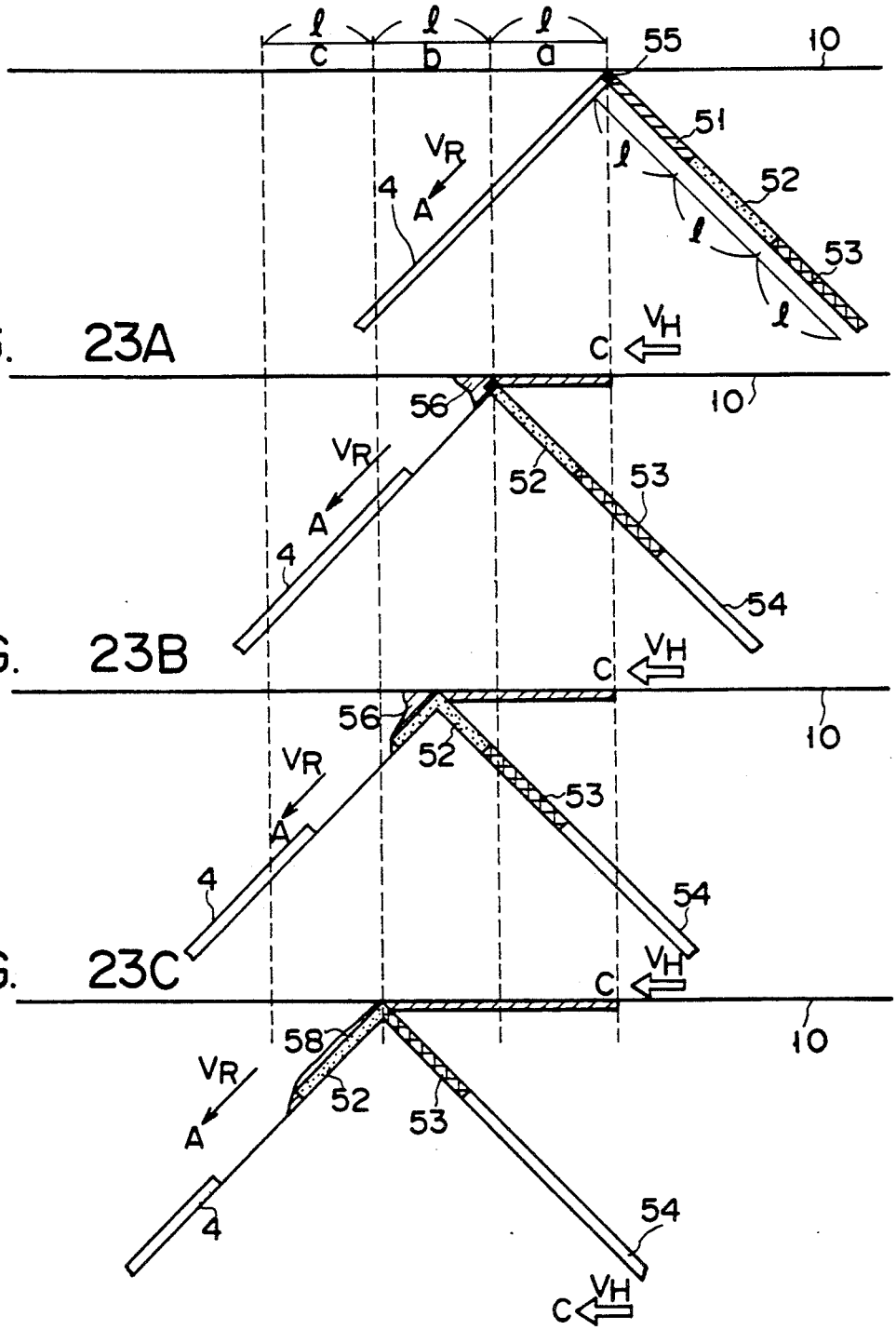
FIGS. 23A to 23D are plan views, explaining how the recording paper gets dirty when the recording head is driven in accordance with the current-pulses shown in FIG. 22A, and prints data in the reverse direction.

While the recording head 7 is moving in the reverse direction to print data on the paper 10, the ink ribbon 4 moves relative to the recording head 7, at the same speed the carriage 30 are moved backward. In other words, every time the head 7 moves backward for a distance, the ribbon 4 moves for the same distance relative to the head 7. Thus, the consecutive portions 51, 52, and 53 of the ink layer 3 will be transferred onto the consecutive pixel regions a, b, and c of the recording paper 10. To be more precise, that portion 55 of the ink layer 3 which contacts the paper 10, as is shown in FIG. 23A, is heated and transferred onto the recording paper 10. The portion 51 of the ink layer 3 is heated until the carriage 30 moves across the entire pixel region a as is shown in FIG. 23B, whereby the portion 51 is transferred to paper 10, thus forming a pixel on the region a of the paper 10.

On the other hand, while the recording head 7 is moving in the reverse direction to print data on the paper 10, some part of ink portion 51 is transferred onto the paper 10, but the remaining part 56 of this portion 51, which is still soft, is rubbed by the ink ribbon 4. Consequently, the part 56 of the ink portion 51 is collected in a space between the recording paper 10 and that portion of the ribbon 4 which is leaving the paper 10. As the head 7 further moves in the reverse direction, the part 56 is partly applied to the paper 10 by the portion 52 of the ink layer 3 and is partly transferred back onto the ribbon 4, as is illustrated in FIG. 23C. When all part 56 of the ink portion 51 is transferred to the region b of the paper 10 or back to the region 58 of the ribbon 4 as is shown in FIG. 23D, no more ink is transferred onto the recording paper 10. In this instance, the ink is transferred to both regions a and b of the paper 10, though the ink should be transferred to the region a only. As a consequence, the printing quality is degraded. The amount of the ink transferred to the regions of the paper 10, on which the ink is unnecessarily be transferred, depends on the speed of the recording head 7 and the viscosity of the ink collected between the ribbon 4 and the paper 10.

With reference to FIGS. 24A to 24D, it will now be explained how data is printed on the recording paper 10 when current-supply pulses having a width W2, which is half the width W1, are supplied to the recording head 7 to perform the reverse printing.

Figure 24A:
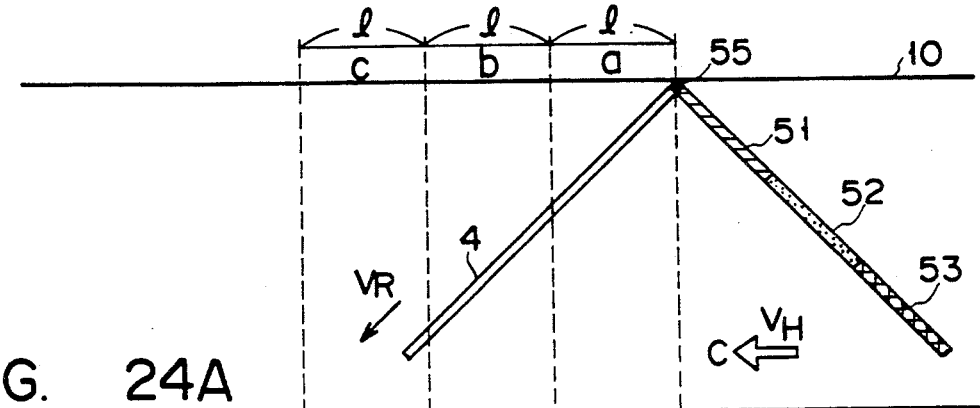
FIGS. 24A to 24D are plan views, explaining how the recording head prints data in the reverse direction when it is driven in accordance with the current-pulses shown in FIG. 22B.
Figure 24B:
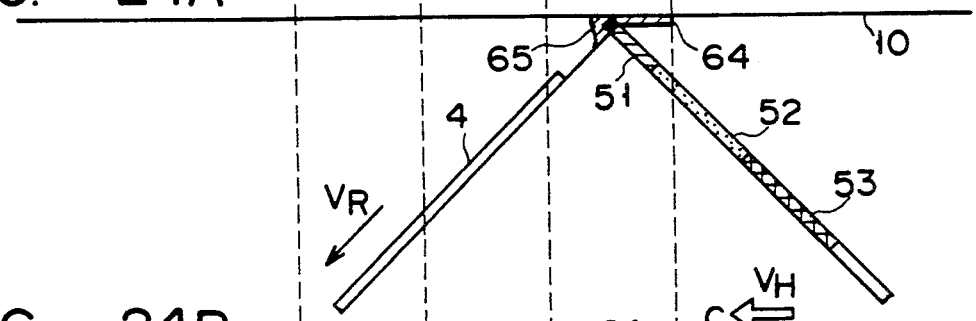
Figure 24C:
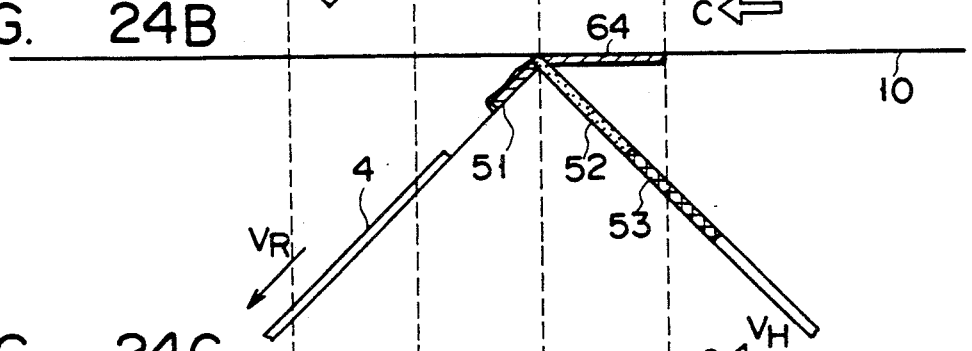
Figure 24D:
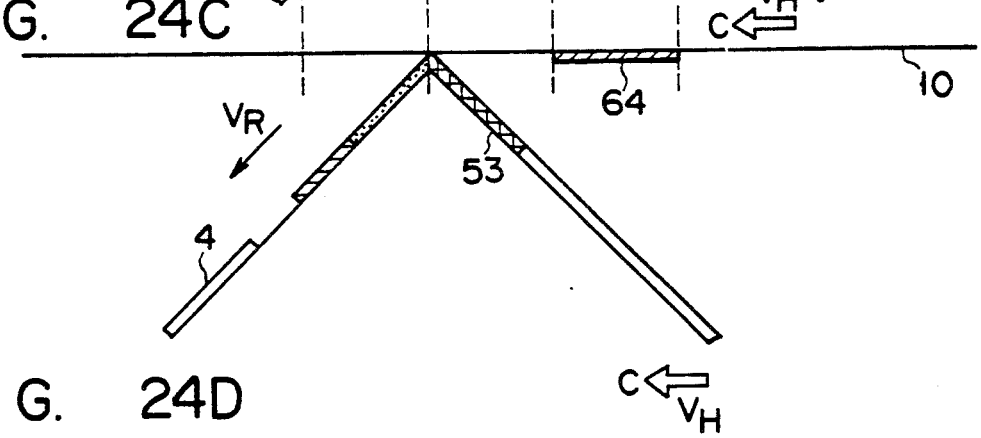

To transfer the portion 51 of the ink layer 3 onto the region a of the paper 10 by moving the head 7 in the reverse direction, an electric current is supplied to the head 7 only while the head 7 is moving over the first half of the region a, in accordance with the current-supply pulse having a width of W2 (=W1/2). In other words, the supply of a current to the head 7 is started when the head 7 is located at the edge of the region a as is shown in FIG. 24A, and is stopped when the head 7 is reaches the middle portion of the region a as is shown in FIG. 24B. The molten ink 64 is transferred onto the first half of the region a, as is illustrated in FIG. 24B. The transferred molten ink 64 is rubbed by the ribbon 4, and part 65 of it is collected between the ribbon 4 and the paper 10 as is shown in FIG. 24B. As is shown in FIG. 24C, this part 65 of the ink is transferred onto the second half of the region a as the head 7, which is no longer supplied with a current, moves across the second half of the region a. As a result, a pixel is formed on the region a only, as is illustrated in FIG. 24D.

As has been described, according to the present invention, a low-quality, reverse printing can be prevented since current-supply pulses having a width W1 are supplied to the recording head 7 to print data in the forward direction, and current-supply pulses having a width W2, when W1>W2, are supplied to the head 7 to print data in the reverse direction.

In the explanation made in conjunction with FIGS. 23A to 23D and FIGS. 24A to 24D, it has been assumed, for the sake of simplicity, that any soft or molten portion of the ink layer 3 covers twice as long a region of the paper 10 during the reverse printing as during the forward printing. Actually, however, the printing length achieved by a specific amount of soft or molten ink is determined by various factors such as the properties of the ink, the printing speed, and the heating condition of the ribbon. In view of this, it is desirable that the width of the current-supply pulses be controlled in accordance with these factors.

Further, the above explanation is made on the assumption that the ink ribbon 4 and the recording paper 10 are set in a point-contact. In fact, they are in a surface-contact or line-contact since the recording head 7 has some width.

Moreover, the heating condition of the ribbon varies with the printing pattern. Even in the case of the forward printing, it is desirable that the width of each current-supply pulse is changed in accordance with the printing pattern. For example, to print an all-mark pattern in the forward direction, it suffices to supply current-supply pulses having W2 (=W1/2) to the recording head 7. To print an all-mark pattern in the reverse direction, however, it is necessary to supply the recording head 7 with current-supply pulses having a width shorter than W2.

The printer circuit incorporated in the electrothermal printer according to the present invention will now be described with reference to the FIG. 25.

Image data 211 is input to the heat control section 210 of the printer circuit. More specifically, the data items each representing, for example, 24 dots are serially input to the heat control section 210. These are binary pattern data items corresponding to the image data or character codes supplied from a host computer. To print the data in the forward direction, that is, from the left to the right, the data items are input to the section 210, in the normal order. To print the data in the reverse direction, that is, form the right to the left, the data items are input to the section 210 in the reverse order.

Figure 26:
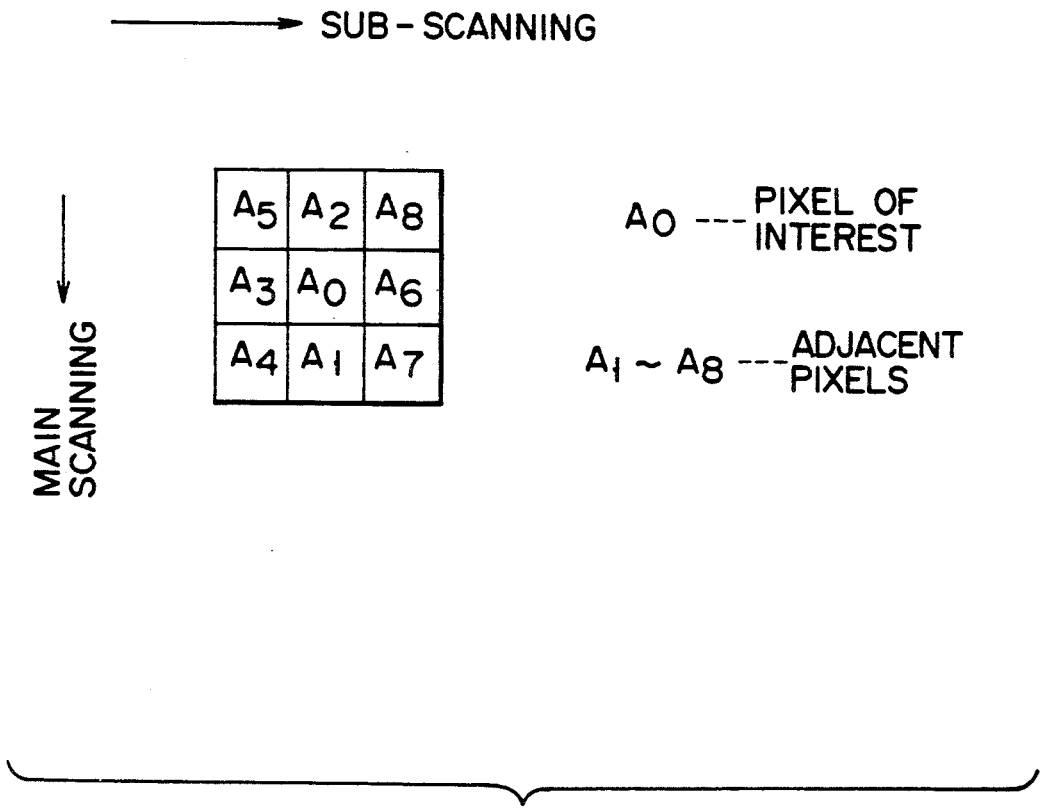
FIG. 26 shows a 3×3 pixel matrix, in accordance to which the heat controller incorporated in the circuit of FIG. 25 controls the heating condition of the recording head.
Figure 27A:
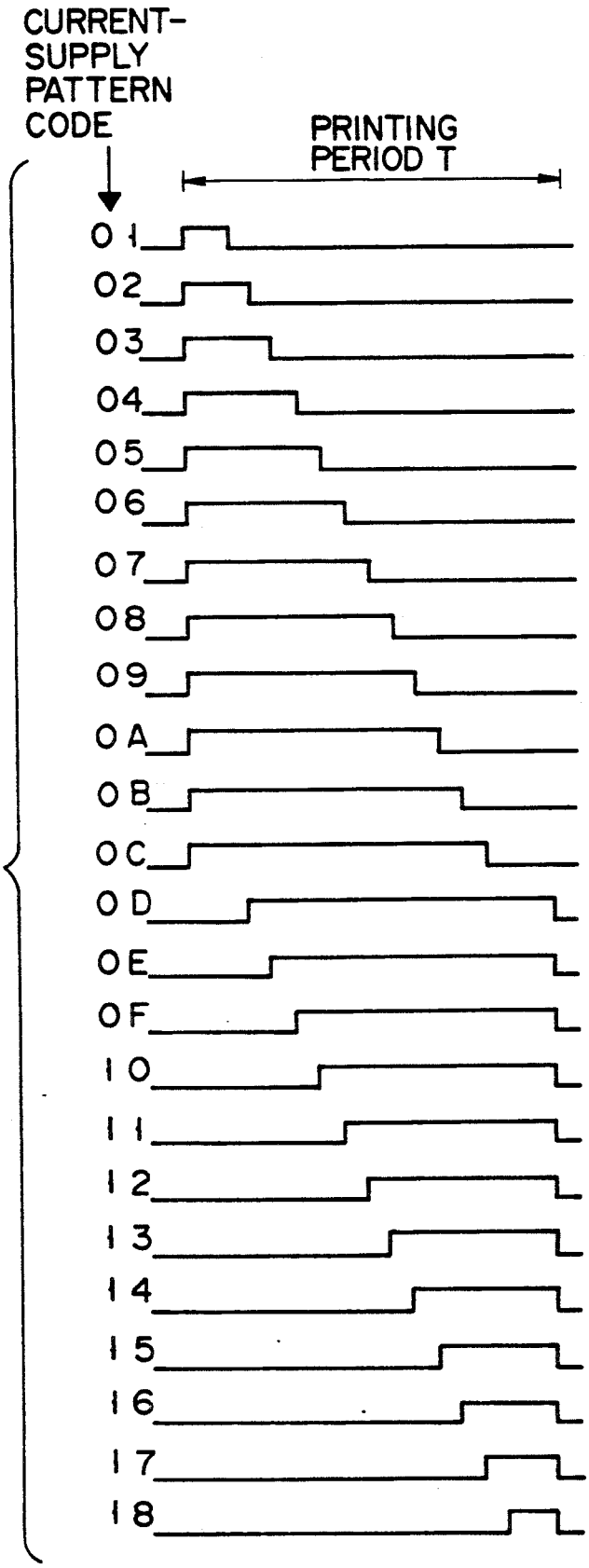
FIGS. 27A and 27B are a list of the current-supply pattern codes which are selected in accordance with the 3×3 pixel matrix showing the values and positions of the pixels adjacent to a pixel of interest.

The heat control section 210 comprises a current-supply pulse selector 213 and a recording voltage controller 214. The selector 213 selects various current-supply pulses having various widths, so that any selected one of the 24 heating elements arranged on the recording head 7 is energized. The recording voltage controller 214 determines the optimum voltage which is to be applied to any selected heating element. The controller 213 determines how many pixels should be printed around a specified pixel, as will be explained with reference to FIG. 26, and then determines which current-supply pulse should be used to energize the selected heating elements. More specifically, the controller 213 selects one of the current-supply pattern codes shown in FIGS. 27A and 27B for each of the selected heating elements. The selected current-supply pattern code 215 is output to a head driver 217.

A temperature sensor 219 (e.g., a thermister) detects the temperature of the recording head 7. It generates a signal representing this temperature, and supplies the signal to the recording voltage controller 214. In accordance with the signal output by the sensor 219, the controller 214 outputs voltage-control data 216 to a head driver 217. The head driver 217 drives the recording head such that each heating element is energized by the recording voltage represented by the data 216, for the period of time defined by the current-supply pattern code 215. Such a method of controlling the head 7 is disclosed in U.S. patent application Ser. No. 163,394 filed May 2, 1988, assigned to the assignee of the present application.

The printing-direction signal 212 representing the direction, in which data is being printing on the paper 10, is supplied to the selector 213 and the controller 214 from a CPU (not shown). In accordance with the signal 212, the heat selector 213 performs a specific method of selecting a current-supply pattern code, and the controller 214 performs a specific method of controlling the recording voltage and controlling the head driver 217.

Figure 28:
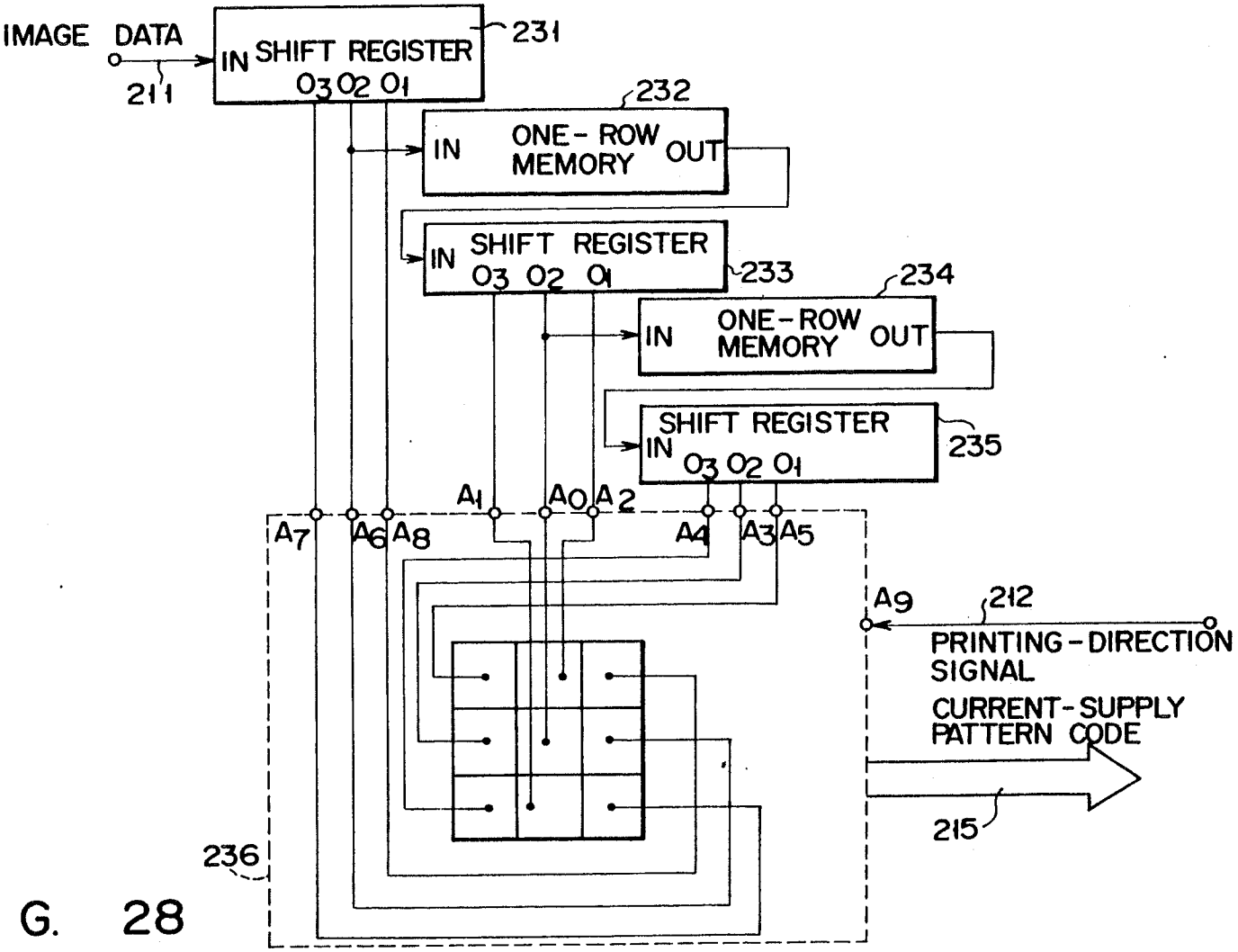
FIG. 28 is a block diagram illustrating the recording voltage controller shown in FIG. 25.

FIG. 28 schematically represents the current-supply pulse selector 213. As is shown in this figure, the selector comprises three 3-bit shift registers 231, 233, and 235, and two one-row memories 232 and 234. Further, it comprises a ROM 236. Binary image data 211 is serially input to the first shift register 231. The shift register 231 outputs 3-bit data consisting of three bits which correspond to three pixels A6, A7, and A8 (FIG. 26) forming the next row to be printed. The 3-bit data is stored into the one-row memory 232. Simultaneously, the 3-bit data consisting of three bits, which correspond to the three pixels forming the preceding row, is supplied from the memory 232 to the shift register 233. The shift register 233 outputs 3-bit data consisting of three bits which correspond to three pixels A0, A1, and A2 (FIG. 26) forming the row, A0 being the pixel of interest. The 3-bit data output by the shift register 233 is stored into the one-row memory 234, and the 3-bit data consisting of three bits, which correspond to the three pixels A3, A4, and A5 (FIG. 26) forming the row preceding the row containing the pixel of interest, i.e., A0, is supplied from the memory 234 to the shift register 235.

The 9 bits output by the shift registers 231, 233, and 235 are supplied to the input terminals of the ROM 236. These bits form a 9-bit address data. The address input terminals of the ROM 236 correspond to pixels A0 to A8 shown in FIG. 26. The ROM 236 stores the current-supply pulse pattern codes shown in FIGS. 27A and 27B. One of the pattern codes is read from the ROM 236 in accordance with the 9-bit address data, and is supplied, as the selected current-supply pattern code 215, to the head driver 217.

The ROM 236 has another input terminal A9 for receiving the significant bit corresponding to the printing-direction signal 212 which is supplied from the CPU (not shown). The signal 212 is a one-bit signal. It represents forward printing its value is "0", and the reverse printing when its value is "1".

One of the current-supply pattern codes (FIGS. 27A and 27B) is read from the ROM 236 in accordance with the 9-bit address data which represent the positional relationship of the pixel of interest and the adjacent pixels and also with the direction of printing. The pattern code 215 thus read from the ROM 236 is supplied to the head driver 217. The code 215 serves to control not only the heating of the ribbon 4, but also the transfer of the ink to the paper 10 during the reverse printing.

It will be explained, in greater detail, how one of the current-supply pattern codes is selected and read from the ROM 236 in accordance with 10 bits A0 to A9 supplied to the ROM 236. Let us assume here again that, data can be printed, with the same length of the ink layer 3, on twice as long a region of the paper 10 during the reverse printing as during the forward printing.

Figure 27B:
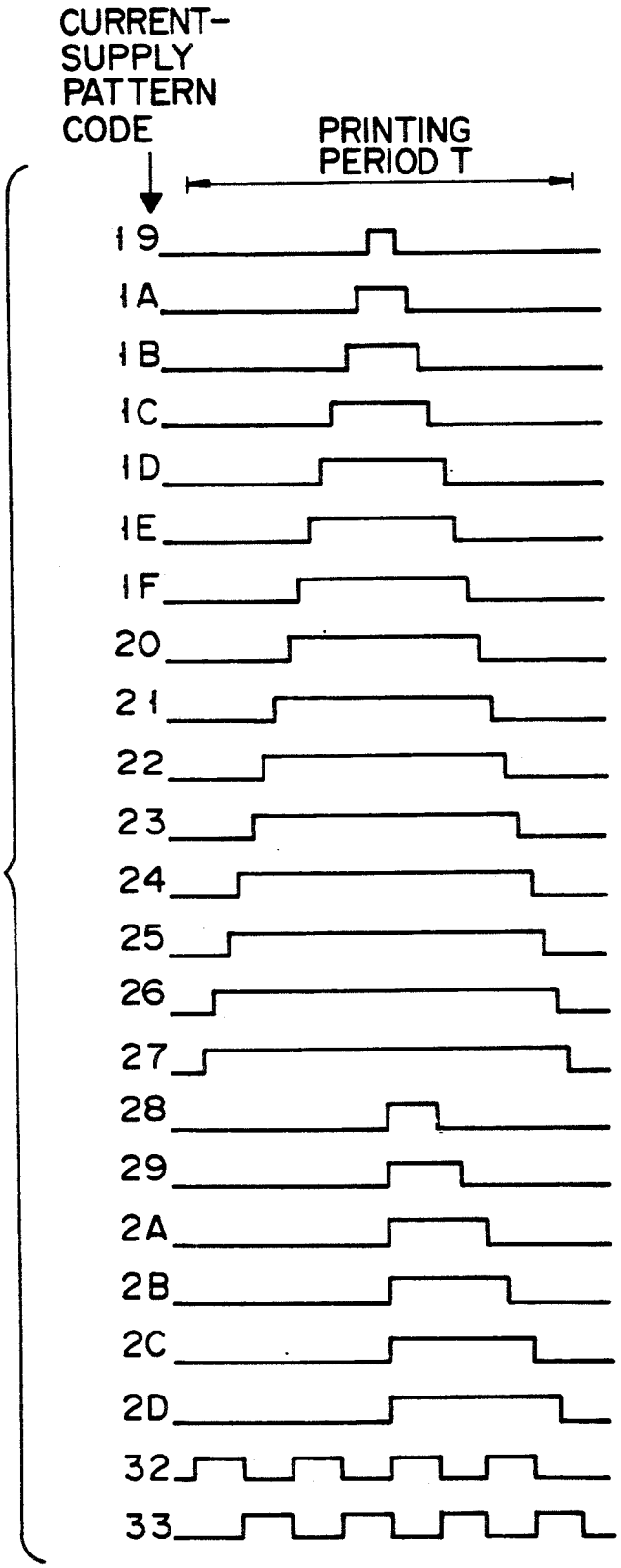

To print only pixel A0, i.e., the pixel of interest, a "1" bit is supplied to the address terminal A0 of the ROM 236, whereas eight "0" bits are supplied to the other address terminals A1 to A8 of the ROM 236. In this instance, the pattern code "27" shown in FIG. 27B is read out as the code 215 from the ROM 236 when A9="0", and the pattern code "20" shown in FIG. 27B is read out as the code 215 from the ROM 236 when A0="1". As can be understood from FIGS. 27A and 27B, the current-supply pulse having a width almost equal to the printing period is supplied to the head 7 during the forward printing, whereas the current-supply pulse having a width half the printing period is supplied to the head 7 during the reverse printing. Hence, the heating element of the head 7, which is to print pixel A0, is heated almost for the printing period during the forward printing, and heated half this period during the reverse printing. As a result, the reverse printing will be of the same quality as the forward printing.

To print all nine pixels A0 to A8, that is, to perform all-mark printing, nine "1" bits are supplied to the address terminals A0 to A8 of the ROM 236. In this case, the pattern code "20" shown in FIG. 27B is read out as the code 215 from the ROM 236 when A9="0." As is evident from FIG. 27B, the code "20" designates a current-supply pulse whose width is about half the printing period. It suffices to energize the head 7 for half the printing period to effect all-mark printing in the forward direction since the head 7 accumulates a great amount of heat while carrying out the all-mark printing. When A9="1", the code pattern "1C" is read out as the code 215 from the ROM 236. As may be understood from FIG. 27B, the code "1C" designates a current-supply pulse whose width is about a quarter of the printing period. It suffices to energize the head 7 for a quarter of the printing period to effect all-mark printing in the reverse direction partly because the head 7 accumulates a great amount of heat while carrying out the all-mark printing, and partly because data can be printed on a longer region of the paper 10 with the same amount of ink, than in the case of the forward printing.

As is shown in FIG. 25, the printing-direction signal 212 is input to recording voltage controller 214, too, thereby to change the recording voltage in accordance with the direction of printing. As has been pointed out, the ink ribbon 4 does not move relative to the paper 10 during the forward printing, and moves relative to the paper 10 during the reverse printing. When each heating element of the head 7 has a width less than ⅔ of the interval at which the heating elements are arranged in the main-scanning direction, those portions of the paper 10 which oppose the gaps among the heating elements can not be heated sufficiently. To transfer ink onto the paper 10, the paper 10 must also be heated to 10° C. or more. When such a recording head is used, thus carrying out bidirectional printing, the pixels formed on the paper 10 by the reverse printing may be discontinuous in the main-scanning direction.

Figure 29:
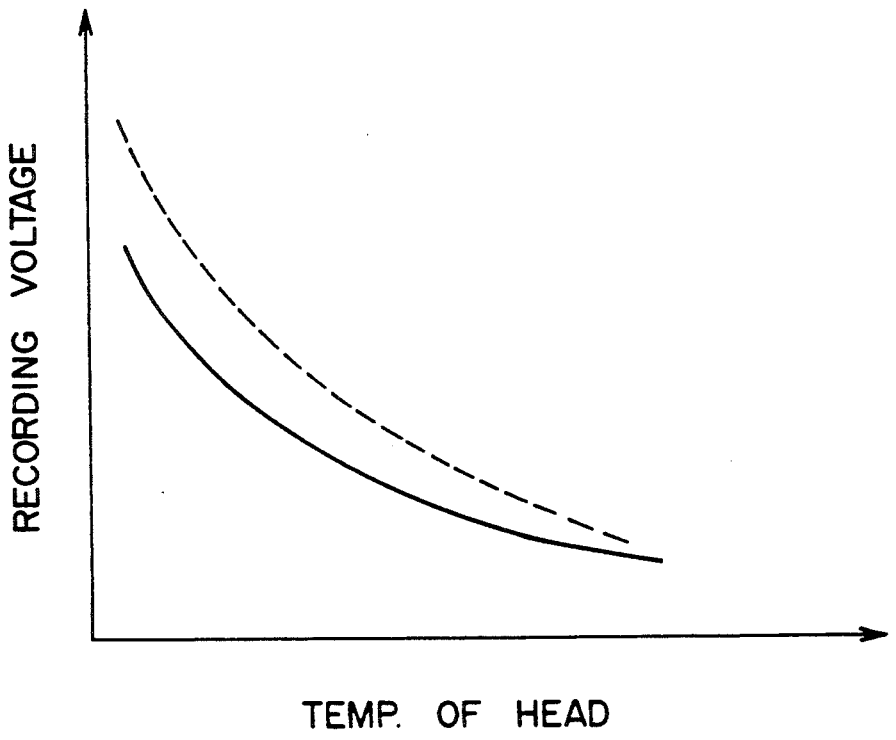
FIG. 29 is a graph representing the data stored in the ROM shown in FIG. 28.

In order to prevent the printing of such discontinuous pixels, a higher recording voltage is applied to the head 7 during the reverse direction. The higher the voltage applied to the head 7, the more heat the head 7 generates, and the larger the size of the pixel printed by the heating elements. Accordingly, the recording voltage is controlled in accordance with the temperature of the head 7, such that it is higher during the reverse printing as is indicated by the broken line in FIG. 29, than during the forward printing as is represented by the solid line in FIG. 29. Hence, the pixels formed on the paper 10 are continuous in the main-scanning direction, no matter whether they have been formed by the forward printing or the reverse printing.

The recording voltage controller 214 can comprise a ROM as the current-supply pulse selector 213. This ROM stores the two voltage control schemes shown in FIG. 29, and the first control scheme or the second control scheme is read from the ROM in accordance with the printing-direction signal 212.

A further electrothermal printer according to the present invention will be described, with reference to FIGS. 30A to 30D and also to FIG. 31. This printer can prevent ink-streaking during the reverse printing, to accomplish high-quality printing. The printer is characterized in two respects. First, the carriage 30 is moved at the same speed in either direction, that is, $V_{HF}=V_{HB}$. Second, the ink ribbon 4 is moved faster during the forward printing than during the reverse printing, that is, $V_{RF}>V_{RB}$. In other words, the ink ribbon 4 is used less in the reverse printing than in the forward printing. To save the ink ribbon 4, the speeds $V_{HF}$, $V_{HB}$, $V_{RF}$, and $V_{RB}$ are set to have the following relation:

$$V_{HF}=V_{HB}\leqq V_{RF}<V_{RB}$$

With reference to FIGS. 30A to 30D, it will be explained why high-quality printing is accomplished when the speeds of the ink ribbon 4 and the speeds of the carriage 30 have said specific relationship.

As has been pointed out, the carriage 30 is moved at the same speed in either direction, and the ribbon 4 is moved faster during the forward printing than during the reverse printing. As has been explained with reference to FIGS. 23A to 23D, the ribbon 4 is moved at a speed half that of the carriage 30 during reverse printing, wher data can be printed with the same length of the ink layer 3, on as twice long a region of the paper 10 as during the forward printing. In this case, the portions 51, 52 and 53 of the ink layer 3 which have a length l/2 are used to print data on the regions a, b, and c of the paper 10 which have a length l.

Figures 30A, 30B, 30C, 30D:
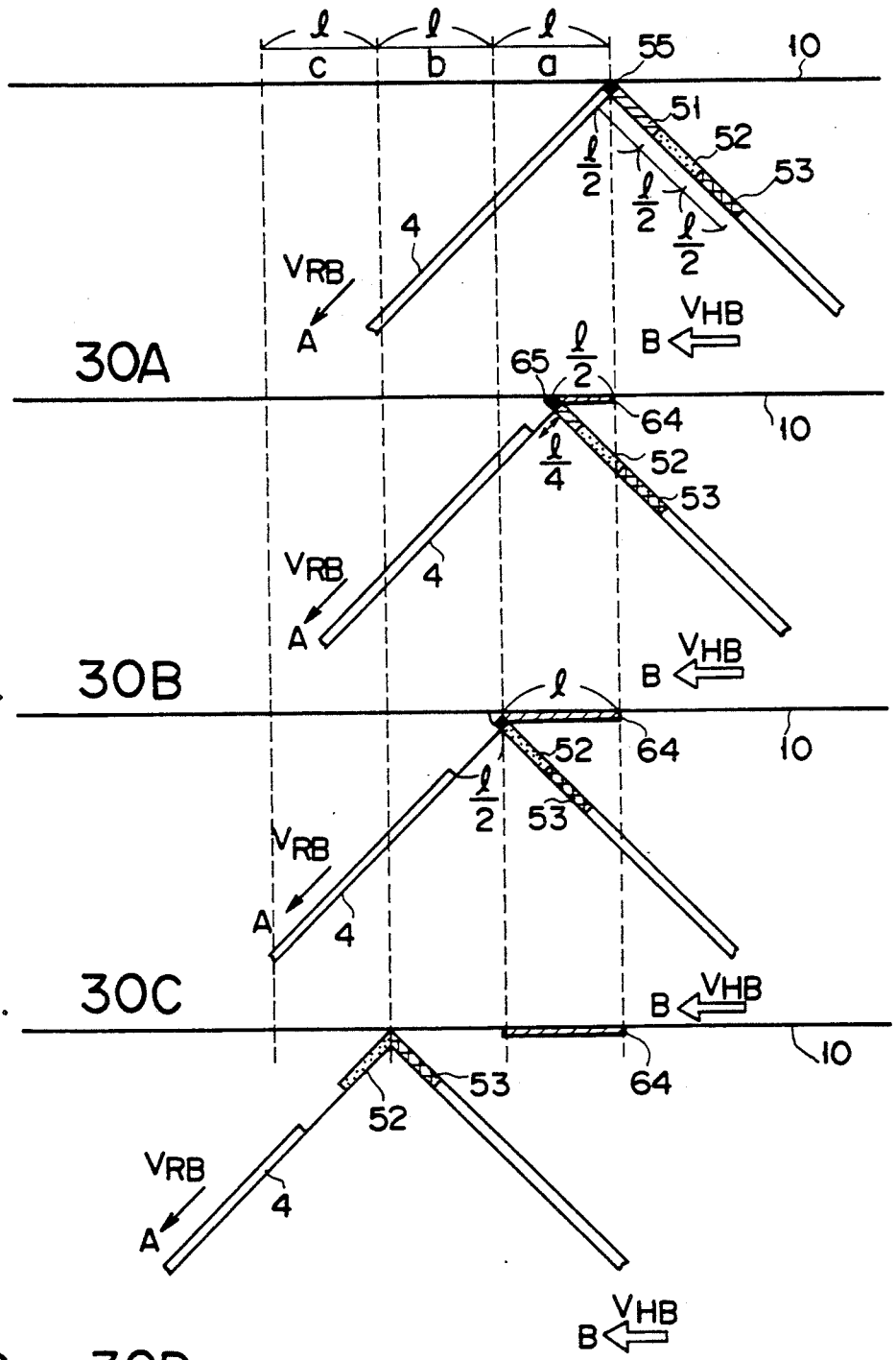
FIGS. 30A to 30D are plan views explaining how to prevent the recording paper from getting dirty when the recording head is driven by the current-supply pulses shown in FIG. 22A and prints data in the reverse direction.

During the reverse printing, the portion 51 of the ink layer is to be transferred to the region a of the paper 10. First, the edge of the ink portion 51 contacts the paper 10 as is shown in FIG. 30A. Then, the carriage 30 moves in the reverse direction for distance of l/2 as is shown in FIG. 30B. At this time, the portion of the ink layer 2, whose length is l/4, has already melted. This molten ink is applied on the first half of the region a. That is, the ink is applied on a region twice as long as that portion of the ink layer from which it has been transferred. Hence, virtually no accumulation 65 of ink takes place between the recording paper 10 and that portion of the ribbon 4 which is leaving the paper 10. No accumulation of ink occurs even after the ink has been transferred to the entire region a having length l, as is illustrated in FIG. 30C. Therefore, high-quality printing is accomplished as is shown in FIG. 30D.

In the above instance, data is printed, with the same length of the ink layer 3, on as twice long a region of the paper 10 during the reverse printing as during the forward printing. Nonetheless, the data can be printed, with the same length of the ink layer 3, on a longer or shorter region of the paper 10 during the reverse printing, depending upon the properties of the ink or the printing speed. Generally, when data is printed, with the same length of the ink layer 3, on n times as long a region of the paper 10 during the reverse printing, as during the forward printing, it suffices to take up the ink ribbon 4 at a speed n times lower than during the forward printing.

Figure 31:
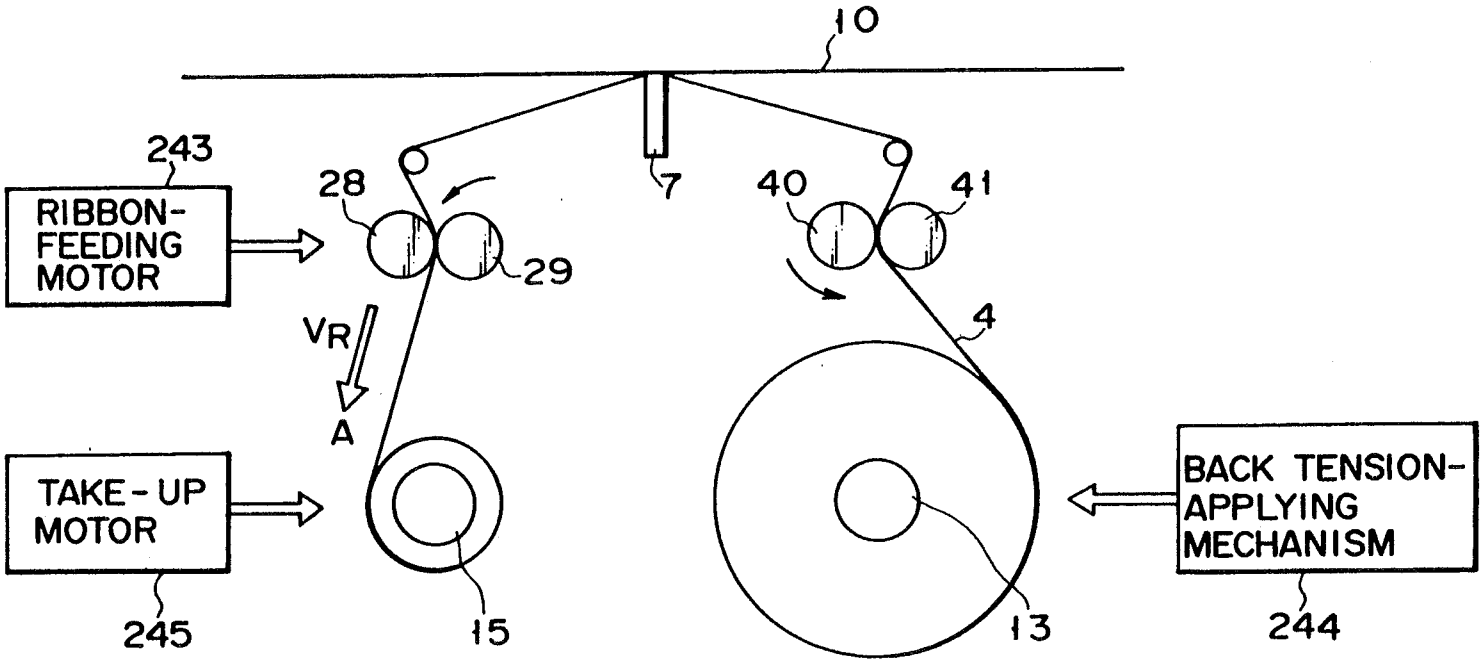
FIG. 31 is a diagram showing a printer which can effect the printing operation explained with reference to FIGS. 30A to 30D.

FIG. 31 illustrates a carriage 30 which can change the ribbon-feeding speed in accordance with the direction of printing. A ribbon-feeding reel 13, a ribbon take-up reel 15, a recording head 7, a pair of rollers 28 and 29, and a pair of rollers 40 and 41 are mounted on the carriage 30. The unused portion of ink ribbon 4 is wound around the reel 13, and the used portion thereof is taken up around the reel 15. Further, a solenoid (not shown), a ribbon-feeding motor 243, a back tension-applying mechanism 244, and a ribbon take-up motor 245 are also mounted on the carriage 30. The solenoid is used to press the head 7 onto the paper 10 and release the head 10 therefrom. The motor 243 can rotate the rollers 29 and 40 in the direction of the arrow. The mechanism 244 controls the rotation of the reel 13, thereby to apply back tension on the ink ribbon 4. The motor 245 is used to rotate the ribbon take-up reel 15. The solenoid and motors 243 and 245 are driven under the control of a CPU located outside the carriage 30. The back tension-applying mechanism 244 is rather simple in structure, comprising a lever having a felt pad and a spring holding the felt pad in contact with the ribbon-feeding reel 13. The ribbon take-up motor 245 is coupled to an idling mechanism. The idling mechanism disconnects the motor 245 from the reel 15 when that portion of the ribbon 4, which is travelling from the roller 29 and the reel 15, becomes sufficiently tense. Hence, the ribbon take-up reel 15 is not rotated as long as a sufficient tension is applied on said portion of the ink ribbon 4.

In the case of the printer having the carriage 30 shown in FIG. 31, when the carriage 30 is moved at the same speed in either direction, and the ribbon-feeding motor 243 is controlled so as to feed the ink ribbon 4 slower during the reverse printing than during the forward printing. The motor 243 can be either a pulse motor or a DC motor. When the motor 243 is a pulse motor, the frequency at which pulses are supplied to the motor is changed to drive the motor 243 at a different speed. When the motor 243 is a DC motor, it is servo-controlled to change the ribbon take-up speed in accordance with the direction of printing. Since the ribbon-feeding motor 243 is controlled, independently of the speed of the carriage 30, the printer can be set in various ribbon-saving modes by the use of software.

The speed of feeding the ink ribbon 4 can be changed in accordance with the direction of printing, also in the printer shown in FIGS. 17A to 17D, wherein the ribbon reels 13 and 15 are located at the ends of the platen 12, not mounted on the carriage 30 as is shown in FIG. 31. Although the data is printed in the same speed in either direction in all embodiments described above, the speed of printing data can be changed in accordance with the direction of printing. In this case, the speed of feeding the ink ribbon 4 is determined in accordance with the speed of the reverse printing. This is because it is only during the reverse printing (either in the ordinary mode or the ribbon-saving mode) that a length of the ink layer 3 is applied on a longer region of the recording paper 10, and therefore the speed of the reverse printing is the sole determinant of the length of the region on which the ink is applied.

Since a length of the ink layer 3 is applied on a longer region of the paper 10 during the reverse printing, some measures must be taken during the reverse printing to provide the same printing quality as is achieved by the forward printing. More specifically, to print a character having any stroke consisting of n dots arranged in the sub-scanning direction (where n is an integer more than 1) in the reverse direction, a character pattern data is used in which the same stroke consists of n–m dots arranged in the sub-scanning direction (where m is 1 or more). This specific method will be described in detail, with reference to FIGS. 32A to 32C, FIG. 33, FIG. 34, and FIG. 35.

Figure 32A:
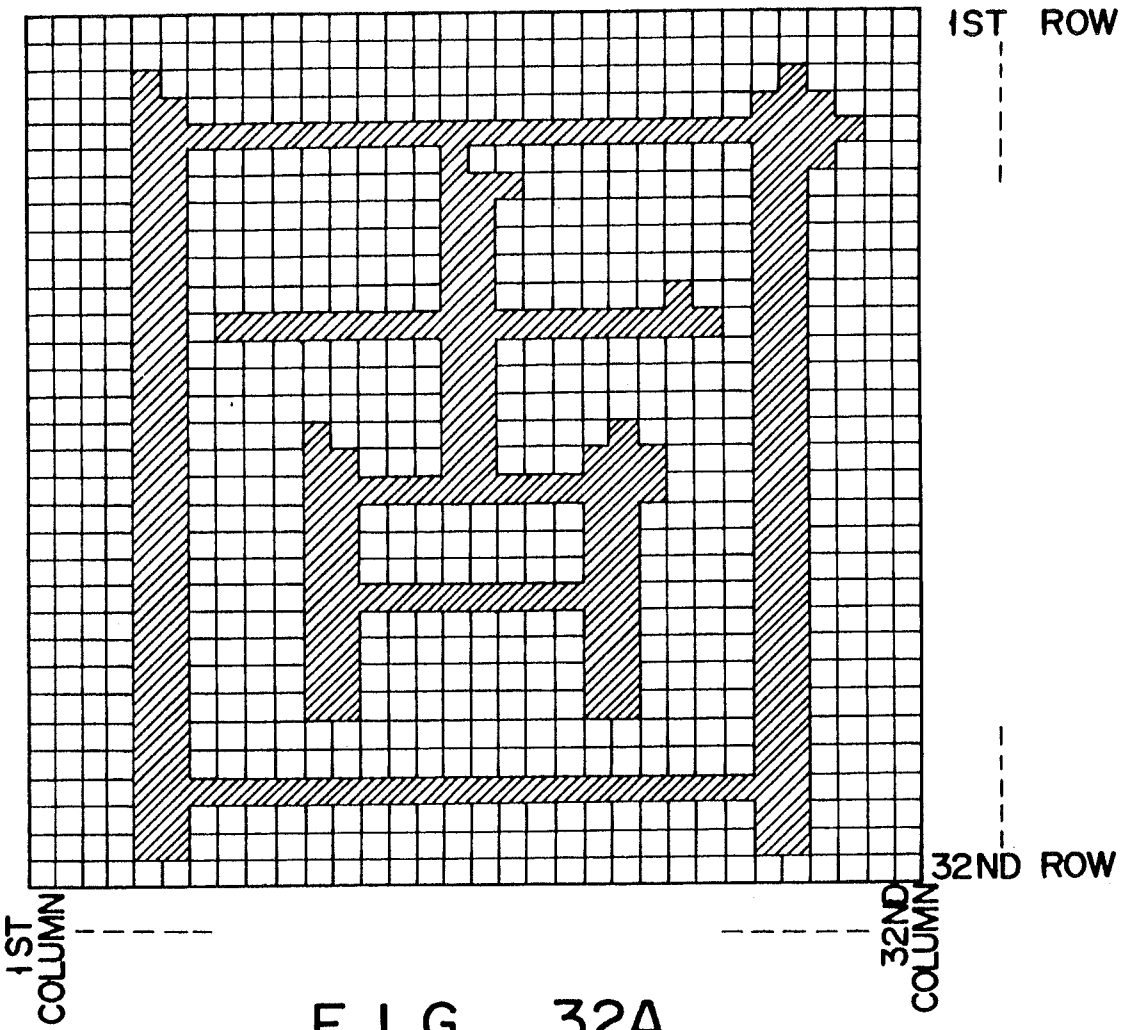
FIG. 32A shows the pattern data used in printing a Chinese character is printed in the forward direction.

FIG. 32 shows a Chinese character pattern which is a 32 dots×32 dots matrix pattern. To print characters in this matrix pattern, a recording head must be used which has an array of 40 heating elements or recording electrodes. These elements are arranged in a column, or in the main-scanning direction. Hence, as the recording head is moved forward, that is, from the left to the right in FIG. 32A, the Chinese character is printed, column by column, from the first column to the 32nd column.

As has been explained, the same length of the ink layer 3 is applied on a longer region of the paper 10 during the reverse printing than during the forward printing. Hence, when the Chinese character is printed in the reverse direction in accordance with the data representing the character pattern shown in FIG. 32A, any vertical stroke of the printed Chinese character will be thicker. For example, a vertical stroke will be 3 dots thick or 4 dots thick, though it should be 2 dots thick. Consequently, the ink dot at the 12th row and the 27th column, and the ink dot at 12th row and the 8th column will expand in the sub-scanning direction, inevitably blackening the blank portion at the 12th row and the 26th column and also the blank portion at the 12th row and the 7th column. This results in low-quality printing, particularly of many vertical and slanting strokes. Further, when characters are printed in the reverse direction in accordance with data representing 32 dots×32 dots matrix patterns similar to that of FIG. 32A, they will be emphasized unnecessarily.

Figure 32B:
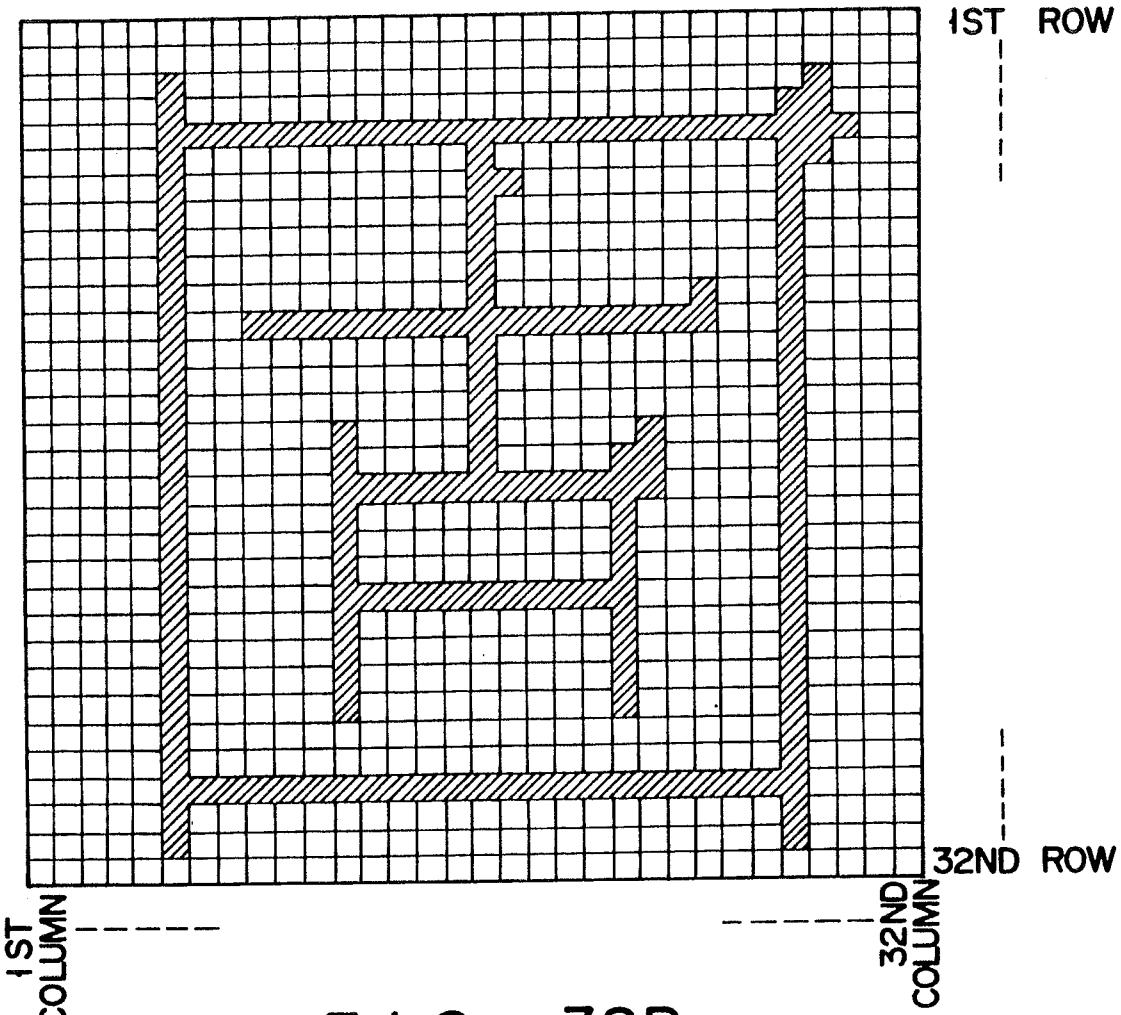
FIG. 32B shows the pattern data used in printing the Chinese character in the reverse direction.
Figure 32C:
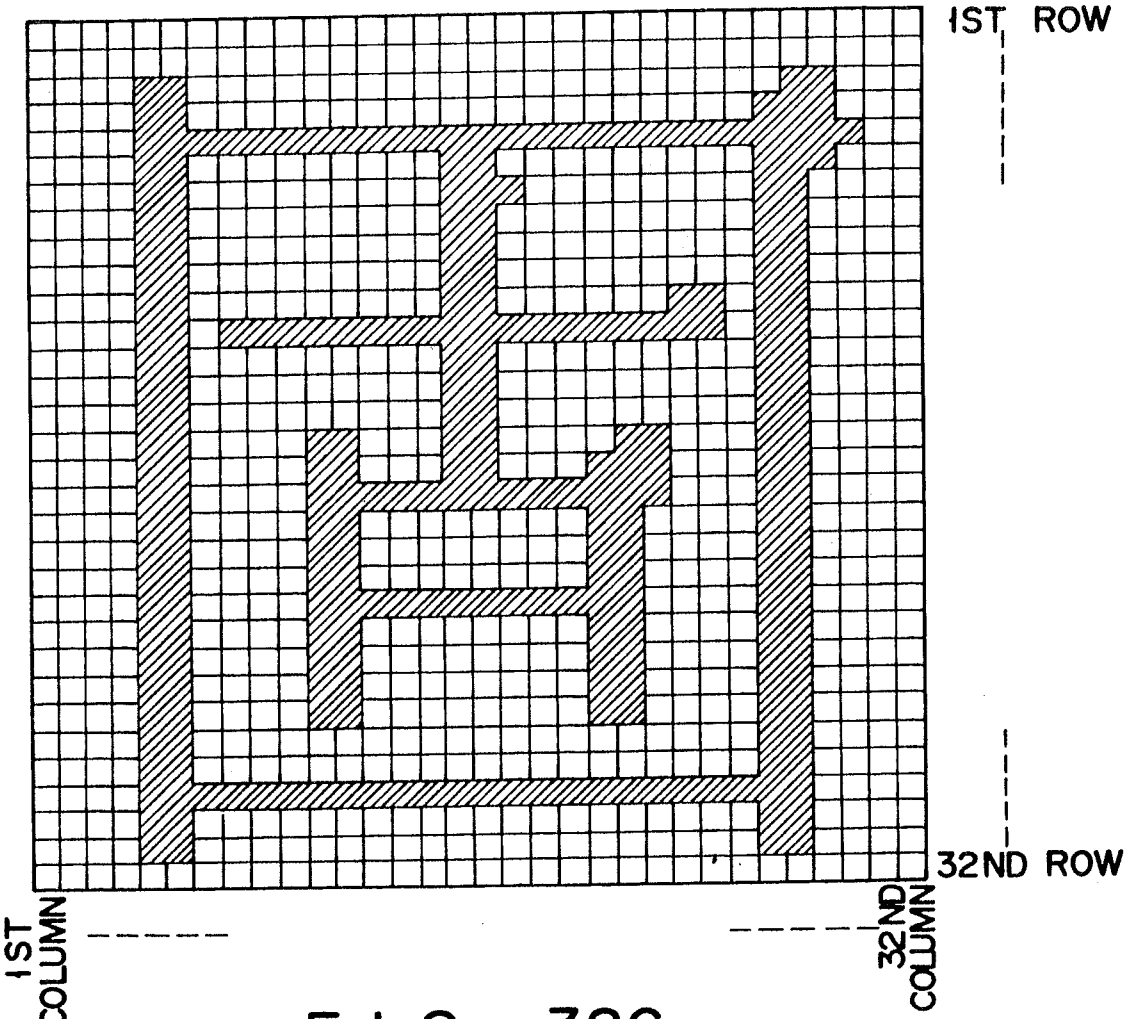
FIG. 32C the pattern in which the Chinese character is printed in the reverse direction.

To prevent such low-quality printing of characters, the same Chinese character is printed in the reverse direction in accordance with the data showing the 32 dots×32 dots matrix pattern illustrated in FIG. 32B. In this case, the pressure holding the recording head onto the paper 10 and the recording voltage applied to the head 7 are controlled such that the same length of the ink layer 3 is applied on twice as long a region of the paper 10 during the reverse printing than during the forward printing. Hence, as the head 7 is moved in the reverse direction, that is, from the right to the left, the character of the pattern shown in FIG. 32C will be printed, column by column, from the 32nd column to the first column. Since most vertical strokes of the character pattern shown in FIG. 32B are one dot thick, the corresponding vertical strokes of the printed character are two dots thick as is evident from FIG. 32C. Also as is clearly shown in FIG. 32C, the two portions of the paper 10, which are at the 12th row and the 26th column and at the 12th row and the 7th column, remain blank. The character printed in the reverse direction cannot be exactly identical to the one printed in the forward direction, inevitably because any one-dot thick vertical stroke will become two dots thick when printed in the vertical direction. Nonetheless, most Chinese characters have only a few one-dot thick vertical strokes. Hence, the character printed in the reverse direction is almost identical, in pattern, to the character printed in the forward direction.

The data representing character pattern shown in FIG. 32B can be easily formed from the data representing the pattern illustrated in FIG. 32A, in accordance with the rule shown in Table 1. More specifically, the value of each bit corresponding to any pixel (or bit) of interest is determined from the values ("0" or "1") of the two pixels (or bits) located beside the pixel of interest, in the same row.

TABLE 1

| Bit pattern for forward printing | | | Bit pattern |
|---|---|---|---|
| Preceding pixel | Pixel of interest | Following pixel | for reverse printing |
| 0 | 0 | 0 | 0 |
| 0 | 0 | 1 | 0 |
| 0 | 1 | 0 | 1 |
| 0 | 1 | 1 | 0 |
| 1 | 0 | 0 | 0 |
| 1 | 0 | 1 | 0 |
| 1 | 1 | 0 | 1 |
| 1 | 1 | 1 | 1 |

Figure 33:
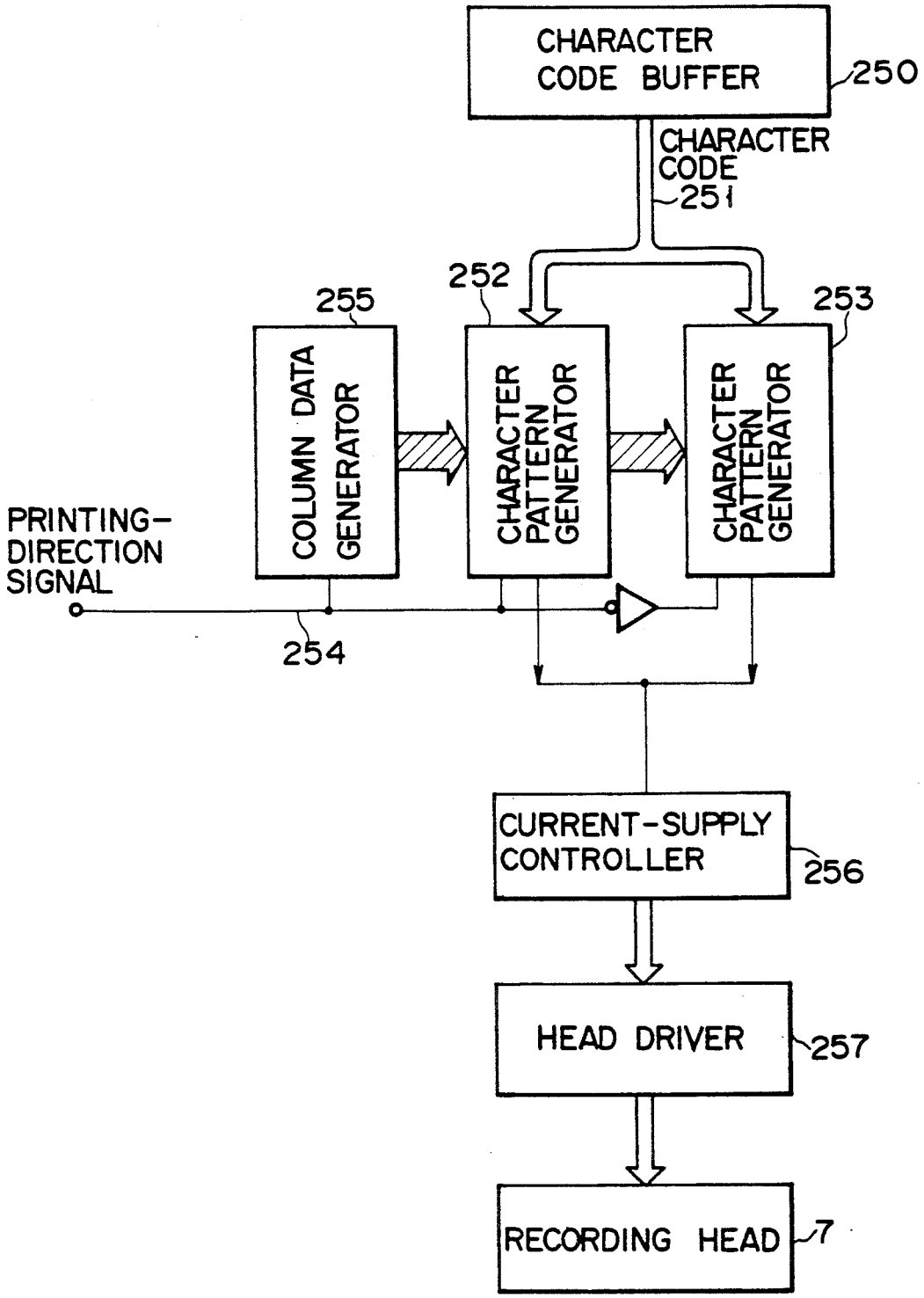
FIG. 33 is a block diagram showing a circuit for generating the pattern data illustrated in FIG. 32B.

FIG. 33 is a block diagram showing the circuit for generating the pattern data showing the character pattern shown in FIG. 32A, and also the pattern data representing the character pattern shown in FIG. 32B. As is illustrated in FIG. 33, this circuit comprises a character code buffer 250, two character pattern generators 252 and 253, both connected to the buffer 250, and a column data generator 255 connected to both character pattern generators 252 and 253. The buffer 250 stores the codes of the characters to be printed in one line. The character codes are supplied, one after another, from the buffer 250 to both character pattern generators 252 and 253. In accordance with each code, the character pattern generator 252 generates data representing the character pattern shown in FIG. 32A, which is to be printed in the forward direction. Also in accordance with the same character code, the character pattern generator 253 generates data representing the character pattern shown in FIG. 32B, which is to be printed in the reverse direction. A printing-direction signal 254 is supplied to both pattern generators 252 and 253. When signal 254 designates the forward printing, the character pattern data generated by the pattern generator 252 is selected. On the other hand, when signal 254 designates the reverse printing, the character pattern data generated by the pattern generator 253 is selected.

The column data generator 255 generates column data items designating the columns of a character pattern. These data items are supplied to both character pattern generators 252 and 253. In response to these column data items, the character pattern generators 252 and 253 output the data items representing the columns of the 32 dots×32 dots matrix pattern, one after another. In other words, either character pattern generator converts the character pattern data into serial data. This serial data is input to a current-supply controller 256. The printing-direction signal 254 is also supplied to the column data generator 255. When the signal 254 designates the forward printing, the column data generator 255 generates the data items designating the first to the 32nd column, in this order. These data items are supplied to the character pattern generator 252. As a result, the character pattern generator 252 generates a series of data items which represent the dot patterns of the first to the 32nd columns of the character pattern shown in FIG. 32A. When the signal 254 designates the reverse printing, the column data generator 255 generates the data items designating the 32nd to the first column, in the reverse order. The column data items are supplied to the character pattern generator 253. Hence, the character pattern generates a series of data items which represent the dot patterns of the 32nd to the first column of the character pattern shown in FIG. 32B.

In accordance with the serial data output by either character pattern generator, the current-supply controller 256 generates data representing the conditions in which to supply a current to the recording head 7 to give optimum energy thereto. More precisely, the controller 256 determines, from the temperature of the head 7 and the character pattern, the optimum width and the optimum value which current-supply pulses and the recording voltagest have to make the head 7 perform high-quality printing. The data showing the optimum pulse width and the optimum recording voltage is supplied to a head driver 257. In accordance with this data, the head driver 257 drives the heating elements or the recording electrodes of the head 7.

As has been pointed out, the order in which the column data generator 255 outputs the column data items is switched every time the printing-direction signal 254 is supplied to the generator 255. According to the present invention, this order need not be altered, only if the character pattern generator 253 is designed to generate data representing the mirror image of the character pattern shown in FIG. 23B. Needless to say, to effect the forward printing, the character codes 251 are read from the buffer 250 in the order the corresponding characters are to be printed, and to perform the reverse printing, the character codes 251 are read from the buffer 250 in the reverse order.

The circuit shown in FIG. 33 is suitable for use in a printer for printing documents in a languages using a limited number of characters, such as English. However, it is not suitable for use in a printer for printing documents in a language using a great number of characters, such as Japanese. This is because of the two character pattern generators used in the circuit. Either character pattern generator is a memory storing the patterns of the characters which the printer can print. To incorporate the circuit into a printer for printing Japanese documents, each character pattern generator must have a great memory capacity. The greater the memory capacity, the more expensive the character pattern generator. Moreover, it is recently demanded that thermal printers be able to print graphics, as well as characters, and to print characters in italic mode. To meet this demand, either character pattern generator must have a great memory capacity since graphic data occupies a great storage area.

Figure 34:
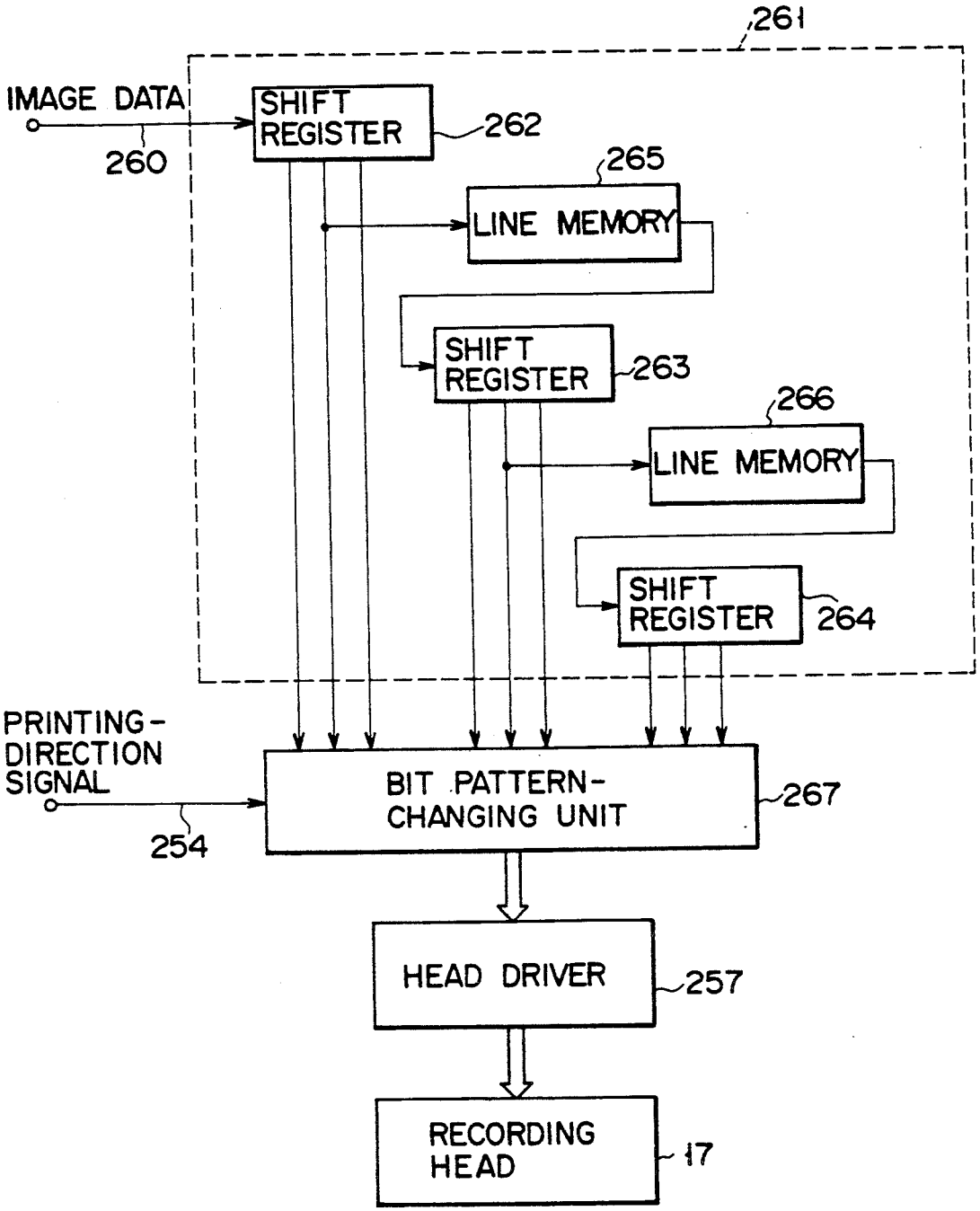
FIG. 34 is a block diagram illustrating another circuit for generating the pattern data shown in FIG. 32B.
Figure 35:
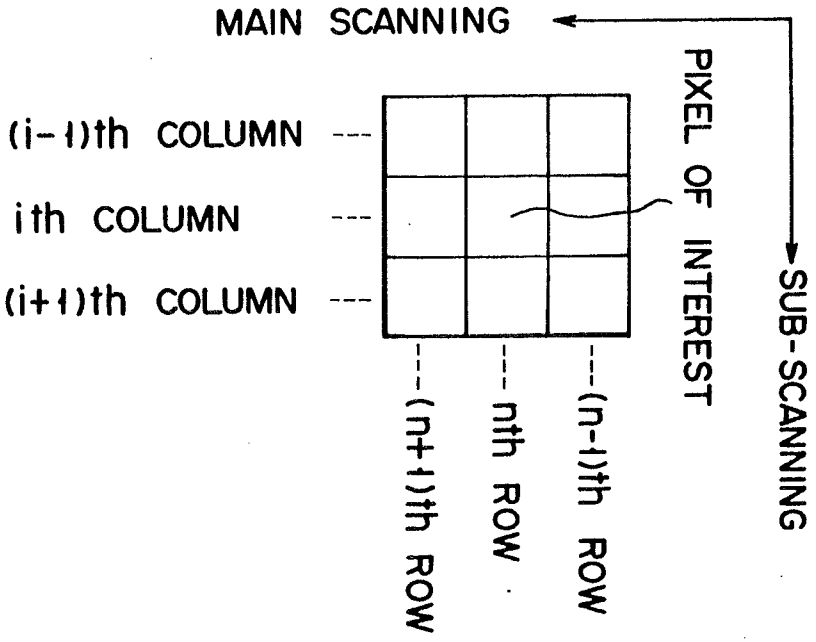
FIG. 35 shows a 3×3 pixel matrix represented by the character pattern data generated by the circuit shown in FIG. 34.

FIG. 34 shows is a block diagram showing a circuit which generates the pattern data showing the character pattern shown in FIG. 32A, and processes this data to generate the pattern data representing the character pattern shown in FIG. 32B. When incorporated in a thermal printer, this circuit can serve to print not only characters, but also graphics, and can also print characters in italic mode. As is illustrated in FIG. 34, this circuit comprises a reference region-acquiring unit 261 and a bit pattern-changing unit 267. The unit 261 has three shift registers 262, 263, and 264, and two line memories 265 and 266. Image data 260 is supplied to the reference region-acquiring unit 261, item by item, each item representing a column of pixels, exerting in the main-scanning direction as is shown in FIG. 35. The unit 261 outputs image data representing nine pixels arranged in a 3×3 matrix, as is shown in FIG. 35. In other words, the unit 261 outputs three columns of pixels, each consisting a pixel of interest and two adjacent pixels. The shift registers 262, 263, and 264 are serial-in, parallel-out shift registers, from which at least 3 bits can be output in parallel. The line memories 265 and 266 can store at least one array of dots arranged in the main-scanning direction. The shift registers 262, 263, and 264 output data items representing the $(i-1)$th column of pixels, the ith column of pixels, and the $(i+1)$th column of pixels. The 3-bit data items output by these shift registers are supplied to the bit pattern-changing unit 267.

The bit pattern-changing unit 267 comprises a ROM. A printing-direction signal 254 is input to the bit pattern-changing unit 267. As long as this signal designates the forward printing, the character patterns are through out the unit 267 and supplied to the head driver 257, without being changed at all. When the signal 254 designates the reverse printing, the character patterns are changed in accordance with the rule shown in Table 1, thus changing reference regions in the way specified in Table 2.

TABLE 2

| | | Pattern in ref. region | New pattern |
|---|---|---|---|
| Pixel of interest "0" | | x x x<br>x 0 x<br>x x x | 0 |
| Pixel of interest "1" | ① | x x x<br>0 1 1<br>x x x | 0 |
| | ② | x x x<br>0 1 0<br>x x x | 1 |
| | ③ | x x x<br>1 1 x<br>x x x | |

In Table 2, "0" means a pixel not to be printed, and "1" means a pixel to be printed. Mark "x" means a pixel either to be printed or not to be printed. When the pixel of interest is not to be printed, it will not be printed in the case of the reverse printing. When the pixel of interest is to be printed, it will be printed also in the reverse printing, but will not be printed if the corresponding pixel of the preceding column is not printed and the corresponding pixel of the next column is to be printed.

The circuit shown in 34 can change the character pattern shown in FIG. 32A to the character pattern illustrated in FIG. 32B. The data showing the character pattern thus changed is supplied to the head driver 257. In accordance with the character pattern data, the head driver 257 drives the recording head 7, which prints the character shown in FIG. 32B in the reverse direction.

As can be understood from Table 2, the data used in changing the character pattern is concerned with only the two columns, one preceding and the other following the column including the pixel of interest. The data representing two other pixels, which form a column along with the pixel of interest, does not influence the changing of the character pattern at all. Nonetheless, such the reference region shown in FIG. 35 is used to enable the bit pattern-changing unit 267 to perform the function of the current-supply controller 256 shown in FIG. 33. Various methods of controlling the energy applied to the head 7 to print the pixel of interest have been proposed in the present specification. In each of these methods, the reference region shown in FIG. 35 is acquired, and then the optimum energy for printing the pixel of interest is determined in accordance with the positions and values of the other pixels in the reference region. Hence, to accomplish both the control of the printing energy and the changing of the character pattern, use is made of the reference region shown in FIG. 35.

The control of the printing energy consists in reducing the energy supplied to each heating element or recording electrode of the head 7 in inverse proportion to the number of the pixels which are in the reference region and which are to be printed. Therefore, in the case of the forward printing, the data output by the bit pattern-changing uniting, the data consists of the data item representing the character pattern shown in FIG. 32B, the data item showing the width of a current-supply pulse, and the data item showing the recording voltage.

As has been explained, the circuit shown in FIG. 34 does not require a memory of a great capacity, and can thus be small and inexpensive. Further, it enables the recording head 7 to print characters of various bit patterns in the same quality, regardless of the printing direction.

What is claimed is:

1. A thermal printer for printing patterns on recording surface by transferring ink onto the recording surface, said printer comprising:

ink ribbon having an ink layer;

energy-applying means having a distal end which is linearly elongated and which contacts the ink ribbon when the printer is set in a recording mode, for applying recording energy to the ink ribbon through the distal end, whereby that portion of the ink layer which contacts the recording surface along said linearly elongated distal end is transferred onto the recording surface;

drive means for driving said energy-applying means at a first drive speed in a first direction crossing linearly elongated distal end in a first mode, and at a second drive speed in a second direction, which is opposite to the first direction, in a second drive mode, such that the distal end of said energy-applying means slides on the ink ribbon; and ribbon feeding means for continuously feeding the ink ribbon in the second direction, thereby to move the ink ribbon at a first feeding speed relative to the recording surface while said energy-applying means is driven in the first drive mode, and at a second feeding speed relative to the recording surface, the second feeding speed being faster than the first feeding speed, while said energy-applying means is driven in the second drive mode.

2. The thermal printer according to claim 1, wherein said drive means includes carrying means for carrying said energy-applying means, and a mechanism for moving the carrying means in the first direction in the first mode, and in the second direction in the second mode.

3. The thermal printer according to claim 1, wherein said drive means includes carrying means for carrying said energy-applying means, said ribbon-feeding means, and said ink ribbon, and a mechanism for moving the carrying means in the first direction in the first mode, and in the second direction in the second mode.

4. The thermal printer according to claim 1, wherein said drive means moves said energy-applying means at a first speed in the first direction in the first mode, and also at the first speed in the second direction in the second mode; and said ribbon-feeding means feeds the ink ribbon at the first speed in the second direction, virtually not moving the ink ribbon relative to the recording surface in the first mode.

5. The thermal printer according to claim 1, wherein said drive means moves said energy-applying means at a first speed in the first direction in the first mode, and also at the first speed in the second direction in the second mode; and said ribbon-feeding means feeds the ink ribbon in the second direction at the second speed which is slower than the first speed.

6. The thermal printer according to claim 1, wherein said energy-applying means includes a recording head having a distal end set in a substantially line-contact with the ink ribbon, and said ribbon-feeding means includes a ribbon-feeding mechanism for feeding the ink ribbon along a substantially V-shaped feed path.

7. The thermal printer according to claim 6, wherein said recording head is positioned removable from the ink ribbon, and substantially at right angles to the recording surface.

8. The thermal printer according to claim 6, wherein said recording head is inclined to the recording surface, at a first angle while being moved in the first mode and at a second angle while being moved in the second mode.

9. The thermal printer according to claim 6, wherein said ribbon-feeding means comprises back tension-applying means for applying a back tension to the ink ribbon, a first ribbon-feeding mechanism located whereabouts portion of the ink ribbon which is being fed to the distal end of said recording head, for feeding the ink ribbon in the first mode, and a second ribbon-feeding mechanism located whereabouts portion of the ink ribbon is being fed away from the distal end of said recording head, for feeding the ink ribbon in the second mode.

10. The thermal printer according to claim 7, wherein said energy-applying means applies recording pulse width to the ink ribbon in the second mode shorter than in the first mode, through the distal end of said recording head to print patterns on the recording surface.

11. The thermal printer according to claim 7, wherein said energy-applying means includes means for generating shorter recording pulse width in the first mode than in the second mode to enable said recording head to print bit patterns on the recording surface.

12. The thermal printer according to claim 1, wherein said cover layer is discontinuously formed on the ink layer.

13. The thermal printer according to claim 1, wherein said drive means drives said energy-applying means at the first speed, in the first direction in the first mode and in the second direction in the second mode, and said ribbon-feeding means feeds the ink ribbon in the second direction at the second speed lower than the first speed, whereby less ink is transferred from the ink ribbon onto the recording surface in the second mode than in the first mode.

14. A thermal ink transfer printer for printing patterns on recording surface by transferring ink onto the recording surface, said printer comprising:

ink ribbon having an ink layer;

means for generating heat including a linear array of heating elements which contacts the ink ribbon when the printer is set in a recording mode, the heating elements selectively applying heat to the ink ribbon whereby that portion of the ink layer which contacts the recording surface is softened and transferred onto the recording surface;

drive means for driving said heat-generating means at a first drive speed in a first direction crossing the linear array of the heating elements in a first mode, and at a second drive speed in a second direction, which is opposite to the first direction, in a second drive mode, such that the array of the heating elements slides on the ink ribbon; and ribbon feeding means for continuously feeding the ink ribbon in the second direction, thereby to move the ink ribbon at a first feeding speed relative to the recording surface while said heat-generating means is driven in the first drive mode, the second feeding speed being faster than the first feeding speed, while said heat-generating means is driven in the second drive mode.

15. The thermal ink transfer printer according to claim 14, further comprising signal-generating means for generating recording signal in accordance with the pattern to be recorded on the recording surface, and for supplying the recording signal to the heating elements of said recording head, whereby the heating elements generate heat.

16. The thermal ink transfer printer according to claim 14, wherein said drive means includes carrying means for carrying said heat-generating means, and a mechanism for moving the carrying means in the first direction in the first mode, and in the second direction in the second mode.

17. The thermal ink transfer printer according to claim 14, wherein said drive means includes carrying means for carrying said heat-generating means, said ribbon-feeding means, and said ink ribbon, and a mechanism for moving the carrying means in the first direction in the first mode, and in the second direction in the second mode.

18. The thermal ink transfer printer according to claim 14, wherein said drive means moves said heat-generating means at a first speed in the first direction in the first mode, and also at the first speed in the second direction in the second mode; and said ribbon-feeding means feeds the ink ribbon at the first speed in the second direction, virtually not moving the ink ribbon relative to the recording surface in the first mode.

19. The thermal ink transfer printer according to claim 14, wherein said drive means moves said heat-generating means at a first speed in the first direction in the first mode, and also at the first speed in the second direction in the second mode; and said ribbon-feeding means feeds the ink ribbon in the second direction at the second speed which is slower than the first speed.

20. The thermal ink transfer printer according to claim 14, wherein said heat-generating means includes a recording head having a distal end set in a substantially line-contact with the ink ribbon, and said ribbon-feeding means includes a ribbon-feeding mechanism for feeding the ink ribbon along a substantially V-shaped feed path.

21. The thermal ink transfer printer according to claim 20, wherein said recording head is positioned removable from the ink ribbon, and substantially at right angles to the recording surface.

22. The thermal ink transfer printer according to claim 20, wherein said recording head is inclined to the recording surface, at a first angle while being moved in the first mode and at a second angle while being moved in the second mode.

23. The thermal ink transfer printer according to claim 14, wherein said ribbon-feeding means comprises back tension-applying means for applying a back tension to the ink ribbon, a first ribbon-feeding mechanism located whereabouts portion of the ink ribbon is being fed to the heating elements, for feeding the ink ribbon in the first mode, and a second ribbon-feeding mechanism located whereabouts portion of the ink ribbon which is being fed away from the heating elements, for feeding the ink ribbon in the second mode.

24. The thermal ink transfer printer according to claim 14, wherein said cover layer is discontinuously formed on the ink layer.

25. The thermal ink transfer printer according to claim 14, wherein said drive means drives said heat-generating means at the first speed, in the first direction in the first mode and in the second direction in the second mode, and said ribbon-feeding means feeds the ink ribbon in the second direction at the second speed lower than the first speed, whereby less ink is transferred from the ink ribbon onto the recording surface in the second mode than in the first mode.

26. The thermal ink transfer printer according to claim 14, further comprising bit data-generating means for generating bit data representing a pattern to be printed on the recording surface, and means for generating a recording energy to be supplied to the heating elements, in accordance with the bit data generated by the bit data-generating means.

27. The thermal ink transfer printer according to claim 26, wherein said bit data-generating means generates first pattern data consisting of n bits ($n \geqq 2$) for horizontal direction in the first mode, and second pattern data consisting of (n–m) bits ($n \geqq 1$) for horizontal direction in the second mode even if the patterns to be printed are identical.

28. The thermal ink transfer printer according to claim 26, wherein said bit data-generating means includes means for changing the first pattern data consisting of n bits ($n \geqq 2$) for horizontal direction to the second pattern data consisting of (n–m) bits ($n \geqq 1$) for horizontal direction.

29. An electrothermal printer for printing patterns on recording surface by transferring ink onto the recording surface, said printer comprising:

ink ribbon having a heat-generating layer, and an ink layer formed on th heat-generating layer;

means for applying a recording current to said ink ribbon, including a linear array of recording electrodes which contacts to the ink ribbon when the printer is set in a recording mode, the recording electrodes selectively supplying the recording current to the ink ribbon whereby said heat-generating layer generates heat, and said ink layer is softened by the heat and transferred onto the recording surface;

drive means for driving said current applying means is at a first drive speed in a first direction crossing the linear array of the recording electrodes in a first drive mode, and at a second drive speed in a second direction, which is opposite to the first direction, in a second drive mode, such that the array of the recording electrodes slides on the ink ribbon; and ribbon feeding means for continuously feeding the ink ribbon in the second direction, thereby to move the ink ribbon at a first feeding speed relative to the recording surface while said current applying means is driven in the first drive mode, and at a second feeding speed relative to the recording surface, the second feeding speed being faster than the first feeding speed, while said current applying means is driven in the second drive mode.

30. The electrothermal printer according to claim 29, further comprising current-generating means for generating a recording current in accordance with a pattern to be printed on the recording surface, and supplying the recording current tot he recording electrodes of said current applying means, whereby the heat-generating layer of the ink ribbon generates heat.

31. The electrothermal printer according to claim 30, further comprising a return electrode kept in contact with the heat-generating layer, for collecting the recording current flowing in the heat-generating layer.

32. The electrothermal printer according to claim 31, wherein said return electrode is kept in contact with that portion of the ink ribbon which is being fed toward said recording electrodes of said current-applying means.

33. The electrothermal printer according to claim 29, wherein said drive means includes carrying means for carrying said current-applying means, and a mechanism for moving the carrying means in the first direction in the first mode, and in the second direction in the second mode.

34. The electrothermal printer according to claim 29, wherein said drive means includes carrying means for carrying said current-applying means, said ribbon-feeding means, and said ink ribbon, and a mechanism for moving the carrying means in the first direction in the first mode, and in the second direction in the second mode.

35. The electrothermal printer according to claim 29, wherein said drive means moves said current-applying means at a first speed in the first direction in the first mode, and also at the first speed in the second direction in the second mode; and said ribbon-feeding means feeds the ink ribbon at the first speed in the second direction, virtually not moving the ink ribbon relative to the recording surface in the first mode.

36. The electrothermal printer according to claim 29, wherein said drive means moves said current-applying means at a first speed in the first direction in the first mode, and also at the first speed in the second direction in the second mode; and said ribbon-feeding means feeds the ink ribbon in the second direction at the second speed which is slower than the first speed.

37. The electrothermal printer according to claim 29, wherein said recording electrodes are set in a substantially line-contact with the ink ribbon, and said ribbon-feeding means includes a ribbon-feeding mechanism for feeding the ink ribbon along a substantially V-shaped feed path.

38. The electrothermal printer according to claim 29, wherein said recording electrodes are positioned removable from the ink ribbon, and substantially at right angles to the recording surface.

39. The electrothermal printer according to claim 29, wherein said recording electrodes are inclined to the recording surface, at a first angle while being moved in the first mode and at a second angle while being moved in the second mode.

40. The electrothermal printer according to claim 29, wherein said ribbon-feeding means comprises back tension-applying means for applying a back tension to the ink ribbon, a first ribbon-feeding mechanism located whereabouts portion of the ink ribbon being fed to said recording electrodes, for feeding the ink ribbon in the first mode, and a second ribbon-feeding mechanism located whereabouts portion of the ink ribbon which is being fed away from said recording electrodes, for feeding the ink ribbon in the second mode.

41. The electrothermal printer according to claim 29, wherein said cover layer is discontinuously formed on the ink layer.

42. The electrothermal printer according to claim 29, further comprising signal-generating means for generating a recording signal in accordance with the pattern to be recorded on the recording surface, and for supplying the recording signal to said recording electrodes, whereby said recording current being supplied through the recording electrodes to the ink ribbon for a shorter period of time in the second mode in the first mode.

43. The electrothermal printer according to claim 29, wherein said drive means drives said current-applying means at the first speed, in the first direction in the first mode and in the second direction in the second mode, and said ribbon-feeding means feeds the ink ribbon in the second direction at the second speed lower than the first speed, whereby less ink is transferred from the ink ribbon onto the recording surface in the second mode than in the first mode.

44. The electrothermal printer according to claim 29, further comprising bit data-generating means for generating bit data representing a pattern to be printed on the recording surface, and means for generating a recording current to be supplied to the recording electrodes, in accordance with the bit data generated by the bit data-generating means.

45. The electrothermal printer according to claim 44, wherein said bit data-generating means generates first pattern data consisting of n bits ($n \geqq 2$) for horizontal direction in the first mode, and second pattern data consisting of (n−m) bits ($n \geqq 1$) for horizontal direction in the second mode even if the patterns to be printed are identical.

46. The electrothermal printer according to claim 44, wherein said bit data-generating means includes means for changing the first pattern data consisting of n bits ($n \geqq 2$) for horizontal direction to the second pattern data consisting of (n−m) bits ($n \geqq 1$) for horizontal direction.

47. A thermal printer for printing patterns on recording surface by transferring ink onto the recording surface, said printer comprising:

ink ribbon having an ink layer and a cover layer deposited on the ink layer, said cover layer being made of white or transparent material which softens when heated;

energy-applying means having a distal end which contacts the ink ribbon when the printer is set in a recording mode, for applying recording energy to the ink ribbon through the distal end, whereby that energy-applied portion of the ink layer transferred onto the recording surface;

drive means for driving said energy-applying means in a first direction in a first mode, and in a second direction, which is opposite to the first direction, in a second drive mode, such that the distal end of said energy-applying means slides on the ink ribbon; and ribbon feeding means for continuously feeding the ink ribbon in the second direction, thereby to move the ink ribbon at a first feeding speed relative to the recording surface while said energy-applying means is driven in the first drive mode, and at a second feeding speed relative to the recording surface while said energy-applying means is driven in the second drive mode.

48. The thermal printer according to claim 47, wherein said drive means includes carrying means for carrying said energy-applying means, and a mechanism for moving the carrying means in the first direction in the first mode, and in the second direction in the second mode.

49. The thermal printer according to claim 47, wherein said drive means includes carrying means for carrying said energy-applying means, said ribbon feeding means, and said ink ribbon, and a mechanism for moving the carrying means in the first direction in the first mode, and in the second direction in the second mode.

50. The thermal printer according to claim 47, wherein said drive means moves said energy-applying means at a first speed in the first direction in the first mode, and also at the first speed in the second direction in the second mode; and said ribbon-feeding means feeds the ink ribbon at the first speed in the second direction, virtually not moving the ink ribbon relative to the recording surface in the first mode.

51. The thermal printer according to claim 47, wherein said drive means moves said energy-applying means at a first speed in the first direction in the first mode, and also at the first speed in the second direction in the second mode; and said ribbon-feeding means feeds the ink ribbon in the second direction at the second speed which is slower than the first speed.

52. The thermal printer according to claim 47, wherein said energy-applying means includes a recording head having a distal end set in a substantially line contact with the ink ribbon, and said ribbon-feeding means includes a ribbon-feeding mechanism for feeding the ink ribbon along a substantially V-shaped feed path.

53. The thermal printer according to claim 47, wherein said recording head is positioned removable from the ink ribbon, and substantially at right angles to the recording surface.

54. The thermal printer according to claim 47, wherein said recording head is inclined to the recording surface, at a first angle while being moved in the first mode and at a second angle while being moved in the second mode.

55. The thermal printer according to claim 47, wherein said ribbon-feeding means comprises back tension-applying means for applying a back tension to the ink ribbon, a first ribbon-feeding mechanism located whereabouts portion of the ink ribbon which is being fed to the distal end of said recording head, for feeding the ink ribbon in the first mode, and a second ribbon-feeding mechanism located whereabouts portion of the ink ribbon is being fed away from the distal end of said recording head, for feeding the ink ribbon in the second mode.

56. The thermal printer according to claim 47, wherein said cover layer is discontinuously formed on the ink layer.

57. The thermal printer according to claim 47, wherein said energy-applying means applies recording pulse width to the ink ribbon in the second mode shorter than in the first mode, through the distal end of said recording head to print patterns on the recording surface.

58. The thermal printer according to claim 47, wherein said energy-applying means includes means for generating shorter recording pulse width in the first mode than in the second mode to enable said recording head to print bit patterns on the recording surface.

59. The thermal printer according to claim 47, wherein said drive means drives said energy-applying means at the first speed, in the first direction in the first mode and in the second direction in the second mode, and said ribbon-feeding means feeds the ink ribbon in the second direction at the second speed lower than the first speed, whereby less ink is transferred from the ink ribbon onto the recording surface in the second mode than in the first mode.

60. A thermal printer for printing patterns on recording surface by transferring ink onto the recording surface, said printer comprising:

ink ribbon having an ink layer;

energy-applying means having a distal end which contacts the ink ribbon when the printer is set in a recording mode, for applying recording energy to the ink ribbon through th e distal end, whereby that energy-applied portion of the ink layer transferred onto the recording surface;

drive means for driving said energy-applying means at a first drive speed in a first direction in a first mode, and at a second drive speed in a second direction, which is opposite to the first direction, in a second drive mode, such that the distal end of said energy-applying slides on the ink ribbon;

ribbon feeding means for continuously feeding the ink ribbon in the second direction, thereby to move the ink ribbon at a first feeding speed relative to the recording surface while said energy-applying means is driven in the first drive mode, and at a second feeding speed relative to the recording surface while said energy-applying means is driven in the second drive mode; and signal-generating means for generating a recording signal in accordance with the pattern to be recorded on the recording surface, and for supplying the recording signal to said heating elements of said recording head, whereby the heating elements generates heat which transports to the ink ribbon for a shorter period of time in the second mode than the first mode.

61. The thermal printer according to claim 60, wherein said drive means includes carrying means for carrying said energy-applying means, and a mechanism for moving the carrying means in the first direction in the first mode, and in the second direction in the second mode.

62. The thermal printer according to claim 60, wherein said drive means includes carrying means for carrying said energy-applying means, said ribbon feeding means, and said ink ribbon, and a mechanism for moving the carrying means in the first direction in the first mode, and in the second direction in the second mode.

63. The thermal printer according to claim 60, wherein said drive means moves said energy-applying means at a first speed in the first direction in the first mode, and also at the first speed in the second direction in the second mode; and said ribbon-feeding means feeds the ink ribbon at the first speed in the second direction, virtually not moving the ink ribbon relative to the recording surface in the first mode.

64. The thermal printer according to claim 60, wherein said drive means moves said energy-applying means at a first speed in the first direction in the first mode, and also at the first speed in the second direction in the second mode; and said ribbon-feeding means feeds the ink ribbon in the second direction at the second speed which is slower than the first speed.

65. The thermal printer according to claim 60, wherein said energy-applying means includes a recording head having a distal end set in a substantially line contact with the ink ribbon, and said ribbon-feeding means includes a ribbon-feeding mechanism for feeding the ink ribbon along a substantially V-shaped feed path.

66. The thermal printer according to claim 60, wherein said recording head is positioned removable from the ink ribbon, and substantially at right angles to the recording surface.

67. The thermal printer according to claim 60, wherein said recording head is inclined to the recording surface, at a first angle while being moved in the first mode and at a second angle while being moved in the second mode.

68. The thermal printer according to claim 60, wherein said ribbon-feeding means comprises back tension-applying means for applying a back tension to the ink ribbon, a first ribbon-feeding mechanism located whereabouts portion of the ink ribbon which is being fed to the distal end of said recording head, for feeding the ink ribbon in the first mode, and a second ribbon-feeding mechanism located whereabouts portion of the ink ribbon is being fed away from the distal end of said recording head, for feeding the ink ribbon in the second mode.

69. The thermal printer according to claim 60, wherein said cover layer is discontinuously formed on the ink layer.

70. The thermal printer according to claim 60, wherein said energy-applying means applies recording pulse width to the ink ribbon in the second mode shorter than in the first mode, through the distal end of said recording head to print patterns on the recording surface.

71. The thermal printer according to claim 60, wherein said energy-applying means includes means for generating shorter recording pulse width in the first mode than in the second mode to enable said recording head to print bit patterns on the recording surface.

72. The thermal printer according to claim 60, wherein said drive means drives said energy-applying means at the first speed, in the first direction in the first mode and in the second direction in the second mode, and said ribbon-feeding means feeds the ink ribbon in the second direction at the second speed lower than the first speed, whereby less in is transferred from the ink ribbon on the recording surface in the second mode than in the first mode.

73. A thermal printer for printing patterns on recording surface by transferring ink onto the recording surface, said printer comprising:

ink ribbon having an ink layer and a cover layer deposited on the ink layer, said cover layer being made of white or transparent material which softens when heated;

means for generating heat including a linear array of heating elements which contacts the ink ribbon when the printer is set in a recording mode, the heating elements selectively applying heat to the ink ribbon whereby that portion of the ink layer which contacts the recording surface is softened and transferred onto the recording surface;

drive means for driving said heat-generating means at a first drive speed in a first direction in a first mode, and at a second drive speed in a second direction, which is opposite to the first direction, in a second drive mode, such that the array of the heating elements slides on the ink ribbon; and ribbon feeding means for continuously feeding the ink ribbon in the second direction, thereby to move the ink ribbon at a first feeding speed relative to the recording surface while said heat generating means is driven in the first drive mode, and at a second feeding speed relative to the recording surface while said heat-generating means is driven in the second drive mode.

74. The thermal ink transfer printer according to claim 73, further comprising signal-generating means for generating recording signal in accordance with the pattern to be recorded on the recording surface, and for supplying the recording signal to the heating elements of said recording head, whereby the heating elements generate heat.

75. The thermal ink transfer printer according to claim 73, wherein said drive means includes carrying means for carrying said heat-generating means, and a mechanism for moving the carrying means in the first direction in the first mode, and in the second direction in the second mode.

76. The thermal ink transfer printer according to claim 73, wherein said drive means includes carrying means for carrying said heat-generating means, said ribbon-feeding means, and said ink ribbon, and a mechanism for moving the carrying means in the first direction in the first mode, and in the second direction in the second mode.

77. The thermal ink transfer printer according to claim 73, wherein said drive means moves said heat generating means at a first speed in the first direction in the first mode, and also at the first speed in the second direction in the second mode; and said ribbon feeding means feeds the ink ribbon at the first speed in the second direction, virtually not moving the ink ribbon relative to the recording surface in the first mode.

78. The thermal ink transfer printer according to claim 73, wherein said drive means moves said heat generating means at a first speed in the first direction in the first mode, and also at the first speed in the second direction in the second mode; and said ribbon feeding means feeds the ink ribbon in the second direction at the second speed which is slower than the first speed.

79. The thermal ink transfer printer according to claim 73, wherein said heat-generating means includes a recording head having a distal end set in a substantially line-contact with the ink ribbon, and said ribbon-feeding means includes a ribbon-feeding mechanism for feeding the ink ribbon along a substantially V-shaped feed path.

80. The thermal ink transfer printer according to claim 73, wherein said recording head is positioned removable from the ink ribbon, and substantially at right angles to the recording surface.

81. The thermal ink transfer printer according to claim 73, wherein said recording head is inclined to the recording surface, at a first angle while being moved in the first mode and at a second angle while being moved in the second mode.

82. The thermal ink transfer printer according to claim 73, wherein said ribbon-feeding means comprises back tension-applying means for applying a back tension to the ink ribbon, a first ribbon-feeding mechanism located whereabouts portion of the ink ribbon is being fed to the heating elements, for feeding the ink ribbon in the first mode, and a second ribbon-feeding mechanism located whereabouts portion of the ink ribbon which is being fed away from the heating elements, for feeding the ink ribbon in the second mode.

83. The thermal ink transfer printer according to claim 73, wherein said cover layer is discontinuously formed on the ink layer.

84. The thermal ink transfer printer according to claim 73, wherein said drive means drives said heat generating means at the first speed, in the first direction in the first mode and in the second direction in the second mode, and said ribbon-feeding means feeds the ink ribbon in the second direction at the second speed lower than the first speed, whereby less ink is transferred from the ink ribbon onto the recording surface in the second mode than in the first mode.

85. The thermal ink transfer printer according to claim 73, further comprising bit data-generating means for generating bit data representing a pattern to be printed on the recording surface, and means for generating a recording energy to be supplied to the heating elements, in accordance with the bit data generated by the bit data-generating means.

86. The thermal ink transfer printer according to claim 73, wherein said bit data-generating means generates first pattern data consisting of n bits ($n \geqq 2$) for horizontal direction in the first mode, and second pattern data consisting of (n−m) bits ($n \geqq 1$) for horizontal direction in the second mode even if the patterns to be printed are identical.

87. The thermal ink transfer printer according to claim 73, wherein said bit data-generating means includes means for changing the first pattern data consisting of n bits ($n \geqq 2$) for horizontal direction to the second pattern data consisting of (n−m) bits ($n \geqq 1$) for horizontal direction.

88. A thermal printer for printing patterns on recording surface by transferring ink onto the recording surface, said printer comprising:

ink ribbon having an ink layer;

means for generating heat including a linear array of heating elements which contacts the ink ribbon when the printer is set in a recording mode, the heating elements selectively applying heat to the ink ribbon whereby that portion of the ink layer which contacts the recording surface is softened and transferred onto the recording surface;

drive means for driving said heat-generating means at a first drive speed in a first direction in a first mode, and at a second drive speed in a second direction, which is opposite to the first direction, in a second drive mode, such that the array of the heating elements slides on the ink ribbon;

ribbon feeding means for continuously feeding the ink ribbon in the second direction, thereby to move the ink ribbon at a first feeding speed relative to the recording surface while said heat generating means is driven in the first drive mode, and at a second feeding speed relative to the recording surface while said heat-generating means is driven in the second drive mode; and signal-generating means for generating a recording signal in accordance with the pattern to be recorded on the recording surface, and for supplying the recording signal to said heating elements of said recording head, whereby the heating elements generates heat which transports to the ink ribbon for a shorter period of time in the second mode than the first mode.

89. The thermal ink transfer printer according to claim 88, further comprising signal-generating means for generating recording signal in accordance with the pattern to be recorded on the recording surface, and for supplying the recording signal to the heating elements of said recording head, whereby the heating elements generate heat.

90. The thermal ink transfer printer according to claim 88, wherein said drive means includes carrying means for carrying said heat-generating means, and a mechanism for moving the carrying means in the first direction in the first mode, and in the second direction in the second mode.

91. The thermal ink transfer printer according to claim 88, wherein said drive means includes carrying means for carrying said heat-generating means, said ribbon-feeding means, and said ink ribbon, and a mechanism for moving the carrying means in the first direction in the first mode, and in the second direction in the second mode.

92. The thermal ink transfer printer according to claim 88, wherein said drive means moves said heat generating means at a first speed in the first direction in the first mode, and also at the first speed in the second direction in the second mode; and said ribbon feeding means feeds the ink ribbon at the first speed in the second direction, virtually not moving the ink ribbon relative to the recording surface in the first mode.

93. The thermal ink transfer printer according to claim 88, wherein said drive means moves said heat generating means at a first speed in the first direction in the first mode, and also at the first speed in the second direction in the second mode; and said ribbon feeding means feeds the ink ribbon in the second direction at the second speed which is slower than the first speed.

94. The thermal ink transfer printer according to claim 88, wherein said heat-generating means includes a recording head having a distal end set in a substantially line-contact with the ink ribbon, and said ribbon-feeding means includes a ribbon-feeding mechanism for feeding the ink ribbon along a substantially V-shaped feed path.

95. The thermal ink transfer printer according to claim 88, wherein said recording head is positioned removable from the ink ribbon, and substantially at right angles to the recording surface.

96. The thermal ink transfer printer according to claim 88, wherein said recording head is inclined to the recording surface, at a first angel while being moved in the first mode and at a second angle while being moved in the second mode.

97. The thermal ink transfer printer according to claim 88, wherein said ribbon-feeding means comprises back tension-applying means for applying a back tension to the ink ribbon, a first ribbon-feeding mechanism located whereabouts portion of the ink ribbon is being fed to the heating elements, for feeding the ink ribbon in the first mode, and a second ribbon-feeding mechanism located whereabouts portion of the ink ribbon which is being fed away from the heating elements, for feeding the ink ribbon in the second mode.

98. The thermal ink transfer printer according to claim 88, wherein said cover layer is discontinuously formed on the ink layer.

99. The thermal ink transfer printer according to claim 88, wherein said drive means drives said heat generating means at the first speed, in the first direction in the first mode and in the second direction in the second mode, and said ribbon-feeding means feeds the ink ribbon in the second direction at the second speed lower than the first speed, whereby less ink is transferred from the ink ribbon onto the recording surface in the second mode than in the first mode.

100. The thermal ink transfer printer according to claim 88, further comprising bit data-generating means for generating bit data representing a pattern to be printed on the recording surface, and means for generating a recording energy to be supplied to the heating elements, in accordance with the bit data generated by the bit data-generating means.

101. The thermal ink transfer printer according to claim 88, wherein said bit data-generating means generates first pattern data consisting of n bits ($n \geqq 2$) for horizontal direction in the first mode, and second pattern data consisting of (n–m) bits ($n \geqq 1$) for horizontal direction in the second mode even if the patterns to be printed are identical.

102. The thermal ink transfer printer according to claim 88, wherein said bit data-generating means includes means for changing the first pattern data consisting of n bits ($n \geqq 2$) for horizontal direction to the second pattern data consisting of (n–m) bits ($n \geqq 1$) for horizontal direction.

103. A thermal printer for printing patterns on recording surface by transferring ink onto the recording surface, said printer comprising:

ink ribbon having a heat-generating layer, an ink layer formed on th heat-generating layer and a cover layer deposited on the ink layer, said cover layer being made of white or transparent material which softens when heated;

means for applying a recording current to said ink ribbon, including a linear array of recording electrodes which contacts the ink ribbon when the printer is set in a recording mode, the recording electrodes selectively supplying the recording mode, the recording electrodes selectively supplying the recording current to the ink ribbon whereby said heat-generating layer generates heat, and said ink layer is softened by the heat and transferred onto the recording surface;

drive means for driving said current applying means is at a first drive speed in a first direction crossing the linear array of the recording electrodes in a first drive mode, and at a second drive speed in a second direction, which is opposite to the first direction, in a second drive mode, such that the array of the recording electrodes slides on the ink ribbon; and ribbon feeding means for continuously feeding the ink ribbon in the second direction, thereby to move the ink ribbon at a first feeding speed relative to the recording surface while said heat generating means is driven in the first drive mode, and at a second feeding speed relative to the recording surface while said heat-generating means is driven in the second drive mode.

104. The electrothermal printer according to claim 103, further comprising current-generating means for generating a recording current in accordance with a pattern to be printed on the recording surface, and supplying the recording current to the recording electrodes of said current applying means, whereby the heat-generating layer of the ink ribbon generates heat.

105. The electrothermal printer according to claim 103, further comprising a return electrode kept in contact with the heat-generating layer, for collecting the recording current flowing in the heat-generating layer.

106. The electrothermal printer according to claim 103, wherein said return electrode is kept in contact with that portion of the ink ribbon which is being fed toward said recording electrodes of said current applying means.

107. The electrothermal printer according to claim 103, wherein said drive means includes carrying means for carrying said current-applying means, and a mechanism for moving the carrying means in the first direction in the first mode, and in the second direction in the second mode.

108. The electrothermal printer according to claim 103, wherein said drive means includes carrying means for carrying said current-applying means, said ribbon-feeding means, and said ink ribbon, and a mechanism for moving the carrying means in the first direction in the first mode, and in the second direction in the second mode.

109. The electrothermal printer according to claim 103, wherein said drive means moves said current applying means at a first speed in the first direction in the first mode, and also at the first speed in the second direction in the second mode; and said ribbon feeding means feeds the ink ribbon at the first speed in the second direction, virtually not moving the ink ribbon relative to the recording surface in the first mode.

110. The electrothermal printer according to claim 103, wherein said recording electrodes are set in a substantially line-contact with the ink ribbon, and said ribbon-feeding means includes a ribbon-feeding mechanism for feeding the ink ribbon along a substantially V-shaped feed path.

111. The electrothermal printer according to claim 103, wherein said recording electrodes are positioned removable from the ink ribbon, and substantially at right angles to the recording surface.

112. The electrothermal printer according to claim 103, wherein said recording electrodes are inclined to the recording surface, at a first angle while being moved in the first mode and at a second angle while being moved in the second mode.

113. The electrothermal printer according to claim 103, wherein said ribbon-feeding means comprises back tension-applying means for applying a back tension to the ink ribbon, a first ribbon-feeding mechanism located whereabouts portion of the ink ribbon being fed to said recording electrodes, for feeding the ink ribbon in the first mode, and a second ribbon-feeding mechanism located whereabouts, portion of the ink ribbon which is being fed away from said recording electrodes, for feeding the ink ribbon in the second mode.

114. The electrothermal printer according to claim 103, wherein said cover layer is discontinuously formed on the ink layer.

115. The electrothermal printer according to claim 103, wherein said drive means drives said current applying means at the first speed, in the first direction in the first mode and in the second direction in the second mode, and said ribbon-feeding means feeds the ink ribbon in the second direction at the second speed lower than the first speed, whereby less ink is transferred from the ink ribbon onto the recording surface in the second mode than in the first mode.

116. The electrothermal printer according to claim 103, further comprising bit data-generating means for generating bit data representing a pattern to be printed on the recording surface, and means for generating a recording current to be supplied to the recording electrodes, in accordance with the bit data generated by the bit data-generating means.

117. The electrothermal printer according to claim 116, wherein said bit data-generating means generates first pattern data consisting of n bits ($n \geqq 2$) for horizontal direction in the first mode, and second pattern data consisting of (n–m) bits ($n \geqq 1$) for horizontal direction in the second mode even if the patterns to be printed are identical.

118. The electrothermal printer according to claim 116, wherein said bit data-generating means includes means for changing the first pattern data consisting of n bits ($n \geqq 2$) for horizontal direction to the second pattern data consisting of (n–m) bits ($n \geqq 1$) for horizontal direction.

119. An electrothermal printer for printing ink onto the recording surface, said printer comprising:

ink ribbon having a heat-generating layer and an ink layer formed on th heat-generating layer;

means for applying a recording current to said ink ribbon, including a linear array of recording electrodes which contacts the ink ribbon when the printer is set in a recording mode, the recording electrodes selectively supplying the recording current to the ink ribbon whereby said heat-generating layer generates heat, and said ink layer is softened by the heat and transferred onto the recording surface;

drive means for driving said current applying means is at a first drive speed in a first direction crossing the linear array of the recording electrodes in a first drive mode, and at a second drive speed in a second direction, which is opposite to the first direction, in a second drive mode, such that the array of the recording electrodes slides on the ink ribbon;

ribbon feeding means for continuously feeding the ink ribbon in the second direction, thereby to move the ink ribbon at a first feeding speed relative to the recording surface while said heat generating means is driven in the first drive mode, and at a second feeding speed relative to the recording surface while said heat-generating means is driven in the second drive mode; and signal-generating means for generating a recording signal in accordance with the pattern to be recorded on the recording surface, and for supplying the recording signal to said recording electrodes of said applying means, whereby the recording electrodes applies the current to the ink ribbon for a shorter period of time in the second mode than the first mode.

120. The electrothermal printer according to claim 119, further comprising current-generating means for generating a recording current in accordance with a pattern to be printed on the recording surface, and supplying the recording current to the recording electrodes of said current applying means, whereby the heat-generating layer of the ink ribbon generates heat.

121. The electrothermal printer according to claim 119, further comprising a return electrode kept in contact with the heat-generating layer, for collecting the recording current flowing in the heat-generating layer.

122. The electrothermal printer according to claim 119, wherein said return electrode is kept in contact with that portion of the ink ribbon which is being fed toward said recording electrodes of said current applying means.

123. The electrothermal printer according to claim 119, wherein said drive means includes carrying means for carrying said current-applying means, and a mechanism for moving the carrying means in the first direction in the first mode, and in the second direction in the second mode.

124. The electrothermal printer according to claim 119, wherein said drive means includes carrying means for carrying said current-applying means, said ribbon-feeding means, and said ink ribbon, and a mechanism for moving the carrying means in the first direction in the first mode, and in the second direction in the second mode.

125. The electrothermal printer according to claim 119, wherein said drive means moves said current applying means at a first speed in the first direction in the first mode, and also at the first speed in the second direction in the second mode; and said ribbon feeding means feeds the ink ribbon at the first speed in the second direction, virtually not moving the ink ribbon relative to the recording surface in the first mode.

126. The electrothermal printer according to claim 119, wherein said drive means moves said current applying means at a first speed in the first direction in the first mode, and also at the first speed in the second direction in the second mode; and said ribbon feeding means feeds the ink ribbon in the second direction at the second speed which is slower than the first speed.

127. The electrothermal printer according to claim 119, wherein said recording electrodes are set in a substantially line-contact with the ink ribbon, and said ribbon-feeding means includes a ribbon-feeding mechanism for feeding the ink ribbon along a substantially V-shaped feed path.

128. The electrothermal printer according to claim 119, wherein said recording electrodes are positioned removable from the ink ribbon, and substantially at right angles to the recording surface.

129. The electrothermal printer according to claim 103, wherein said recording electrodes are inclined to the recording surface, at a first angel while being moved in the first mode and at a second angle while being moved in the second mode.

130. The electrothermal printer according to claim 103, wherein said ribbon-feeding means comprises:

back tension-applying means for applying a back tension to the ink ribbon;

a first ribbon-feeding mechanism located whereabouts portion of the ink ribbon being fed to said recording electrodes, for feeding the ink ribbon in the first mode, and a second ribbon-feeding mechanism located whereabouts, portion of the ink ribbon which is being fed away from said recording electrodes, for feeding the ink ribbon in the second mode.

131. The electrothermal printer according to claim 130, wherein said cover layer is discontinuously formed on the ink layer.

132. The electrothermal printer according to claim 103, wherein said drive means drives said current applying means at the first speed, in the first direction in the first mode and in the second direction in the second mode, and said ribbon-feeding means feeds the ink ribbon in the second direction at the second speed lower than the first speed, whereby less ink is transferred from the ink ribbon onto the recording surface in the second mode than in the first mode.

133. The electrothermal printer according to claim 103, further comprising:

bit data-generating means for generating bit data representing a pattern to be printed on the recording surface, and means for generating a recording current to be supplied to the recording electrodes, in accordance with the bit data generated by the bit data-generating means.

134. The electrothermal printer according to claim 133, wherein:

said bit data-generating means generates first pattern data consisting of n bits ($n \geqq 2$) for horizontal direction in the first mode, and second pattern data consisting of (n–m) bits ($n \geqq 1$) for horizontal direction in the second mode even if the patterns to be printed are identical.

135. The electrothermal printer according to claim 133, wherein:

said bit data-generating means includes means for changing the first pattern data consisting of n bits ($n \geqq 2$) for horizontal direction to the second pattern data consisting of (n–m) bits ($n \geqq 1$) for horizontal direction.

136. The electrothermal printer according to claim 103, wherein said drive means moves said current applying means at a first speed in the first direction in the first mode, and also at the first speed in the second direction in the second mode; and said ribbon feeding means feeds the ink ribbon in the second direction at the second speed which is slower than the first speed.

* * * * *